US010337239B2

(12) United States Patent
Header

(10) Patent No.: US 10,337,239 B2
(45) Date of Patent: Jul. 2, 2019

(54) HIGH PERFORMANCE FENESTRATION SYSTEM

(71) Applicant: Gregory A. Header, Richland, PA (US)

(72) Inventor: Gregory A. Header, Richland, PA (US)

( * ) Notice: Subject to any disclaimer, the term of this patent is extended or adjusted under 35 U.S.C. 154(b) by 205 days.

(21) Appl. No.: 15/376,183

(22) Filed: Dec. 12, 2016

(65) Prior Publication Data

US 2018/0163458 A1 Jun. 14, 2018

(51) Int. Cl.
*E06B 7/14* (2006.01)
*E06B 3/36* (2006.01)
(Continued)

(52) U.S. Cl.
CPC ..... *E06B 7/14* (2013.01); *E06B 3/362* (2013.01); *E06B 3/365* (2013.01);
(Continued)

(58) Field of Classification Search
CPC .. E06B 3/26301; E06B 3/26303; E06B 3/325; E06B 3/36; E06B 2003/7094; Y10S 49/01
See application file for complete search history.

(56) References Cited

U.S. PATENT DOCUMENTS 3,203,053 A * 8/1965 Lane ..... E06B 3/26307 49/489.1
4,432,179 A * 2/1984 Bachmann ..... E06B 1/325 49/DIG. 1
(Continued)

FOREIGN PATENT DOCUMENTS

CA 2036939 C 1/1996
CA 2184930 A1 3/1998
(Continued)

OTHER PUBLICATIONS

Peerless GT2 Thermal Aluminum Inswing Terrace Door, Terrace Door Product Brochure, Feb. 3, 2016, Peerless Products Inc., Fort Scott, Kansas, US.
(Continued)

*Primary Examiner* — Catherine A Kelly
(74) *Attorney, Agent, or Firm* — Stone Creek Services LLC; Alan M Flum

(57) ABSTRACT

A high-performance fenestration system that includes a pressure chamber formed between longitudinally adjacent fenestration members. The pressure chamber is positioned on one side of the thermal break. The fenestration system can be configured so to create a continuous pressure chamber around the closed perimeter of the fenestration between the frame and sash. The resulting fenestration system enjoys significantly better water penetration resistance as compared with conventional high-performance doors and windows. Because of the positioning and structural configuration of the pressure chamber, the fenestration system can be configured to accept different hinge styles including Euro-style and American-style hinges without significant loss of performance. In addition, the system can accept American-style door hardware or Euro-style door hardware.

12 Claims, 40 Drawing Sheets

(51) Int. Cl.
*E06B 1/70* (2006.01)
*E06B 3/263* (2006.01)

(52) U.S. Cl.
CPC ..... *E06B 2001/707* (2013.01); *E06B 2003/26389* (2013.01); *Y10S 49/01* (2013.01)

(56) References Cited

U.S. PATENT DOCUMENTS

| | | | | | |
|---|---|---|---|---|---|
| 4,471,589 | A * | 9/1984 | Schmidlin | E06B 3/2605 | 52/171.3 |
| 4,614,062 | A * | 9/1986 | Sperr | E06B 3/26303 | 49/401 |
| 4,640,054 | A * | 2/1987 | Breimeier | E06B 3/26343 | 49/504 |
| 4,688,366 | A * | 8/1987 | Schmidt | E06B 3/2675 | 264/261 |
| 4,815,245 | A * | 3/1989 | Gartner | E06B 3/26343 | 49/DIG. 1 |
| 4,999,950 | A | 3/1991 | Beske et al. | | |
| 5,044,121 | A * | 9/1991 | Harbom | E06B 3/325 | 49/401 |
| 5,924,244 | A * | 7/1999 | Ohman | E05D 15/44 | 49/248 |
| 6,588,154 | B1 * | 7/2003 | Miller | E06B 3/50 | 49/401 |
| 8,276,320 | B2 * | 10/2012 | Erbrect | E06B 7/14 | 49/471 |
| 9,062,490 | B2 * | 6/2015 | Kadavy | E06B 7/16 | |
| 9,920,568 | B2 * | 3/2018 | Rethmeier | E06B 3/26303 | |
| 10,113,356 | B2 * | 10/2018 | Lenox | E06B 3/26303 | |
| 2004/0025454 | A1 * | 2/2004 | Burgess | E06B 3/26301 | 52/204.1 |
| 2014/0237918 | A1 | 8/2014 | Miller | | |
| 2017/0350186 | A1 * | 12/2017 | Philips | E06B 3/26301 | |
| 2018/0216397 | A1 * | 8/2018 | Chen | E06B 3/36 | |

FOREIGN PATENT DOCUMENTS

| | | | |
|---|---|---|---|
| CN | 202117492 | U | 1/2012 |
| CN | 205918298 | U | 2/2017 |
| FR | 2877032 | A1 | 4/2006 |
| FR | 2880056 | B1 | 7/2008 |

OTHER PUBLICATIONS

Peerless GT3 Thermal Aluminum Inswing Terrace Door, Terrace Door Product Brochure, Feb. 3, 2016, Peerless Products Inc., Fort Scott, Kansas, US.

Graham Architectural Products Terrace Door—2 3/4" Series GT7700, Mar. 16, 2013, Graham Architectural Products, York, Pennsylvania, US.

1700 D00R, Jun. 2014, Skyline Windows, Bronx, NY US.

Brent Miller, Re: HP In-swing TD (In-house and private testing of the Inventor's own work), Oct. 11, 2016, Solar Innovations Inc., Pine Grove, Pennsylvania, US.

NX-8900 Terrace Doors, Document No. SPCA300EN, Aug. 2016, Kawneer Company, Inc., Norcross, Georgia, US.

9050 Series Spec Data Sheet, Oct. 2010, WinDoor Incorporated., Orlando, Florida, US.

Azo-Core thermal barrier, Azo-core Brochure, Aug. 2016, Azon, Kalamazoo, Michigan, US.

B.M. Brown, Requisition by the Examiner, Canadian Patent Application No. CA298,692, Sep. 26, 2018, Canadian Intellectual Property Office, Gatineau, Quebec, Canada.

* cited by examiner

HIGH PERFORMANCE FENESTRATION SYSTEM

BACKGROUND

This disclosure relates to fenestration systems. Fenestration systems can include door and window openings such as glazed inswing doors, glazed inswing windows, glazed outswing doors, glazed outswing windows, glazed bifold doors, glazed pivot doors, and fixed-lite fenestrations. Specifically, this disclosure relates to "high-performance" (i.e. weather performing and energy efficient) fenestration systems.

High-performance fenestration systems are designed to protect building interiors from wind and rain and improve energy efficiency. A typical high-performance fenestration system includes a frame surrounding the fenestration opening and a movable glass panel surrounded by a frame known as a sash. Each frame and each sash can be constructed from horizontal and vertical members made of extruded aluminum or other structurally rigid materials. While aluminum is both strong and lightweight, it is thermally conductive and not energy efficient. To increase energy efficiency, frame and sash members can be constructed from pairs of aluminum extrusions that are thermally isolated from each other. Out of each pair, one extrusion faces an environment protected by the fenestration, for example, the interior environment, and the other extrusion faces an environment not protected by the fenestration, for example, the exterior environment. Thermal struts, structural foam, or other structural thermally isolating materials, can rigidly join the protected-environment-facing extrusion and corresponding unprotected-environment-facing extrusion. The thermal struts are made of thermally isolating material such as polyamide. The thermal struts are typically crimped into grooves in the extrusions by large crimping rollers. Alternatively, materials, such as polyurethane foam, can be poured or injected. The portion of the frame where the thermal strut or other structural thermally isolating material resides is referred to as a "thermal break." The thermal break thermally isolates the protected-environment-facing extrusion from the unprotected-environment-facing extrusion. The glass panel is typically constructed of sealed double or triple panes of glass. The glass panes within the glass panel are thermally isolated from each other by air or gas between the panes.

One strategy to increase rain and wind performance is to pressurize the air space inside the frame. Weep holes, typically at the bottom and top of the frame, allow air pressure from wind to build up inside the frame. This air pressure becomes equalized with the outside pressure preventing wind driven rain from entering the frame. Many pressurized fenestration frames depend on interior glazing seals to hold the air pressure. Because the interior glazing seals reside in the protected environment, they are not exposed to harsh conditions. They are less likely to degrade over time compared with exterior glazing seals. The exterior glazing seals, on the other hand, can be exposed to ultraviolet light from the sun, as well as large temperature variations. Over time, they can lose its integrity and leak. Any rain that leaks into the window through the outside seal can drain through the weep holes.

Standards organizations, such as ASTM International, have developed standards to test rain leakage performance. One such standard is ASTM E331. This standard tests water penetration into exterior windows, skylights, doors, and curtain walls by applying a uniform and constant pressure difference between the interior and exterior of the fenestration. Some high-performance inswing terrace doors currently on the market can resist water penetration, as measured by ASTM E331, with a pressure difference of up to 718 Pascals (Pa) or 15 pounds per square foot (psf).

SUMMARY

The inventor sought to improve the water resistance performance of inswing terrace doors as well as other high-performance fenestrations. After much experimentation and testing, the inventor observed that air leakage between the thermal struts and the frame sections can cause performance loss. The thermal struts can naturally shift while the door or window is in use. This shifting can cause loss of integrity and leakage in the seal between the thermal strut and frame or alternatively, between the thermal strut and sash. The inventor discovered that by isolating the pressure chamber to one side of the thermal break, leakage between the thermal struts becomes less significant. To further enhance performance, the inventor formed the pressure chamber by overlapping parallel leg ends, from corresponding longitudinally adjacent fenestration frame members. For example, longitudinally adjacent fenestration frame members could be adjacent sash and frame members. It could also be adjacent sash and astragal members. The fenestration frame members were structured so that the pressure chamber was continuous around the perimeter of the fenestration between the frame and sash. For a French-style door, the pressure chamber could be continuous between the frame and sash perimeter and include the sash and astragal.

On Oct. 6, 2016, the National Certified Testing Laboratories (NCTL) witnessed a water penetration test according to ASTM E331 on an improved inswing terrace door developed by the inventor and described in the present disclosure. The inswing terrace door developed by the inventor passed 1197 Pa (25 psf) on this test. After making some hardware modifications, the inswing terrace door, passed 1915 Pa (40 psf) when tested in accordance with ASTM E331 on Oct. 11, 2016 during in-house testing.

In addition, the high-performance fenestration system developed by the inventor yielded additional unexpected results. (1) Because the pressure chamber is on one side of the thermal break, the door can be designed to accept different hinge styles on the opposite side of the thermal break as the pressure chamber without compromising performance. For example, the high-performance fenestration can accept Euro-style hinges or American-style hinges. (2) The structure allows the lockset to be mounted in a Euro-style or American-style position. To the inventor's knowledge, this was never before possible for a pressured high-performance terrace door. (3) It is possible to make structural modifications to the non-chamber side of the fenestration without affecting water penetration performance. (4) The dedicated pressure chamber is relatively easy to clean and maintain.

Applying principles from the inventor's inswing door, the inventor designed a high-performance fenestration system that can also be applied inswing French doors, outswing doors, outswing French doors, bifold doors, pivot doors, and fixed-lite fenestrations. These are described in detail in the Description. The system can readily be applied to inswing and outswing windows. It is the inventor's intention that the high-performance fenestration is not limited to these examples. The inventor anticipates that the principles of his high-performance fenestration system can be applied to a wide range of fenestrations as will become apparent from this disclosure.

DRAWINGS

DESCRIPTION

Figure 1:
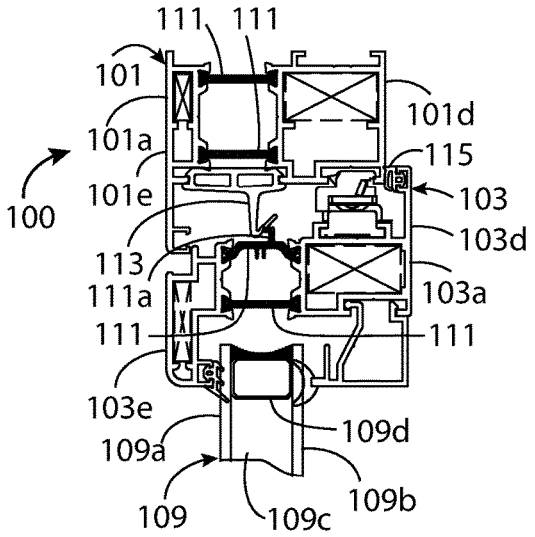
FIG. 1 Prior Art
FIG. 1 illustrates a section of the head sash member and head frame member of a prior art inswing door.

The following terms are used throughout this disclosure and are defined here for clarity and convenience.

American-style (in reference to door hardware): As defined in this disclosure, door hardware mounted in American-style or in a American-style position refers to a combination of door handle and lockset where the lockset is positioned approximately through the center of the fenestration frame member.

American-style Hinge: As defined in this disclosure, an American-style hinge is a hinge mounted to faces of adjacent fenestration members. For example, the hinge can be mounted to the face of a sash and the face of a frame.

Astragal: As defined in this disclosure, an astragal is a portion that joins two sashes or operating door panels.

Euro-style (in reference to door hardware): As defined in this disclosure, door hardware mounted Euro-style or in a Euro-style position refers to a combination of door handle and lockset where the lockset is positioned proximate to interior side of fenestration frame for an inswing door and is positioned proximate to the exterior side of the fenestration frame for an outswing door.

Euro-style Hinge: As defined in this disclosure, a Euro-style hinge is a hinge mounted within a slide-in or snap-in grooves of adjacent fenestration members. These grooves are known in the art as "Euro-grooves." This is distinguished from (i.e. not the same as) European-style cabinet hinges.

Fenestration: As defined in this disclosure, a fenestration refers to a glazed opening (e.g. an opening that includes a glass panel or other in-fill panel) such as a door or window. The fenestration can include a frame in combination with one or more movable or non-movable infill panels. The infill panel is surrounded by a sash. Examples of fenestrations include inswing, outswing, or bifold doors and windows as well as pivot doors or a combination of the above.

Fenestration Frame Member: As defined in this disclosure, a fenestration frame member refers to a frame member, a sash member, or an astragal.

Fixed-lite: As defined in this disclosure, a fixed-lite, or fixed-light is a fenestration that does not open.

Frame: As defined in this disclosure, a frame refers to the stationary portion of the door or window that encloses the sash. The frame is generally comprises frame members. A frame member can be a horizontal (head or sill) or vertical (side jambs) portion of the frame.

Glazing Stop: As defined in this disclosure, a glazing stop includes a removable rigid member, or molding, with optional cushioning material that holds an infill panel in the frame or sash. The rigid member can be made of wood, metal, plastic, or other rigid materials. The glazing stop can include gasketing or other cushioning material to buffer direct contact between the rigid member and the infill panel.

Head: As defined in this disclosure, a head, or head jamb, refers to a top member of a frame.

Infill Panel: As defined in this disclosure, infill refers to a panel such as glass, polycarbonate, acrylic, or aluminum, surrounded by a sash. As defined in this disclosure, an insulated infill panel is an infill panel that includes two or more infill panes separated by a thermal insulator such as urethane foam, air, or an inert gas. An example is an insulated infill panel is known in the art as an insulating glass unit (IG) which includes two or more sealed (i.e. gas tight) panes of glass separated by air or an inert gas.

Jamb: As defined in this disclosure, a jamb refers to a frame member forming the top (head jamb), bottom (sill jamb), or sides (side jambs) of a door or window opening.

Pressure Chamber: As defined in this disclosure, a pressure chamber is a portion of a fenestration formed between two longitudinally adjacent fenestration frame members that attempts to hold or equalize with the pressure of the unprotected environment in order to prevent wind driven water infiltration.

Sash: As defined in this disclosure, a sash refers a frame surrounding an infill panel. For fix-lite fenestrations, the sash is stationary or fixed. For openable fenestrations, the sash together with the infill panel it surrounds forms the movable part of the window or door. A sash member refers to a horizontal or vertical portion of a sash.

Sill: As defined in this disclosure, a sill, or sill jamb, refers to the bottom of the frame that generally rests on the floor.

Setting Block: As defined in this disclosure, a setting block, or stop block, is a cushioning member placed between the infill panel and the sash or frame. Stop blocks are often rectangular and can be made of a material with elastic properties such as ethylene propylene diene monomer (also known as EPDM), polycholorprene (neoprene), rubber, or silicone or other flexible materials suitable for supporting the weight of the infill panel and cushioning it from breakage when secured against a frame or sash.

As defined in this disclosure, and as shown in the figures, the term "Unprotected Environment" indicates the portion of the fenestration that faces the environment not protected by the fenestration. For example, the unprotected environment could be the outside of a building or structure, inside a car wash, or a public area in a hospital. The term "Protected Environment" indicates the portion of the fenestration that faces the environment protected by the fenestration. For example, the protected environment could be the interior of a building or structure, outside of a car wash, or alternatively a protected area of a hospital ward. Note the terms "Protected Environment" and "Unprotected Environment" are defined relative to the fenestration and do not necessary imply anything other than a relative level of protection.

The terms "left", "right", "top", "bottom", "upper", "lower", "vertical", "horizontal", "front", "back", and "side" are relative terms used throughout the to help the reader understand the figures. Unless otherwise indicated, these do not denote absolute direction or orientation and do not imply a particular preference. Specific dimensions are intended to help the reader understand the scale and advantage of the disclosed material. Dimensions given are typical and the claimed invention is not limited to the recited dimensions.

Figure 2:
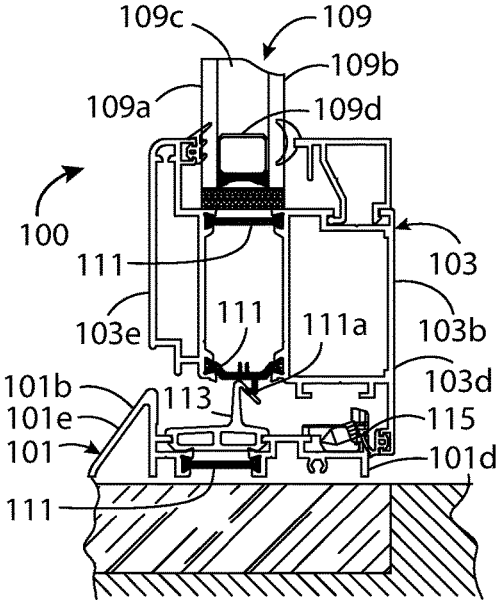
FIG. 2 Prior Art
FIG. 2 illustrates a section of a sill sash member and a sill frame member of the prior art inswing door of FIG. 1.
Figure 3:
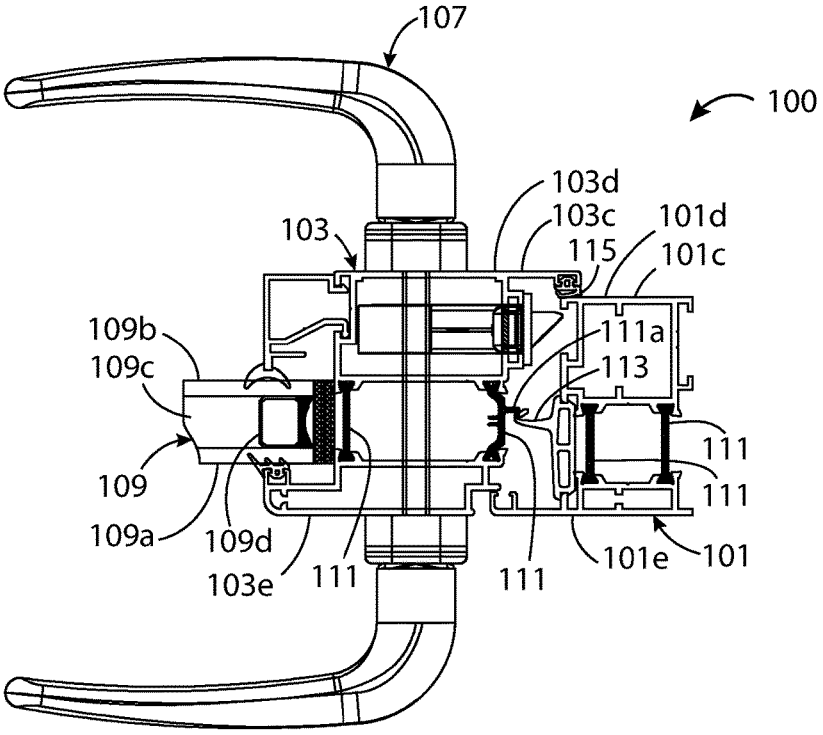
FIG. 3 Prior Art
FIG. 3 illustrates a section of a vertical jamb and a vertical sash of the prior art inswing door of FIG. 1 art showing the door hardware mounted Euro-style.
Figure 4:
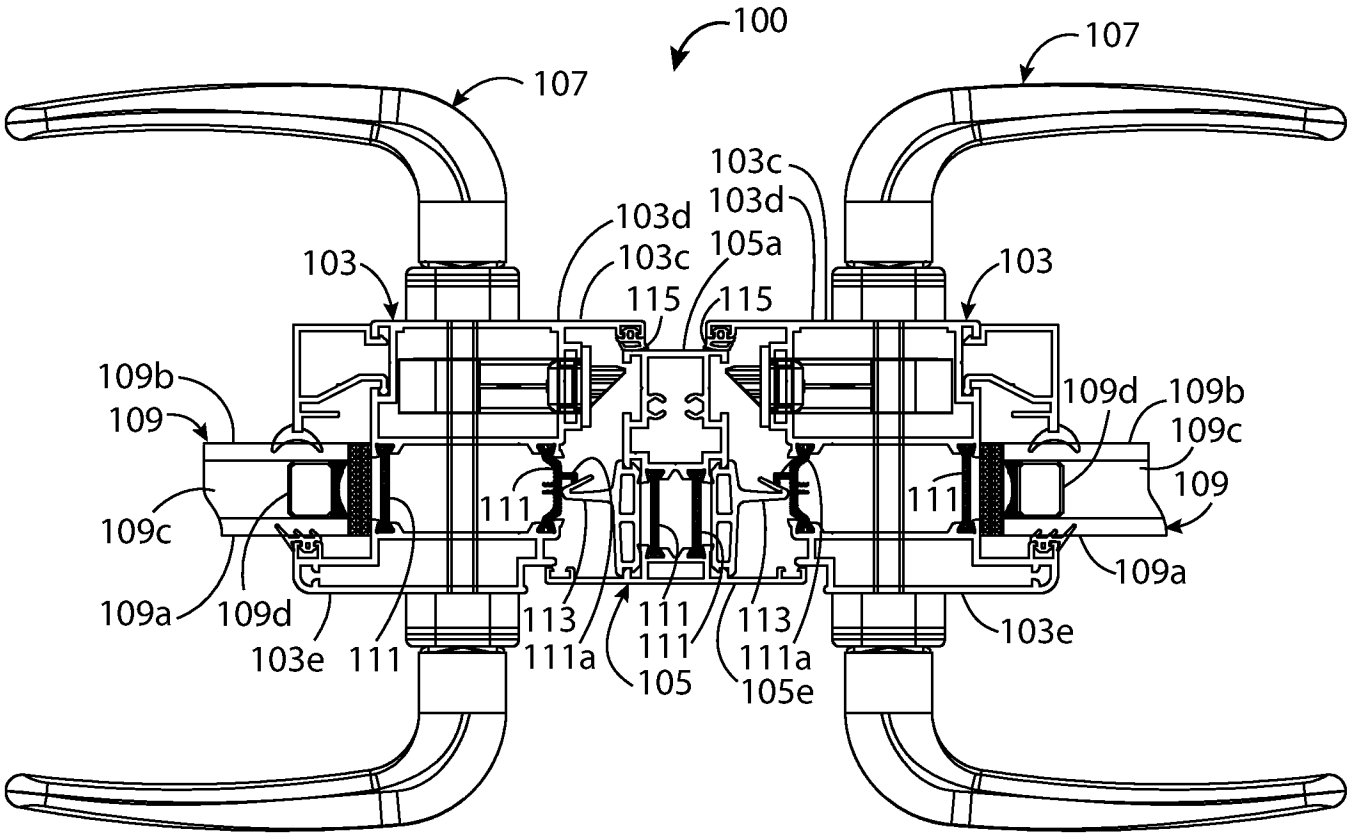
FIG. 4 Prior Art
FIG. 4 illustrates a section of a vertical astragal member and a vertical sash frame member of a prior art inswing French-style door showing the door hardware mounted Euro-style.

FIGS. 1-4 show sections of a prior art inswing door 100. FIG. 1 shows a section of the head frame member 101*a* and head sash member 103*a*. FIG. 2 shows the sill frame member 101*b* and sill sash member 103*b*. FIG. 3 shows a vertical jamb 101*c* in combination with a vertical sash member 103*c*. The vertical sash member 103*c* includes door hardware 107 mounted in a Euro-style position proximate to the protected-environment-facing sash portion 103*d*. FIGS. 1 and 2 can be applied to single inswing doors or French doors. FIG. 4 shows vertical sash members 103*c*, astragal member 105, and door hardware 107 of a French door.

The head frame member 101*a* and head sash member 103*a* (FIG. 1), the sill frame member 101*b* and sill sash member 103*b* (FIG. 2), vertical jamb 101*c* and vertical sash member 103*c* (FIG. 3), can be made of aluminum or an aluminum extrusion. Referring to FIGS. 1-4, to improve thermal performance, the fenestration is divided so that the protected-environment-facing portion (for example, the portion facing an interior environment) and unprotected-environment-facing portion (for example, the portion facing the exterior environment) of the fenestration are thermally isolated. The infill panel 109, the frame 101 (FIGS. 1-3), the sash 103, and the astragal member 105 (FIG. 4), can be divided into a protected-environment-facing portion that faces the protected environment, such as the building interior, and an unprotected-environment-facing portion that faces a relatively less protected environment, such as the building exterior. The protected-environment-facing portions and unprotected-environment-facing portions are separated by a thermal break. The infill panels 109 are shown as double insulated glass. They include an unprotected-environment-facing pane 109*a*, a protected-environment-facing pane 109*b*, and a thermal break between the two panes. The thermal break includes an infill panel cavity 109*c* and a spacer 109*d*. The infill panel cavity 109*c* can be filled with air or other gasses such as argon. In FIGS. 1-3, each frame member includes a protected-environment-facing frame portion 101*d* and an unprotected-environment-facing frame portion 101*e*. In FIGS. 1-4, each sash member includes a protected-environment-facing sash portion 103*d* and an unprotected-environment-facing sash portion 103*e*. In FIG. 4, the astragal member 105 includes a protected-environment-facing astragal portion 105*a* and an unprotected-environment-facing astragal portion 105*e*. In FIGS. 1-3, the protected-environment-facing frame portion 101*d* and unprotected-environment-facing frame portion 101*e* within each frame member are joined by a thermal strut 111. In FIGS. 1-4, the protected-environment-facing sash portion 103*d*, and unprotected-environment-facing sash portion 103*e* are joined by thermal struts 111. In FIG. 4, the protected-environment-facing astragal portion 105*a* and the unprotected-environment-facing astragal portion 105*e* is similarly joined by thermal struts 111. This thermal strut 111 typically is made of polyamide. The thermal strut 111 can be made of other thermally insulating materials with sufficient strength to allow the frames 101, sashes 103, or astragal members 105 to withstand the forces applied in everyday operation. Thermal struts 111 are typically crimped into place between the protected-environment-facing frame portion 101*d* and unprotected-environment-facing frame portion 101*e*, between the protected-environment-facing sash portion 103*d* and unprotected-environment-facing sash portion 103*e*, and between the protected-environment-facing astragal portion 105*a* and unprotected-environment-facing astragal portion 105*e*. The thermal struts 111 can run along the entire length of interior and exterior-facing portions.

In FIGS. 1-3, each of the corresponding sash and frame pairs include two seals. The first seal includes a combination of a gooseneck gasket 113 and a thermal strut projected portion 111*a*. The second seal is formed between a gasket 115 attached to the protected-environment-facing sash portion 103*d* the protected-environment-facing frame portion 101*d* of corresponding head sash member 103*a* and head frame member 101*a* of FIG. 1, sill sash member 103*b* and sill frame member 101*b* of FIG. 2, and vertical sash member 103*c* and vertical jamb 101*c* of FIG. 3. Similarly, in FIG. 4, a first seal includes a combination of gooseneck gasket 113 and thermal strut projected portion 111*a* for each corresponding vertical sash member 103*c* and the astragal member 105. The second seal includes gaskets 115 attached to the protected-environment-facing sash portion 103*d* and resting against the protected-environment-facing astragal portion 105*a*.

The inventor sought to improve the water resistance performance of inswing terrace doors, such as the prior art inswing door 100 illustrated in FIGS. 1-4, as well as other high-performance fenestrations such as outswing doors, bifold doors, pivot doors, or fixed-lite fenestrations. Referring again to FIGS. 1-3, after much experimentation and testing, the inventor observed that air leakage between the thermal struts 111 and their corresponding protected-environment-facing frame portion 101*d* and unprotected-environment-facing frame portion 101*e* might be a cause of performance loss. Referring to FIGS. 1-4, he similarly observed that air leakage between the thermal struts 111 and their corresponding protected-environment-facing sash portion 103*d* and unprotected-environment-facing sash portion 103*e* may similarly cause a performance loss. The thermal struts 111 can naturally shift and move while the door or window is in use. This shifting can cause leakage or loss of integrity in the seal between the thermal strut 111 and frame or between the thermal strut 111 and sash 103.

Figure 5:
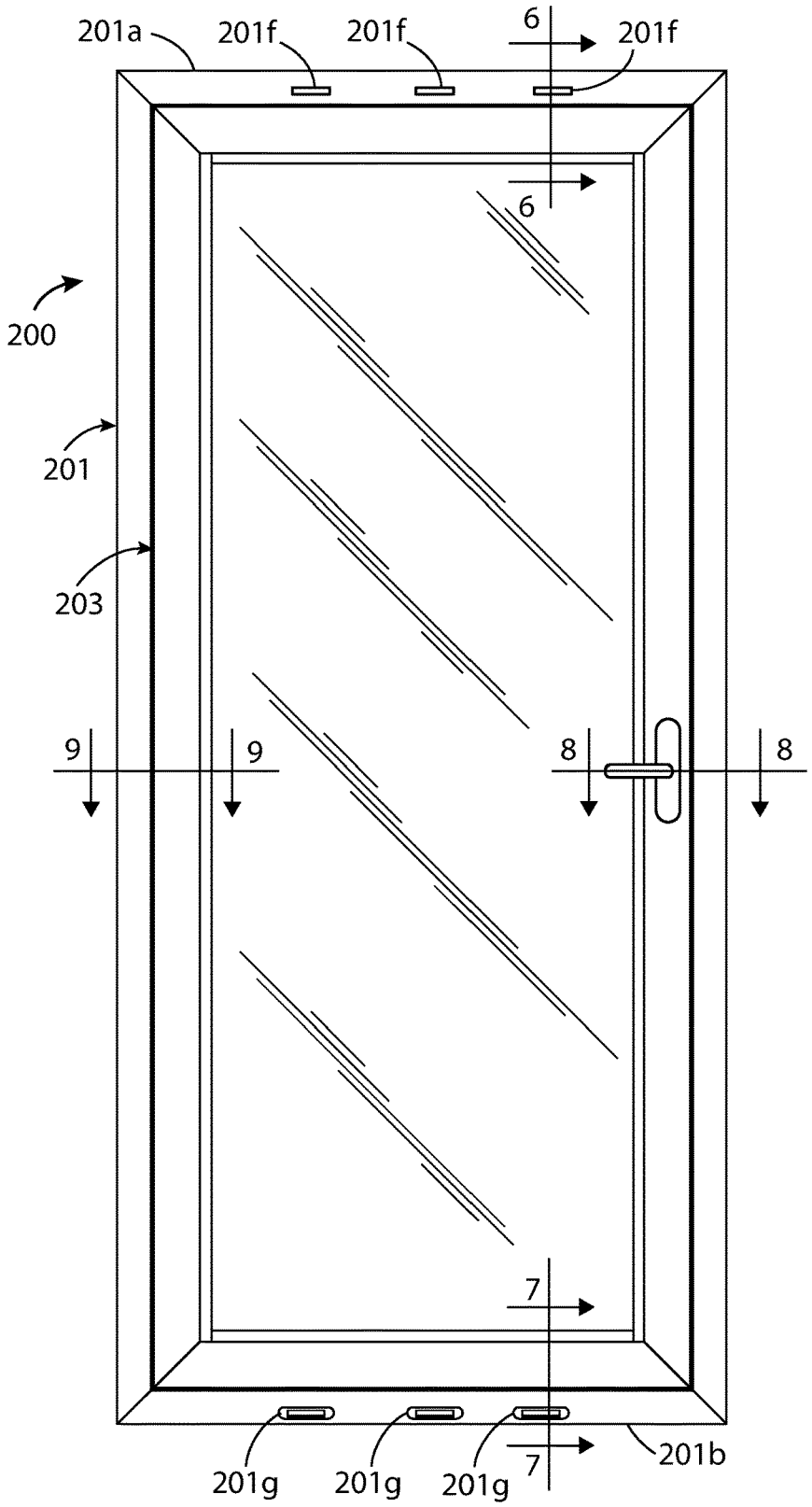
FIG. 5 illustrates the improved inswing door of the present disclosure in front elevation view.
Figure 6:
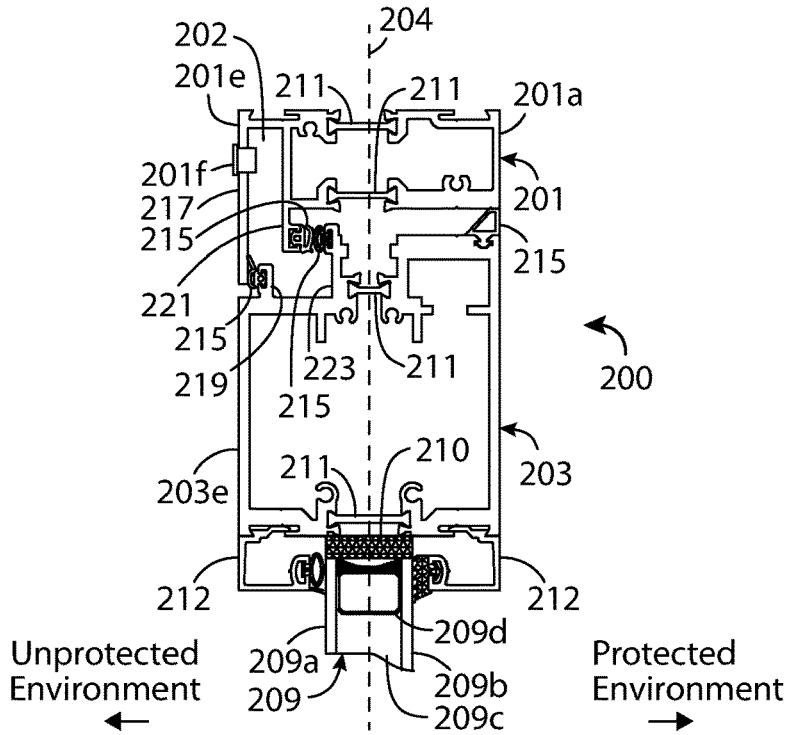
FIG. 6 illustrates a section of a head frame and a head sash of an improved inswing door taken along section lines 6-6 in FIG. 5.
Figure 7:
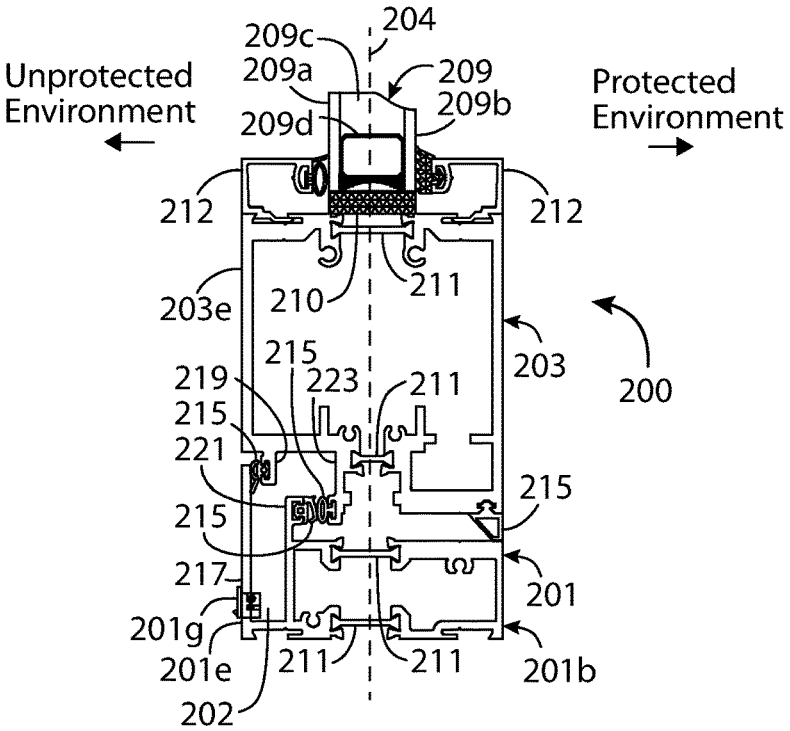
FIG. 7 illustrates a section of a sill frame and a sill sash of an improved inswing door taken along section lines 7-7 in FIG. 5.
Figure 10B:
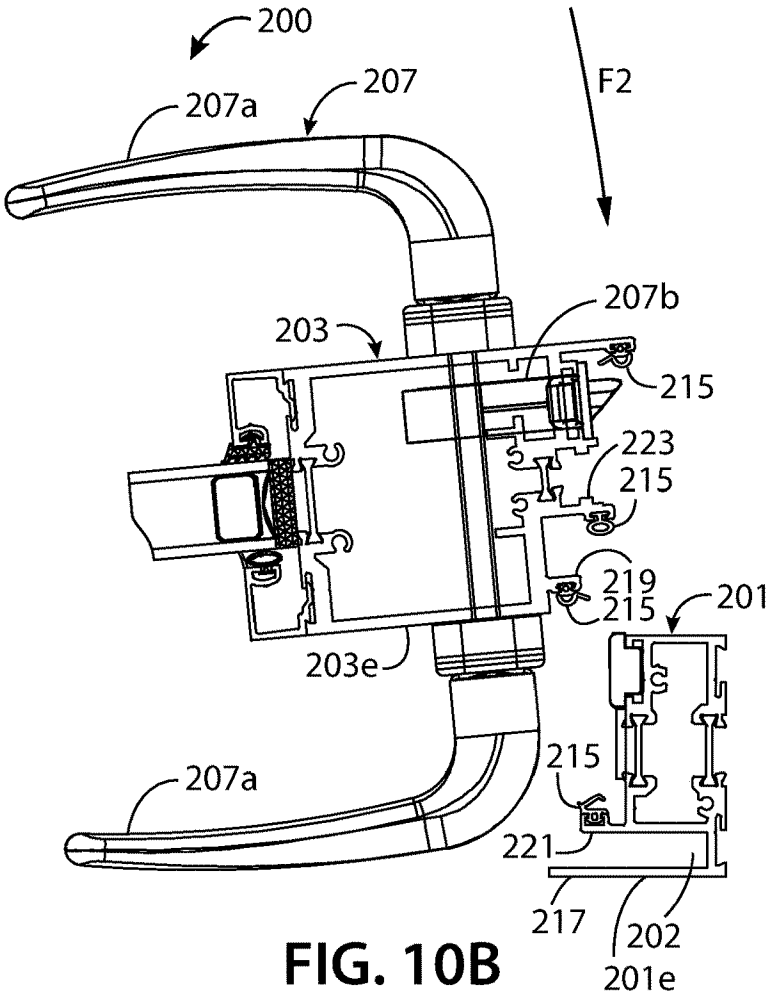
FIG. 10B illustrates a horizontal planar section of the right-hand portion of the improved inswing door of FIG. 5 swung in a partially open position.
Figure 10A:
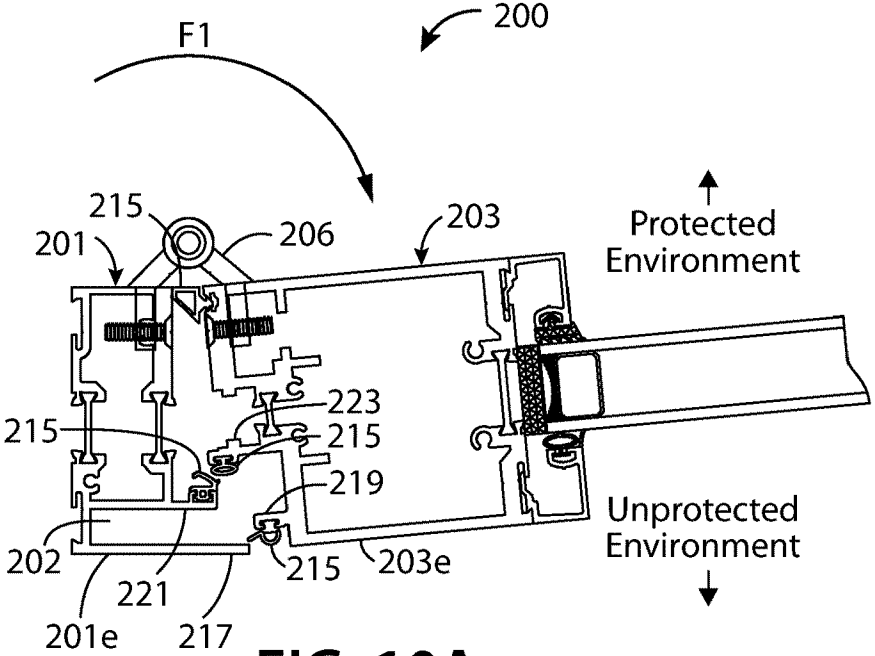
FIG. 10A illustrates a horizontal planar section of the left-hand portion of the improved inswing door of FIG. 5 swung in a partially open position.
Figure 11:
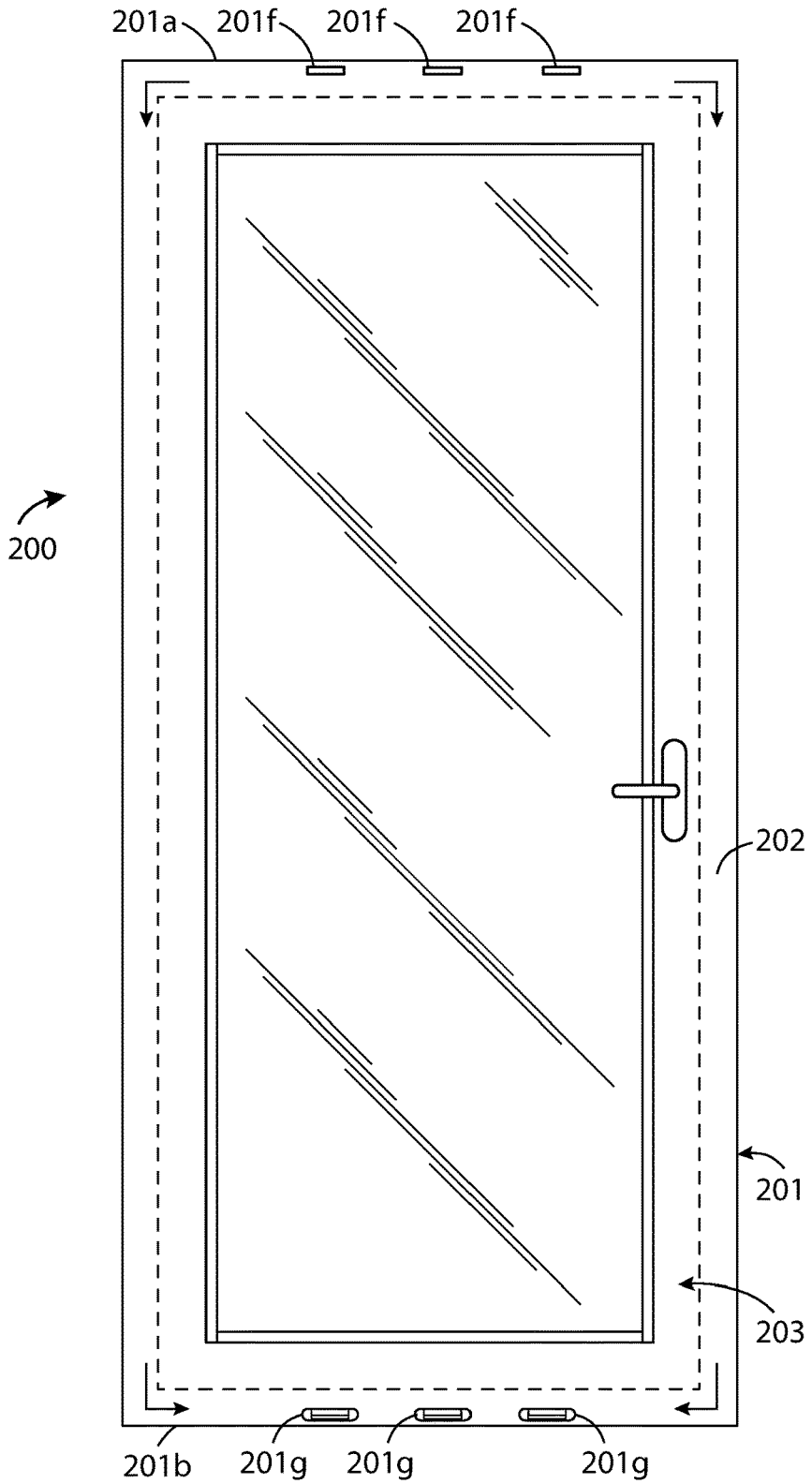
FIG. 11 illustrates the continuous pressure flow path for the improved inswing door of FIG. 5 in front elevation view.

Referring to FIGS. 6-9, which shows sectional views of an improved inswing door 200 of FIG. 5, the inventor discovered that by isolating the pressure chamber 202 to one side of the thermal break 204, leakage between the thermal struts 211 becomes less significant. For the improved inswing door 200, the pressure chamber 202 is isolated to the exterior-facing side of the thermal break 204. As illustrated in FIGS. 6-9, 10A, and 10B, to further enhance performance, the inventor created the pressure chamber 202 by overlapping parallel leg ends from corresponding longitudinally adjacent fenestration frame members. For example, a first frame projection 217 overlaps a first sash projection 219 and a second frame projection 221 overlaps a second sash projection 223. As illustrated in FIG. 11, the pressure chambers 202 on the horizontal and vertical members of the fenestration are aligned to create a pressure chamber 202 that is continuous around the closed perimeter of the improved inswing door 200 between the frame 201 and sash 203. The boundary of the pressure chamber 202 is indicated by the dashed line. In FIGS. 5-7 and 11, apertures used for pressure equalization and drainage, known in the art as weep holes 201*f* (FIGS. 5, 6, and 11) and weep flaps 201*g* (FIGS. 5, 7, and 11), are added to the frame 201 to allow air pressure from wind and the outside environment to build up within the pressure chamber 202. The weep holes 201*f* are open apertures and are shown positioned within the head frame member 201*a* (FIGS. 5, 6, and 11). Weep flaps 201*g* are an aperture covered by a hinged flap. The hinged flap opens outward allowing water to exit but not enter. The weep flaps 201*g* are shown positioned in the sill frame member 201*b* (FIGS. 5,7, and 11). They allow water collected within the pressure chamber 202 (FIGS. 7 and 11) to drain to the exterior environment. This configuration of weep holes 201*f* and weep flaps 201*g* can be applied to the improved high-performance fenestrations of this disclosure as will be demonstrated.

Figure 12:
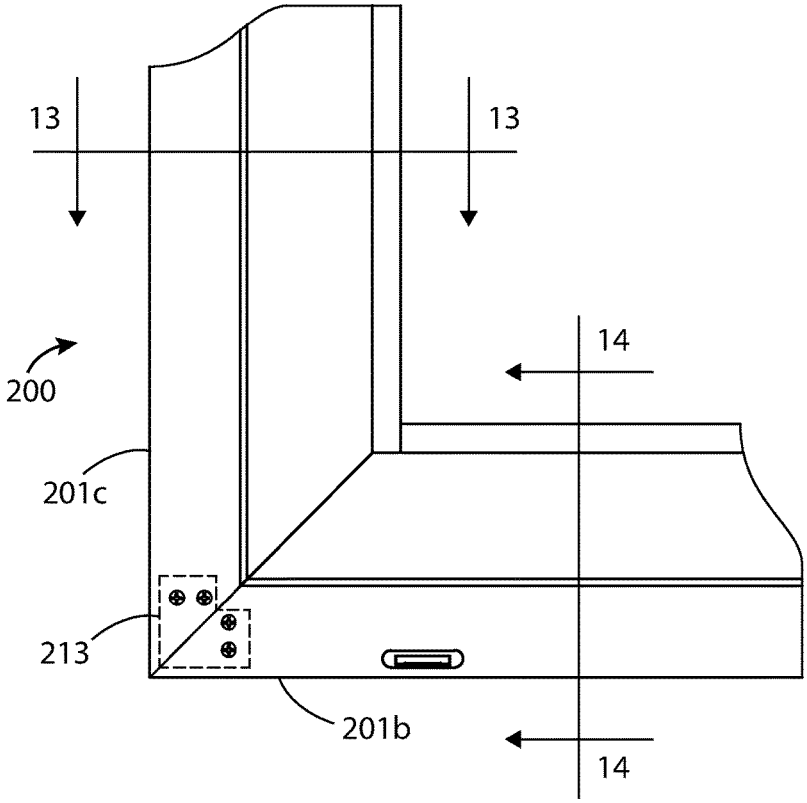
FIG. 12 illustrates, in front view, a lower left portion of the sash and frame of FIG. 5 with optional corner bracing.
Figure 13:
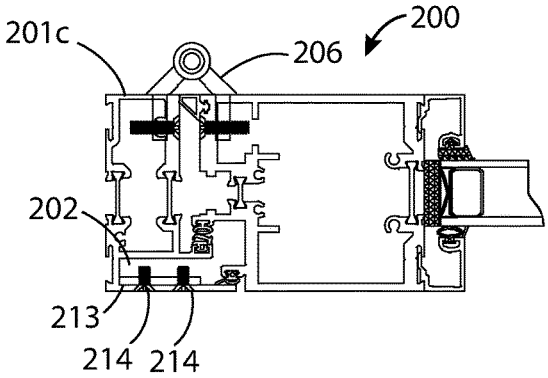
FIG. 13 illustrates a section of FIG. 12 taken along section lines 13-13 and showing the corner bracing in relation to the hollow passage.
Figure 14:
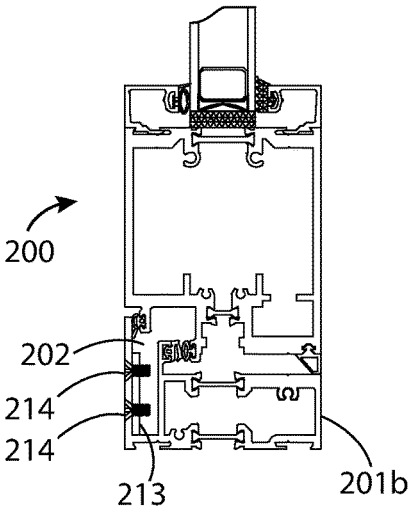
FIG. 14 illustrates a section of FIG. 12 taken along section lines 14-14 and showing the corner bracing in relation to the hollow passage.

FIG. 12 shows a corner detail of the improved inswing door 200 showing how the chamber can be made continuous by inserting a corner brace 213 between the mitered corners of the vertical jamb 201*c* and a horizontal frame member such as the sill frame member 201*b* as illustrated. Sectional views FIGS. 13-14 show the corner brace 213 fastened to the inside wall of the pressure chamber 202 by threaded fasteners 214 to the vertical jamb 201*c* (FIG. 13) and the sill frame member 201*b* (FIG. 14). By applying these principles and creating a similar structure, the corner braces 213 of the improved inswing door 200 of FIGS. 12-14 can be readily applied to improved inswing French-style door 240 (FIGS. 15-23), improved outswing French-style door 250 (FIGS. 31-41), improved outswing door 260 (FIGS. 42-44), improved bifold door 270 (FIGS. 45-53), improved bifold corner doors 280 (FIGS. 54-61), improved pivot door 290 (FIGS. 62-66), and improved fixed-lite fenestration 300 (FIGS. 67-71) discussed and illustrated in this disclosure.

Figure 15:
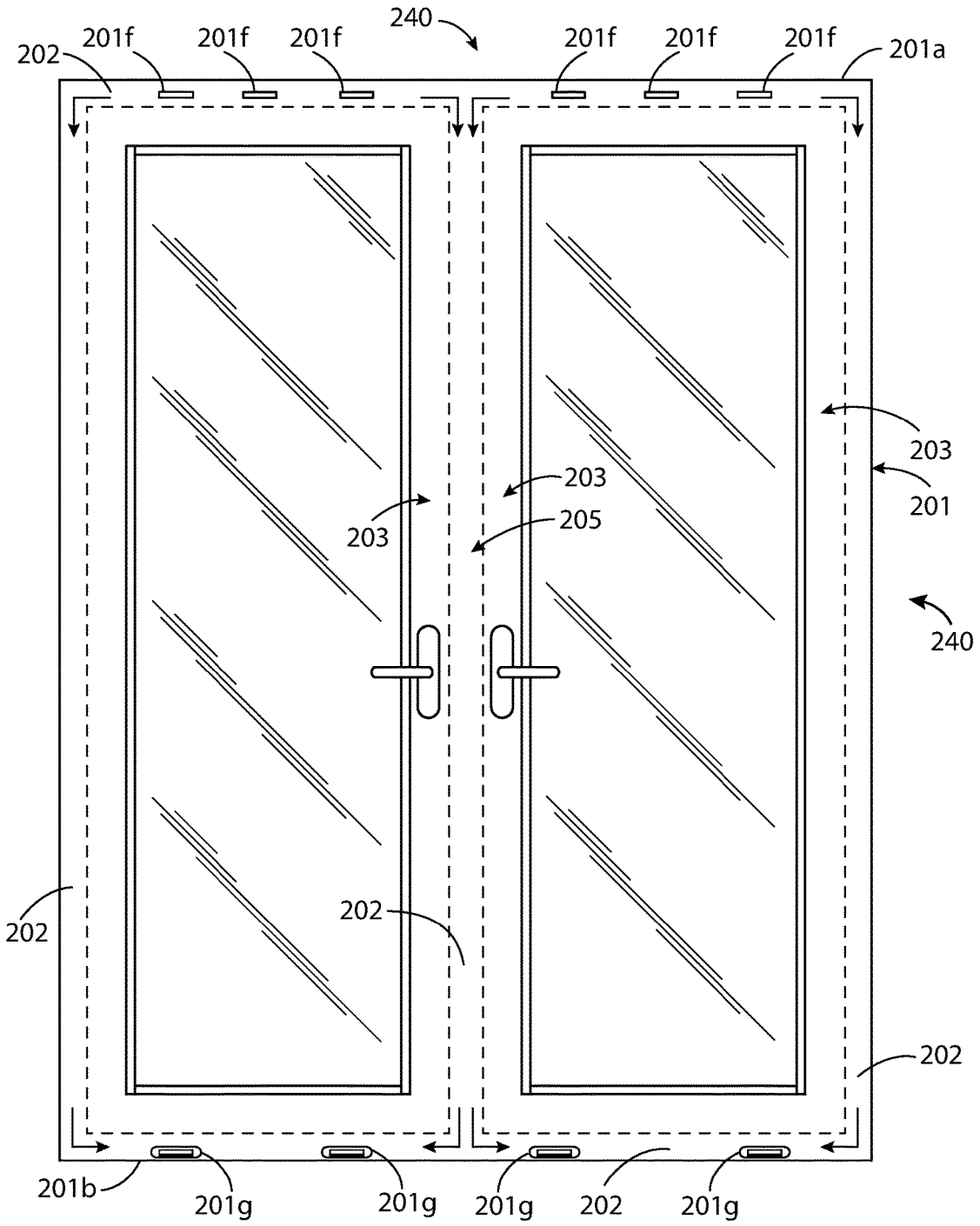
FIG. 15 illustrates the continuous pressure flow path for the improved inswing French door of FIG. 16 in front elevation view.
Figure 16:
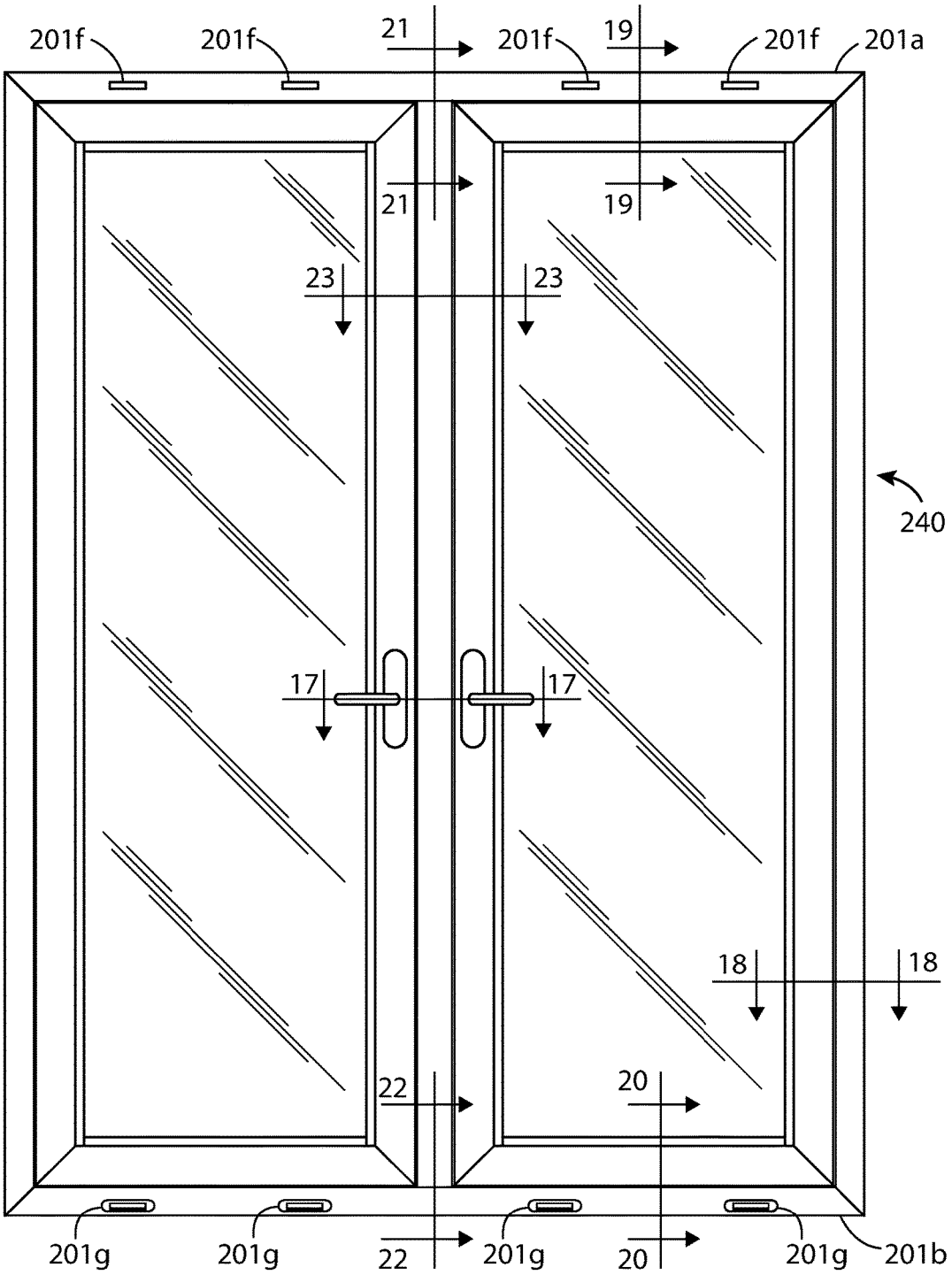
FIG. 16 illustrates the improved inswing French door of the present disclosure in front elevation view.

Referring to FIG. 15, the pressure chamber 202 can be created between the frame 201 and sash 203 around the outside perimeter and between the sash 203 and astragal 205 on the inside perimeter of an improved inswing French-style door 240. The improved inswing French-style door 240 of FIGS. 15-16 also includes weep holes 201*f* in the head frame member 201*a* and weep flaps 201*g* in the sill frame member 201*b* to pressurize the pressure chamber 202 (FIG. 15). The weep flaps 201*g* also allow for drainage. The same principle of a pressure chamber 202 that is continuous around the fenestration perimeters illustrated in FIGS. 11 and 15 apply to the improved outswing French-style door 250 (FIGS. 31-41), improved outswing door 260 (FIGS. 42-44), improved bifold door 270 (FIGS. 45-53), improved bifold corner doors 280 (FIGS. 54-61), improved pivot door 290 (FIGS. 62-66), and improved fixed-lite fenestration 300 (FIGS. 67-71) discussed and illustrated in this disclosure. This will become apparent by studying their sectional views.

On Oct. 6, 2016, the NCTL witnessed a water penetration test according to ASTM E331 on an inswing terrace door similar to the improved inswing door 200 shown in FIGS. 5-14. The inswing terrace door passed 1197 Pa (25 psf) on this test. Other in-house testing performed on Oct. 11, 2016 showed the inswing terrace door, after hardware modifications, passing 1915 Pa (40 psf) when tested in accordance with ASTM E331. In comparison, a prior art inswing door 100 of FIGS. 1-3, typically has an ASTM E331 water penetration performance of 575 Pa (12 psf) to 718 (15 psf).

Figure 8:
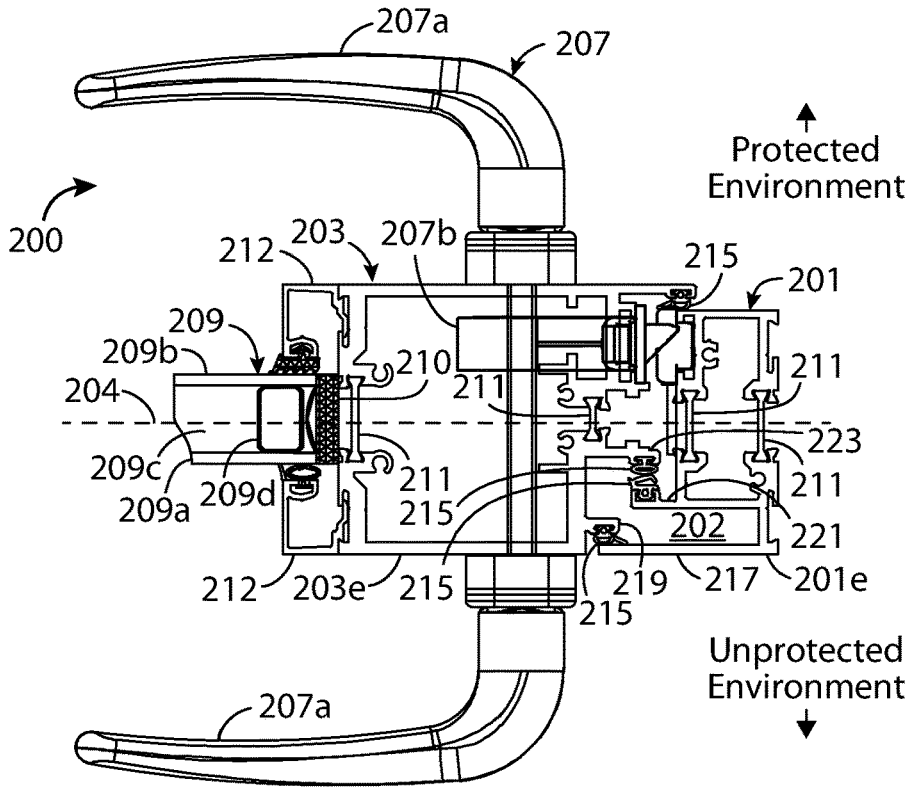
FIG. 8 illustrates a section of a vertical jamb and vertical sash of the improved inswing door taken along section lines 8-8 in FIG. 5 and showing door hardware mounted Euro-style.
Figure 9:
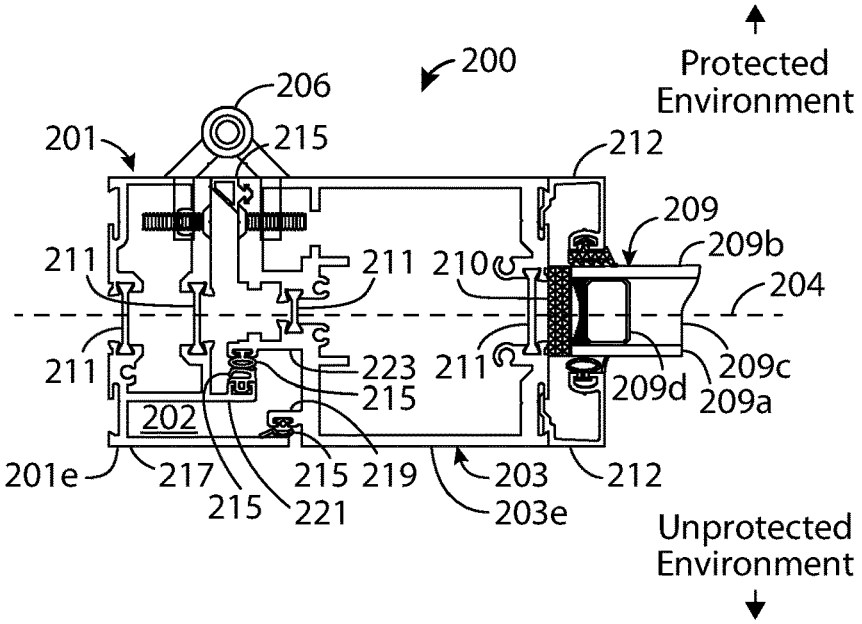
FIG. 9 illustrates a section of a vertical jamb and a vertical sash of the improved inswing door taken along section lines 9-9 in FIG. 5.
Figure 17:
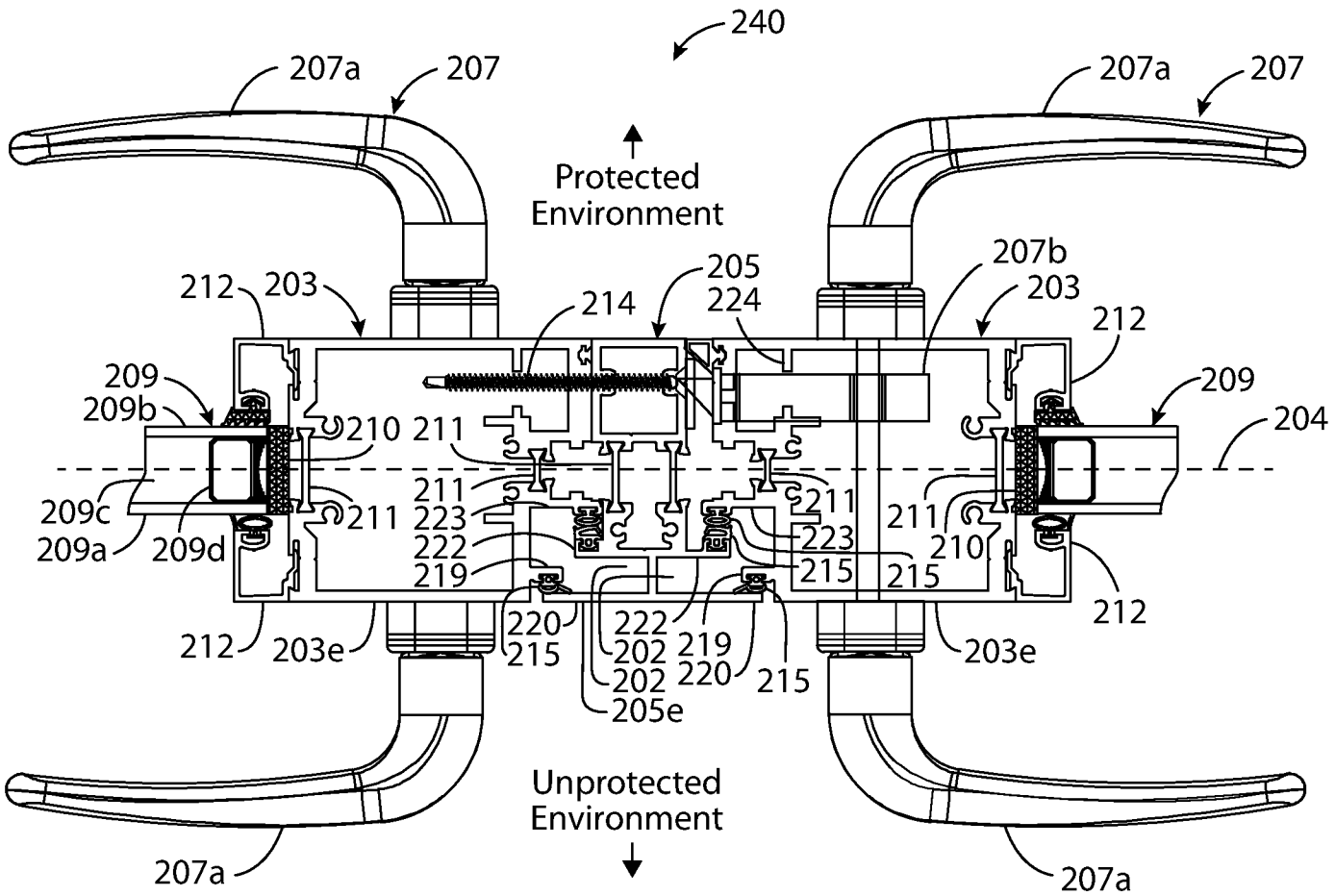
FIG. 17 illustrates a section of an improved inswing French door of FIG. 16 taken along section lines 17-17 of FIG. 16 and showing the door hardware.
Figure 18:
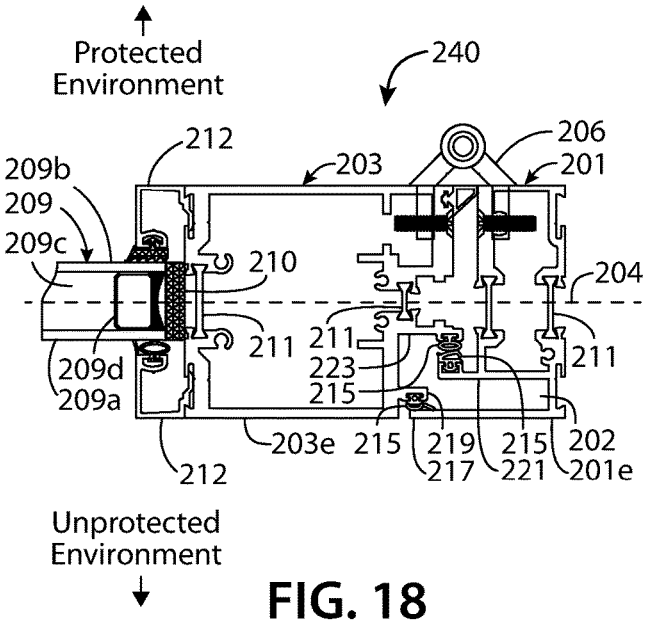
FIG. 18 illustrates a section of vertical jamb and a vertical sash of the improved inswing French door taken along section lines 18-18 of FIG. 16.
Figure 19:
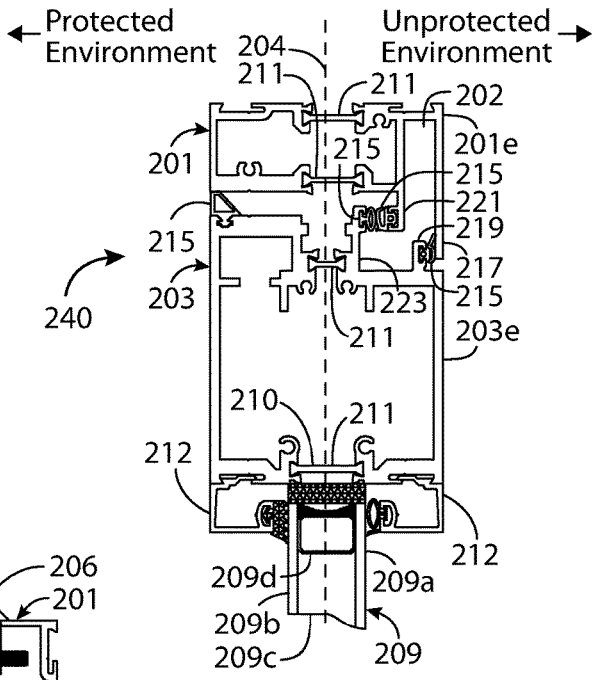
FIG. 19 illustrates a section of a head frame and head sash of the improved inswing French door taken along section lines 19-19 of FIG. 16.
Figure 20:
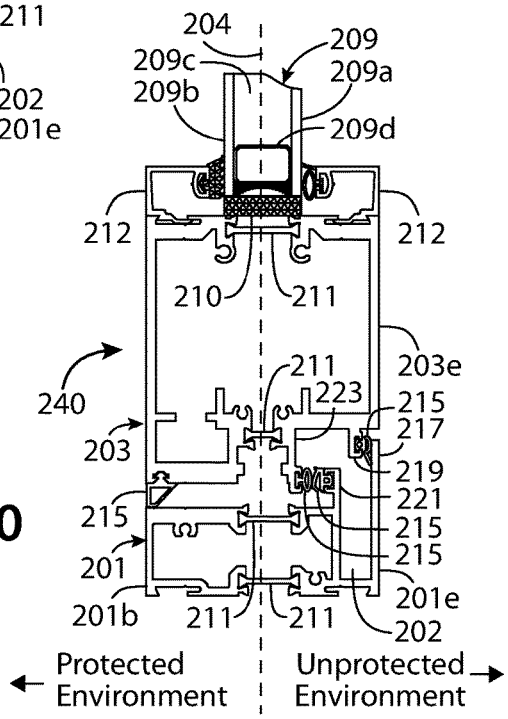
FIG. 20 illustrates a section of the sill frame and sill sash the improved inswing French door taken along section lines 20-20 of FIG. 16.

In addition, the high-performance fenestration system developed by the inventor yielded additional unexpected results. (1) Because the pressure chamber 202 is on the opposite side of the thermal break 204 as the hinge, the high-performance fenestration can be designed to accept different hinge styles without compromising performance. For example, American-style hinges 206 as shown in FIGS. 9, 10A, 13, 18, 33, 36, 50, 55-57, 59-60; an alternative American-style hinge 225 in FIG. 26; and Euro-style hinges 227, 229 in FIGS. 27 and 28 respectively. (2) In addition, the structure of the high-performance fenestration system lends itself to the use of more than one style of door hardware. The structure allows Euro-style mounting positions for the door hardware 207 and lockset 207*b*, as illustrated in FIGS. 8, 10B, and 17, or American-style mounting positions for the door hardware 207 and lockset 207*b*, as illustrated in FIGS. 24, 25, 38, 43, 46-49, 54, 55, 58, 59, and 65. (3) It is possible to make structural modifications to the non-chamber side of the fenestration without affecting water penetration performance.

Figure 40:
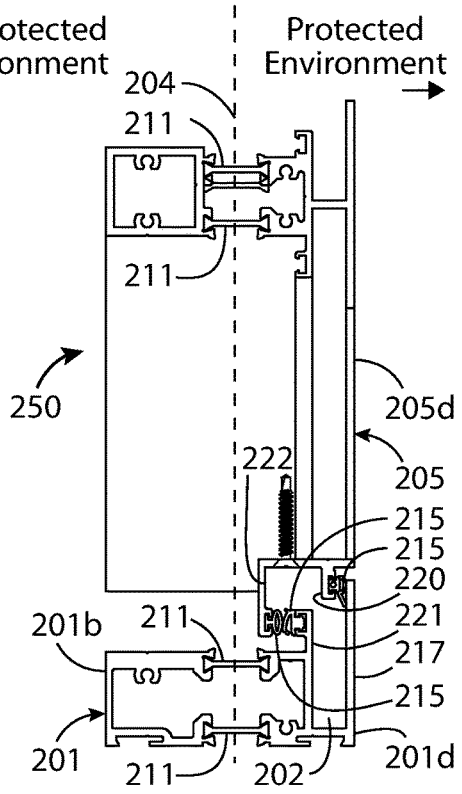
FIG. 40 illustrates a section of the improved outswing French door of FIG. 31 showing the sill frame section and astragal and taken along section lines 40-40.
Figure 41:
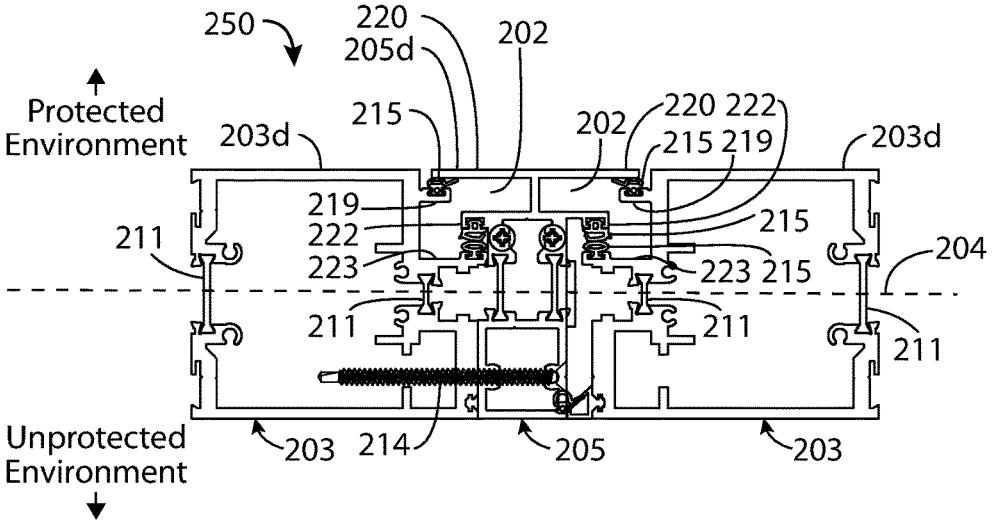
FIG. 41 illustrates a horizontal section of the improved outswing French door of FIG. 31 showing vertical sash members and astragal taken along section lines 41-41.
Figure 42:
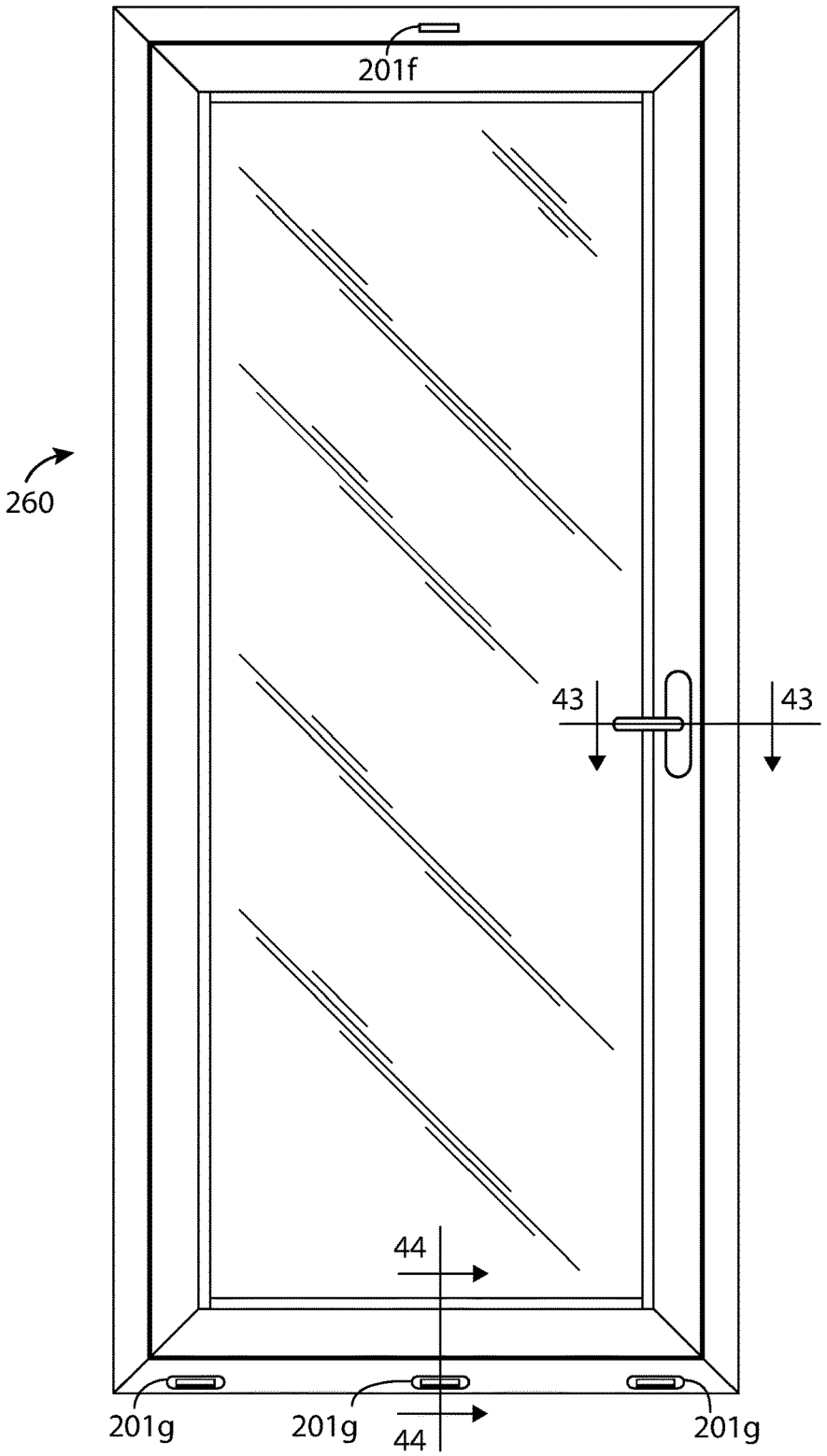
FIG. 42 illustrates in front elevation view, the improved outswing door of the present disclosure.
Figure 43:
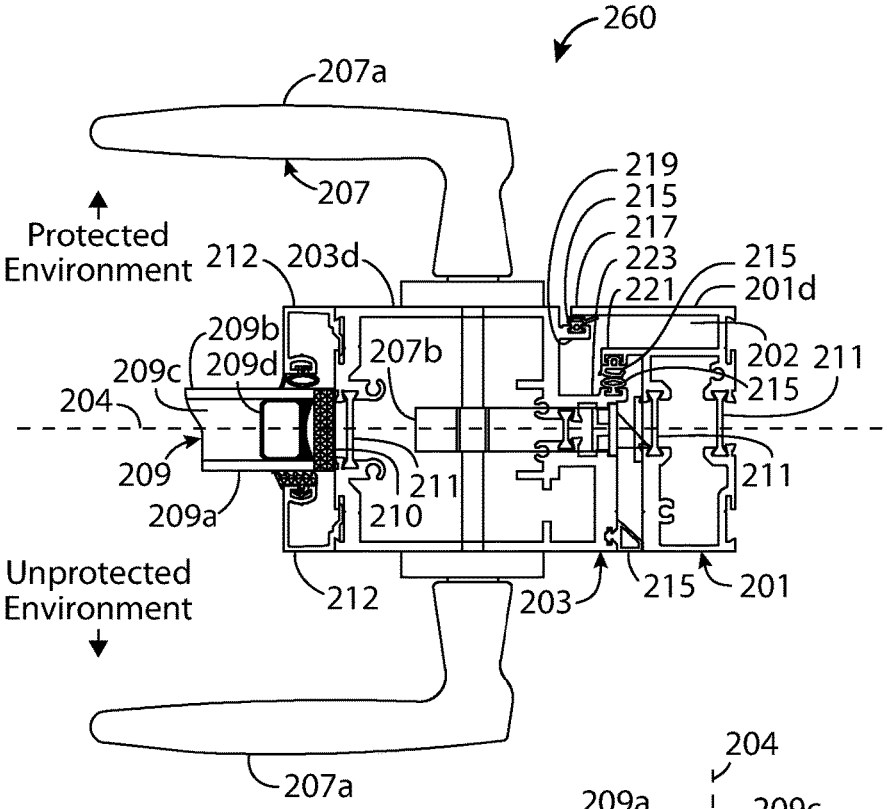
FIG. 43 illustrates a section of the improved outswing door of FIG. 42 taken along section lines 43-43 showing the door hardware.
Figure 44:
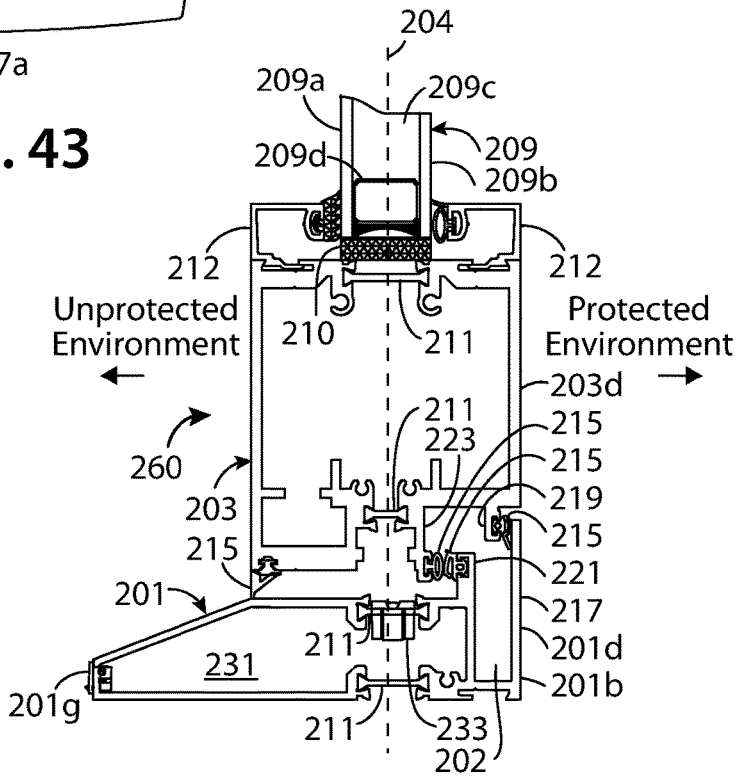
FIG. 44 illustrates a section of the improved outswing door of FIG. 42 taken along section lines 44-44 showing an alternative sill portion.

Applying principles from the improved inswing door 200, illustrated in FIGS. 5-14, the inventor designed a high-performance fenestration system that can be applied to improved inswing French-style door 240 as illustrated in FIGS. 15-23, improved outswing French-style doors 250 as illustrated in FIGS. 31-41, improved outswing doors 260 as illustrated in FIGS. 42-44, improved bifold doors 270 as illustrated in FIGS. 45-53, improved bifold corner doors 280 as illustrated in FIGS. 54-61, improved pivot doors 290 as illustrated in FIGS. 62-66, and improved fixed-lite fenestrations 300 of FIGS. 67-71. From these examples, the high-performance fenestration system can also readily be applied to inswing, outswing, and casement windows. It is the inventor's intention that the high-performance fenestration is not limited to these examples. The inventor anticipates that the principles of his high-performance fenestration system can be applied to a wide range of fenestrations as will become apparent from this disclosure.

Common to all illustrated embodiments of the inventor's high-performance fenestration system is the pressure chamber 202 positioned on one side of the thermal break 204 as shown in the sectional views of FIGS. 6-9, 17-23, 32-41, 43, 44, 49-53, 56, 57, 60, 61, and 63-71. The pressure chamber 202 is positioned on the exterior-facing side of the thermal break 204 for the improved inswing door 200 (FIGS. 6-9), the improved inswing French-style door 240 (FIGS. 17-23), the improved bifold door 270 (FIGS. 49-53), the improved bifold corner door 280 (FIGS. 54, 56-58, 60, and 61), the improved pivot door 290 of FIGS. 63-66, and the improved fixed-lite fenestrations 300 (FIGS. 68-71). The pressure chamber 202 is positioned on the interior side of the thermal break 204 for the improved outswing French-style door 250 (FIGS. 32-41) and the improved outswing door 260 (FIGS. 43 and 44).

To enhance the seal within the pressure chamber 202 and the water resistance, the pressure chamber 202 utilizes overlapping projections from longitudinally adjacent fenestration members on all illustrated embodiments except the pivot door. These overlapping projections extend directly from and are integral with their corresponding fenestration member. The overlapping projections are parallel to each other where they overlap and parallel to the plane of the closed fenestration. In addition, because the projections are integral with the fenestration frame, sash, or astragal, they are as structurally rigid as the fenestration frame, sash, or astragals. These fenestration members can be fabricated from a rigid material and typically fabricated from extruded aluminum. These structural factors maximize the closure force, and therefore the sealing potential, of the pressure chamber 202. While the actual seals are formed by the engagement of flexible gaskets, they are backed by these rigid projections. In contrast, the prior art inswing door 100 of FIGS. 1-4 depend on a combination of an gooseneck gasket 113 and thermal strut projected portion 111*a* to form their seal. Both the gooseneck gasket 113 and the thermal strut projected portion 111*a* are subject to flexing and are more likely to form air and water leaks as compared with the inventor's high-performance fenestration where the seals are backed by rigid projections as in FIGS. 5-61. In addition, the gooseneck gasket 113 of the prior art inswing door 100 in FIG. 2 sticks up above the top of the threshold of the sill frame member 101*b* and is easily worn away over time by foot traffic. In contrast, the gasket 215 of the second frame projection 221 of the sill frame member 201*b* is protected from foot traffic as illustrated in FIGS. 7, 20, 22, 34, 37, 40, 44, 52, and 69.

Figure 71:
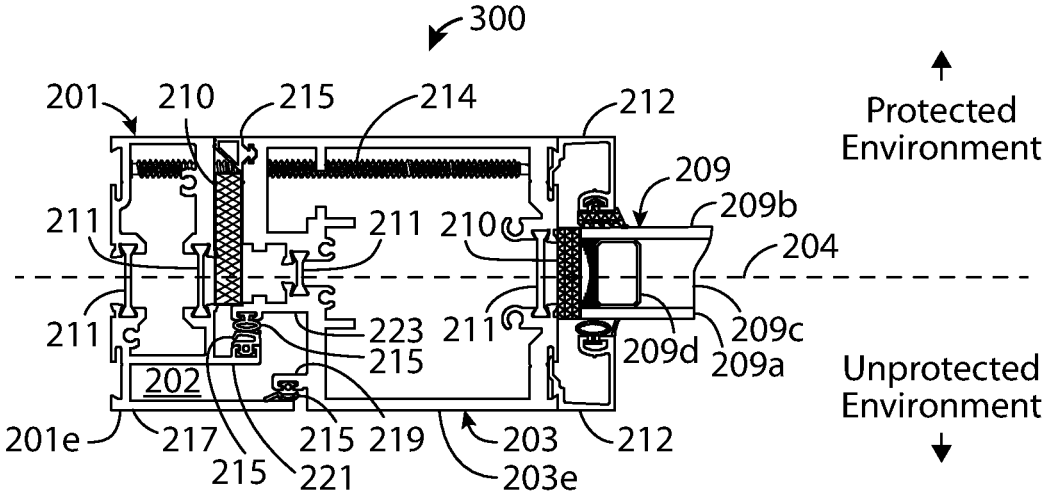
FIG. 71 illustrates a section of a vertical jamb and a vertical sash of the improved fixed-lite fenestration taken along section lines 71-71 in FIG. 67.

Referring to FIGS. 6-10B, 18-20, 49, 51-53, and 68-71, the first pair of projections includes a first frame projection 217 and a first sash projection 219. The first frame projection 217 is shown as a portion of the outside wall of the unprotected-environment-facing frame portion 201*e* of the frame 201. The first sash projection 219 projects away from the unprotected-environment-facing sash portion 203*e* of the sash 203. A gasket 215 is attached to the first sash projection 219. The gasket 215 is positioned between the first frame projection 217 and the first sash projection 219 and forms a seal between the two portions. The second pair of projections includes a second frame projection 221 and a second sash projection 223. The second frame projection 221 is shown as a portion of the interior of the unprotected-environment-facing frame portion 201*e*. The second sash projection 223 projects away from the interior of the unprotected-environment-facing sash portion 203*e*. Gaskets 215 are attached to the second sash projection 223 and the second frame projection 221. These gaskets 215 form a seal between the two portions. Note that while two of the gaskets 215 are shown sandwiched between the second frame projection 221 and the second sash projection 223, one of the gaskets 215 could easily be used instead of both gaskets 215. In addition, gaskets 215 are shown in FIGS. 6-10A, 19, 20, 33-38, 43, 44, 49-53, 57, 61, and 68-71 on the non-chamber side of the fenestration in order to enhance isolation from the interior environment and to prevent infiltration of air from the exterior environment into the interior environment. The gaskets 215 illustrated throughout this disclosure are typical. The improved fenestrations of FIGS. 5-71 are not limited to gaskets of the specific types and shapes illustrated. Those skilled in the art of fenestrations will readily recognize other gasket types and shapes that can also be used.

The effectiveness of the seal is enhanced by the overlapped ends of the projections being parallel to each other and along the same plane as the closed fenestration. Referring to FIGS. 8-10B, the rotational force translated from the American-style hinge 206 (FIGS. 9 and 10A) from the first sash projections 219 to the first frame projections 217 and from the second sash projections 223 to the second frame projections 221 is perpendicular to the plane of the closed fenestration when the lockset 207*b* (FIGS. 8 and 10B) is engaged. Therefore, the force is maximized when the engagement portions of the first sash projections 219, the first frame projection 217, the second sash projections 223, and the second frame projection 221 are parallel to the plane of the closed fenestration. FIGS. 10A and 10B show the lines of torque (i.e. rotational forces) by arc F1 (FIG. 10A) and arc F2 (FIG. 10B).

Figure 21:
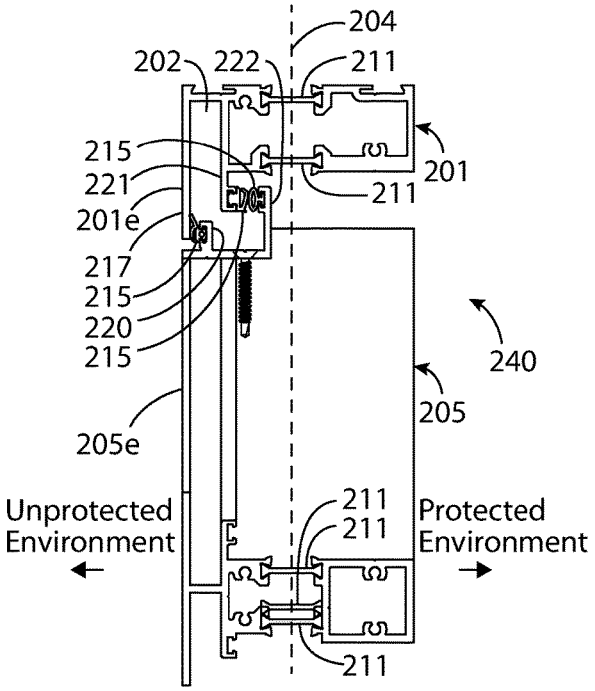
FIG. 21 illustrates a section of the head frame and astragal of the improved inswing French door taken along section lines 21-21 of FIG. 16.
Figure 22:
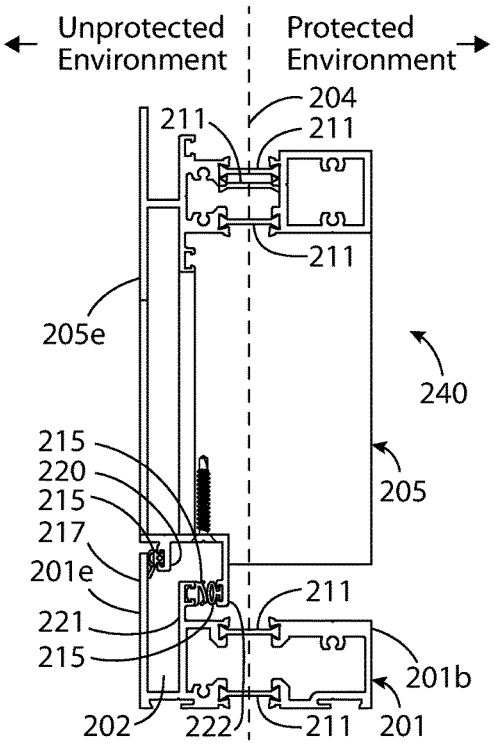
FIG. 22 illustrates a section of the sill frame and astragal of the improved inswing French door taken along section lines 22-22 of FIG. 16.
Figure 23:
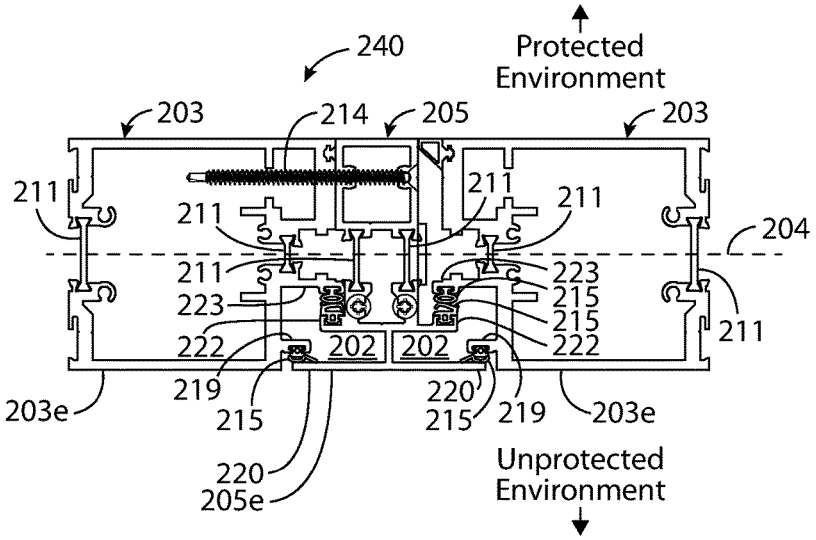
FIG. 23 illustrates a section of the vertical sash members and the astragal of the improved inswing French door taken along section lines 23-23 of FIG. 16.

Referring to FIGS. 17 and 21-23 of the improved inswing French-style door 240, the right side of the door includes a lockset 207*b* (FIG. 17). The astragal 205 is shown rigidly attached to the sash 203 on the left-hand door by a threaded fastener 214 so that the astragal 205 and sash 203 on the left side of the door move together as a unit (FIGS. 17 and 23). Because the astragal 205 is symmetrical, the astragal 205 can instead be rigidly attached to sash 203 on the right-hand side, and the lockset 207*b* (FIG. 17) can alternatively be mounted on the left side of the door.

In FIGS. 17 and 23, the first pair of projections includes a first sash projection 219 and a first astragal projection 220. The first sash projection 219 projects away from the unprotected-environment-facing sash portion 203*e* of the sash 203. The first astragal projection 220 is shown as the exterior-facing astragal portion 205*e*. A gasket 215 is attached to the first sash projection 219. The gasket 215 is positioned between the first sash projection 219 and the first astragal projection 220 and forms a seal between the two portions. The second pair of projections includes a second astragal projection 222 and a second sash projection 223. The second astragal projection 222 is shown as a portion of the interior of the astragal 205. The second sash projection 223 projects away from the interior of the unprotected-environment-facing sash portion 203*e*. Gaskets 215 are attached to the second sash projection 223 and the second astragal projection 222. These gaskets 215 form a seal between the two portions.

In FIGS. 21 and 22 the first pair of projections includes a first frame projection 217 and a first astragal projection 220. The first frame projection 217 projects away from the unprotected-environment-facing frame portion 201*e* of the frame 201. The first astragal projection 220 is shown as the exterior-facing astragal portion 205*e* of the astragal 205. A gasket 215 is attached to the first astragal projection 220. The gasket 215 is positioned between the first frame projection 217 and the first astragal projection 220 and forms a seal between the two portions. The second pair of projections includes a second frame projection 221 and second astragal projection 222. The second astragal projection 222 is shown as a portion of the interior of the astragal 205. The second frame projection 221 projects away from the interior of the unprotected-environment-facing frame portion 201*e*. Gaskets 215 are attached to the second frame projection 221 and the second astragal projection 222. These gaskets 215 form a seal between the two portions.

For the improved outswing French-style door 250 shown in FIGS. 32-37 and the improved outswing door 260 of FIGS. 43 and 44, the first frame projection 217 is shown as a portion of the outside wall of the protected-environment-facing frame portion 201*d* of the frame 201. The first sash projection 219 is illustrated projecting away from the protected-environment-facing sash portion 203*d* of the sash 203. A gasket 215 is attached to the first sash projection 219. The gasket 215 is positioned between the first frame projection 217 and the first sash projection 219 and forms a seal between the two portions. The second frame projection 221 is shown as a portion of the inside of the protected-environment-facing frame portion 201*d*. The second sash projection 223 projects away from the inside of the protected-environment-facing sash portion 203*d*. Gaskets 215 are attached to the second sash projection 223 and the second frame projection 221. These gaskets 215 form a seal between the two portions. For reasons similar to those previously described, the force of engagement is maximized when the engagement portions of the first sash projections 219, the first frame projection 217, the second sash projections 223, and the second frame projection 221 are parallel to the plane of the closed fenestration.

Figure 34:
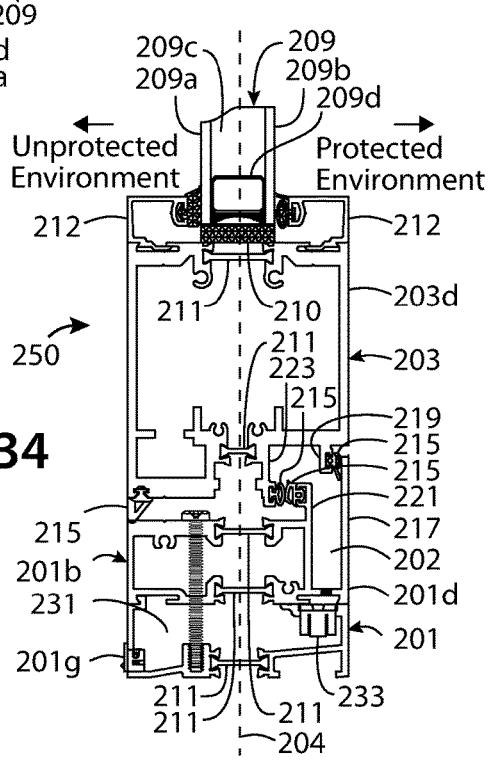
FIG. 34 illustrates a section of the left sill portion of the improved outswing French door of FIG. 31 taken along section lines 34-34.
Figure 37:
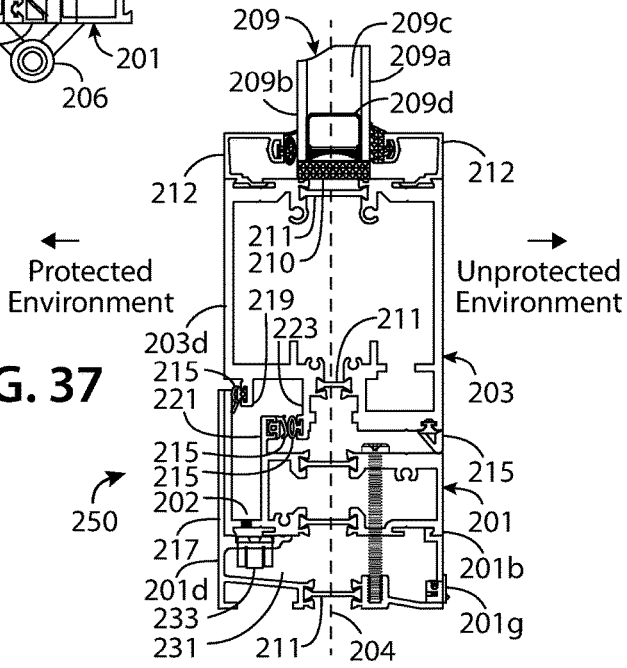
FIG. 37 illustrates a section of the right sill portion of the improved outswing French door of FIG. 31 taken along section lines 37-37.

Referring to FIGS. 34, 37, and 44, in order to help further maintain water penetration resistance, a sub-sill 231, positioned below the pressure chamber 202, collects water from the pressure chamber 202 (FIGS. 34 and 37) or other parts of the fenestration (FIG. 44) via a ball valve 233 and drains the water through the weep flaps 201*g* in the sill frame member 201*b*. As shown in FIGS. 34 and 37, the weep flap 201*g* in combination with the ball valve 233, prevents water from the outside from flowing into the frame 201 but allows water to drain. In FIGS. 37 and 44, when there is no water below the ball valve 233, the force of gravity and water from above pushes the ball valve 233 down and allows the water to flow from the pressure chamber 202 to the sub-sill 231. If the sub-sill 231 is filled with water, the water in the sub-sill 231 pushes the ball valve 233 up and closes off the pressure chamber 202. This prevents water from the sub-sill 231 from infiltrating the pressure chamber 202.

Figure 31:
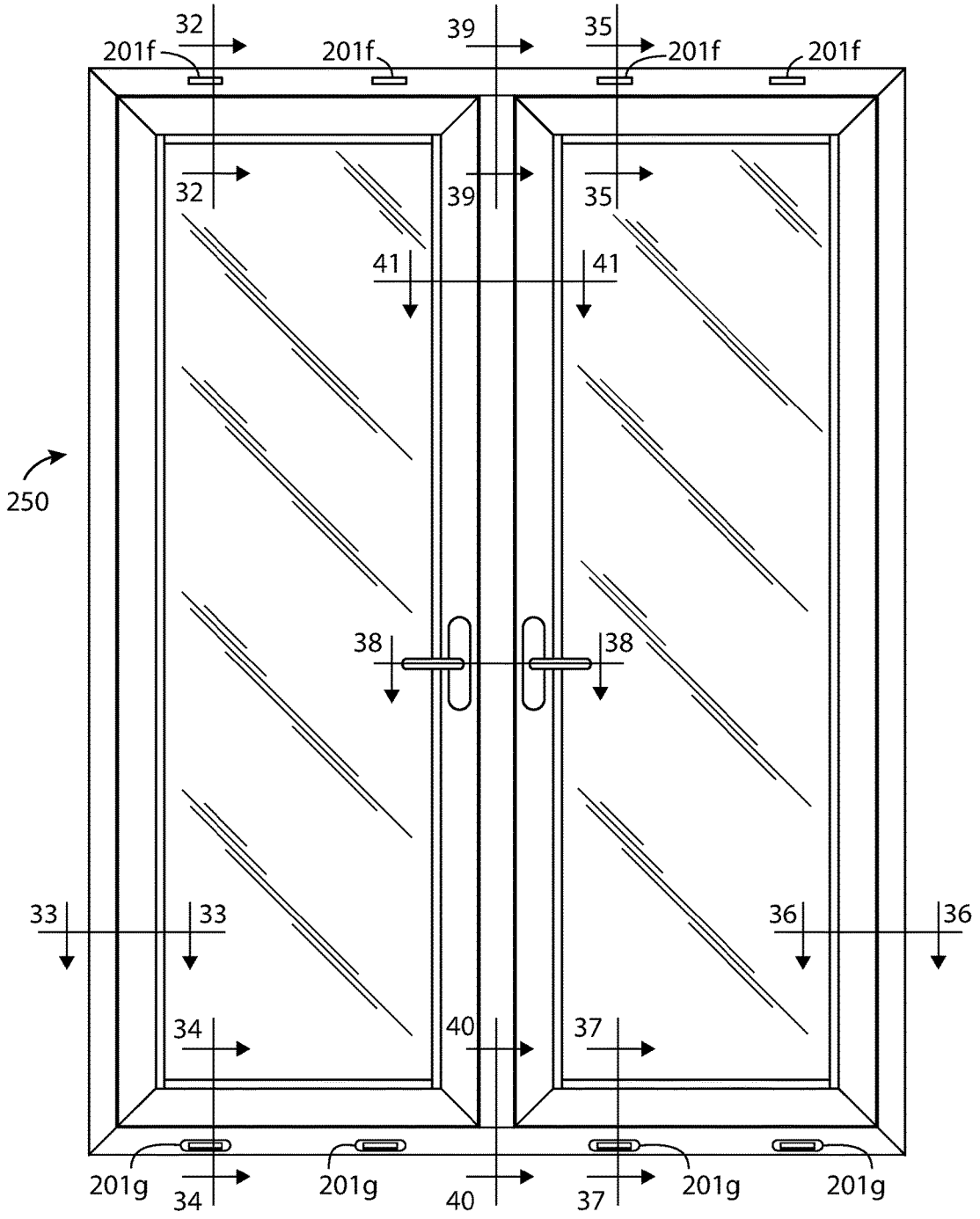
FIG. 31 illustrates a front elevation view of an improved outswing French door of the present disclosure.
Figure 32:
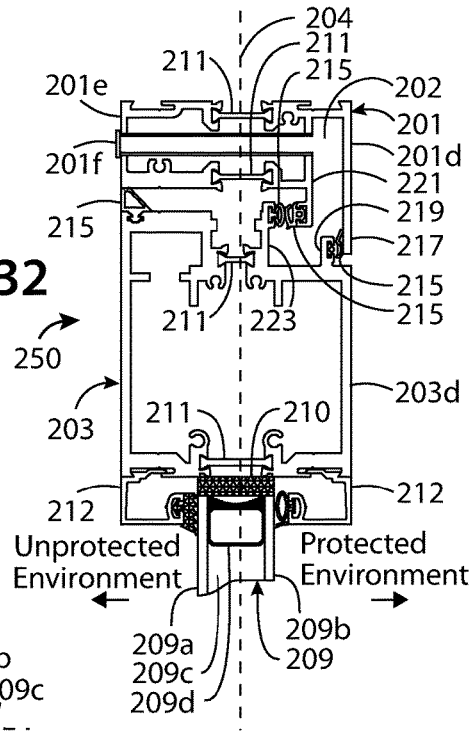
FIG. 32 illustrates a section of the left header portion of the improved outswing French door of FIG. 31 taken along section lines 32-32.
Figure 33:
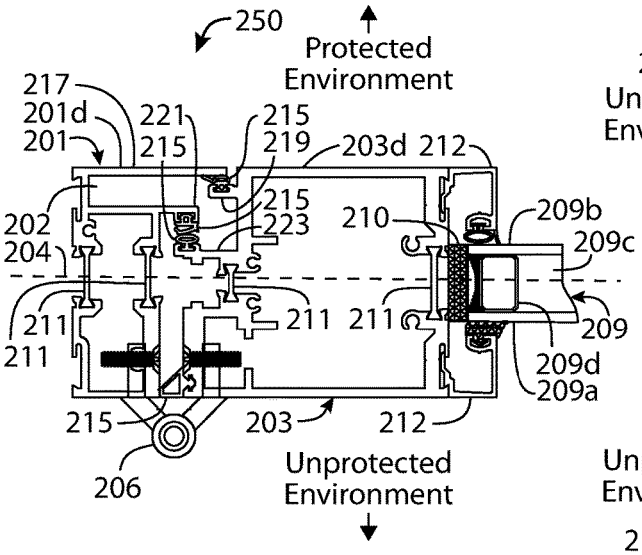
FIG. 33 illustrates a section of the left vertical portion of the improved outswing French door of FIG. 31 taken along section lines 33-33.
Figure 35:
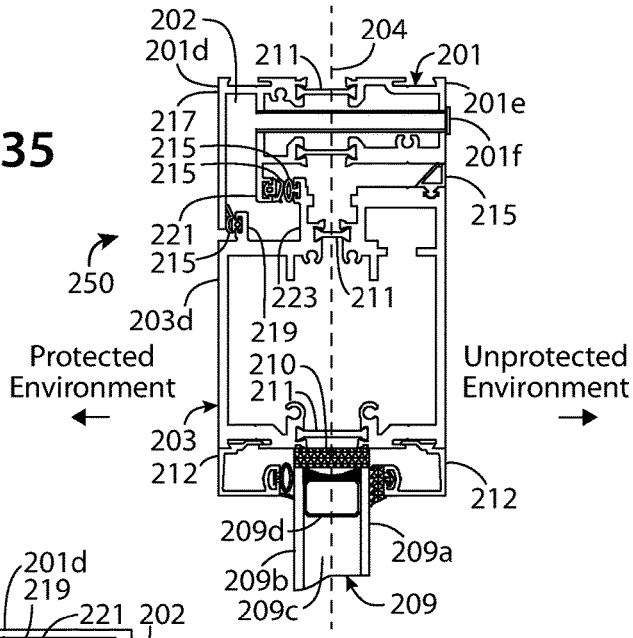
FIG. 35 illustrates a section of the right header portion of the improved outswing French door of FIG. 31 taken along section lines 35-35.
Figure 36:
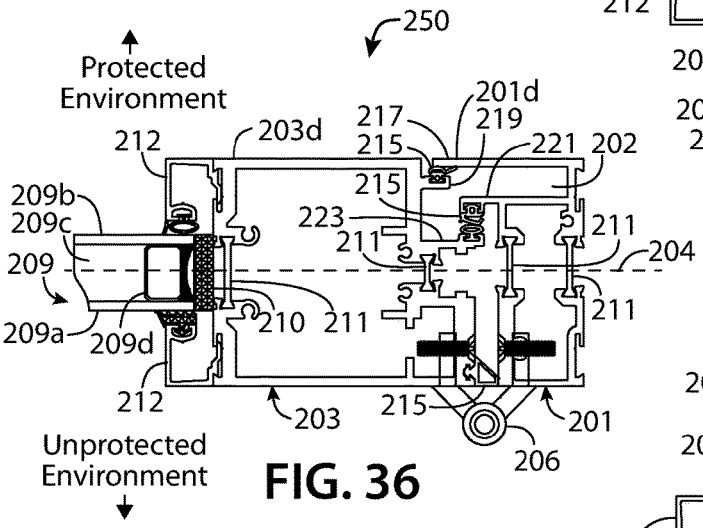
FIG. 36 illustrates a section of right vertical portion of the improved outswing French door of FIG. 31 taken along section lines 36-36.

Referring to FIGS. 32 and 35, the weep holes 201*f* can be configured to extend from the unprotected-environment-facing frame portion 201*e* of into the pressure chamber 202 via an aperture in the pressure chamber 202. The weep holes 201*f* may be configured with a ball valve (not shown) if needed, to equalize the air pressure in the chamber to the external air pressure of the unprotected environment. The pressure chamber is located directly adjacent to the protected-environment-facing frame portion 201*d*. Both the weep holes 201*f* and weep flaps 201*g* are also shown in FIGS. 31 and 42 and function as previously described.

Figure 38:
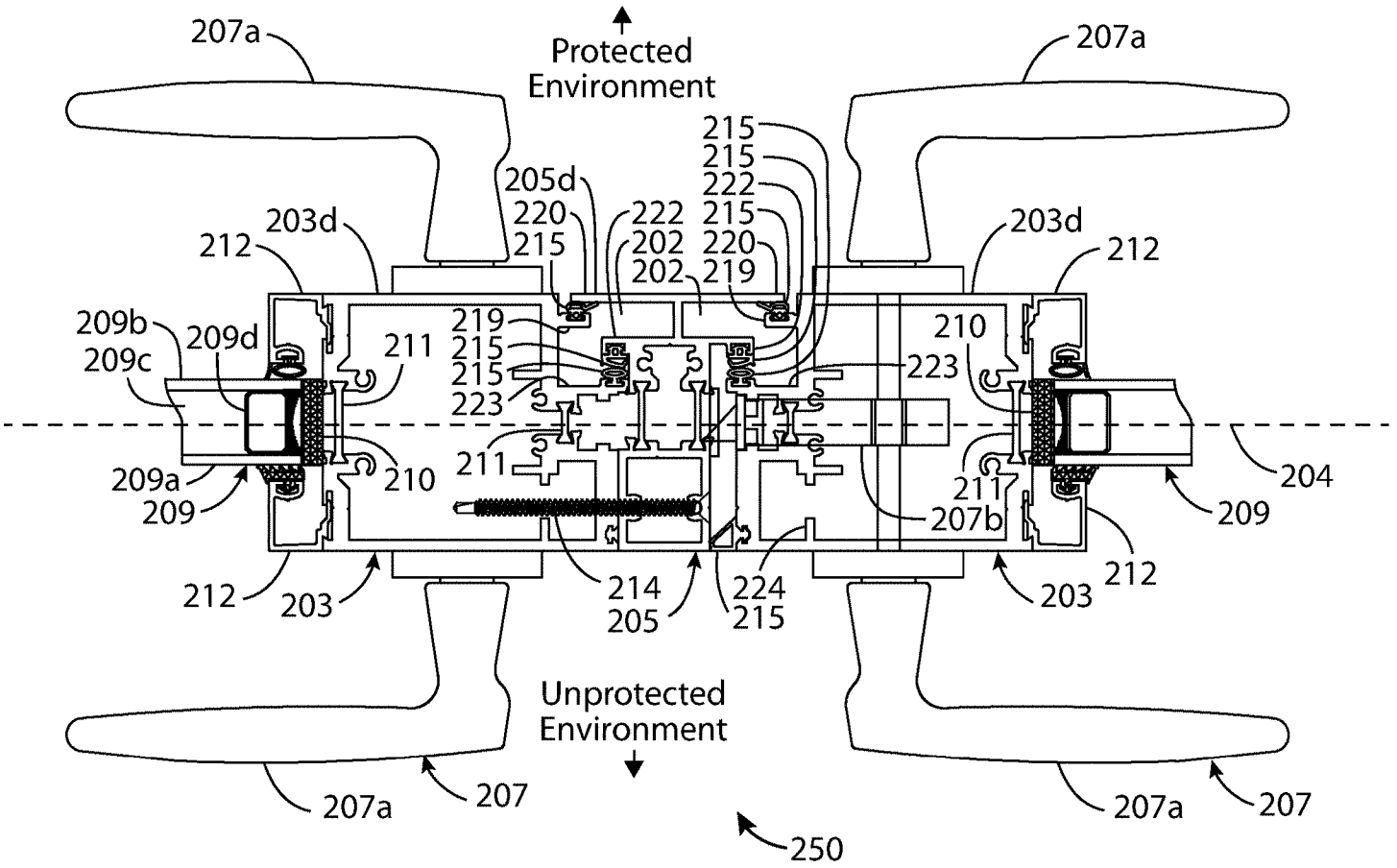
FIG. 38 illustrates a section of the improved outswing French door of FIG. 31 taken along section lines 38-38 showing the door hardware.

Referring to FIG. 38 the lockset 207*b* is shown mounted on the right side of the door. In FIGS. 38 and 41, the astragal 205 is show rigidly attached to the sash 203 on the left-hand door by a threaded fastener 214 so that the astragal 205 and sash 203 on the left side of the door move together as a unit. Referring back to FIG. 38, because the astragal 205 is symmetrical, the astragal 205 can instead be rigidly attached to sash 203 on the right-hand side, and the lockset 207*b* can be mounted on the left side of the door.

In FIGS. 38 and 41, the first pair of projections includes a first sash projection 219 and a first astragal projection 220. The first sash projection 219 projects away from the protected-environment-facing sash portion 203*d* of the sash 203. The first astragal projection 220 is shown as the interior-facing astragal portion 205*d* of the astragal 205. A gasket 215 is attached to the first sash projection 219. The gasket 215 is positioned between the first sash projection 219 and the first astragal projection 220 and forms a seal between the two portions. The second pair of projections includes a second astragal projection 222 and a second sash projection 223. The second astragal projection 222 is shown as a portion of the interior of the astragal 205. The second sash projection 223 projects away from the interior of the unprotected-environment-facing sash portion 203*e*. Gaskets 215 are attached to the second sash projection 223 and the second astragal projection 222. These gaskets 215 form a seal between the two portions.

Figure 39:
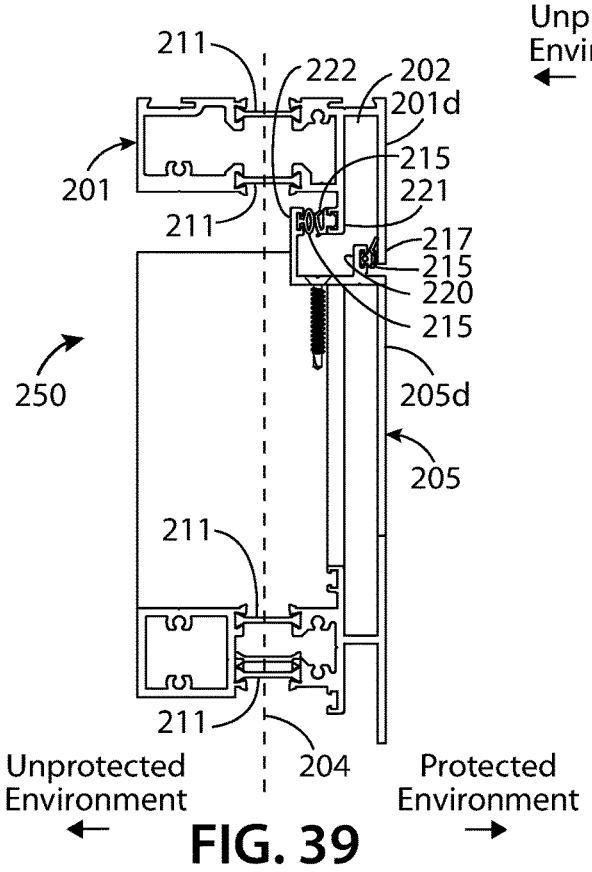
FIG. 39 illustrates a section of the improved outswing French door of FIG. 31 showing the head frame section and astragal and taken along section lines 39-39.

FIGS. 39 and 40, show cross sections of the astragal 205 and frame 201 taken along section lines 39-39 and 40-40 respectively from FIG. 31. Referring to FIGS. 39 and 40, the first pair of projections includes a first frame projection 217 and a first astragal projection 220. The first frame projection 217 projects away from the protected-environment-facing frame portion 201*d*. The first astragal projection 220 is shown as extending away from interior-facing astragal portion 205*d* toward the frame 201. A gasket 215 is attached to the first sash projection 219. The gasket 215 is positioned between the first frame projection 217 and the first astragal projection 220 and forms a seal between the two portions. The second pair of projections includes a second frame projection 221 and second astragal projection 222. The second astragal projection 222 is shown as a portion of the interior of the astragal 205. The second frame projection 221 projects away from the interior of the protected-environment-facing frame portion 201*d*. Gaskets 215 are attached to the second frame projection 221 and the second astragal projection 222. These gaskets 215 form a seal between the two portions.

One of the advantages of this structure is that the thermal break 204 can be linearly aligned along each fenestration member, which simplifies manufacturing. Referring to FIGS. 6-9, 17-23, 32-41, 43, 44, 49-54, 56-58, 60, 61, 63-66, and 68-71 the thermal break 204 is linearly aligned in each illustrated cross-section along the thermally isolating material, which in these figures is shown as thermal struts 211. Rigid or structural thermally isolating material, other than the thermal struts 211, with similar structural and thermal properties can be readily substituted. For example, poured or injected structural foam, such as high-density polyurethane foam, can be used in place of the thermal struts. An example of such a material is manufactured by Azon and sold under the brand name AZO-CORE™.

Referring to FIGS. 6-9, 17-20, 32-38, 43, 44, 49-53, 61, 63-66, and 68-71 the unprotected-environment-facing pane 209*a* and the protected-environment-facing pane 209*b* of the infill panels 209 are thermally isolated by an infill panel cavity 209*c* created by a spacer 209*d*. The infill panels 209 are shown seated against setting blocks 210 and shown secured to the sash 203 by glazing stops 212. The use of setting blocks 210 and glazing stops 212 in this manner is shown for illustrative purposes and is not an essential feature. Other ways of securing the infill panels 209 to sash 203 known in the art can be used without undo experimentation. For example, the infill panels 209 can be secured by wrap-around marine glazing (i.e. a gasket wrapping around the edge of infill panel 209 and seated in a u-shaped indented structure in the sash 203. The infill panel 209 can also be mounted by pocket glazing (i.e. the sash projects upward on one side to support one edge of the infill panel 209 while the opposing edge of the infill panel 209 is supported by a glazing stop 212. Similarly, while the infill panels 209 is shown as a double pane insulated glazing unit, other configurations are possible such as a triple pane insulated glazing unit.

Figure 24:
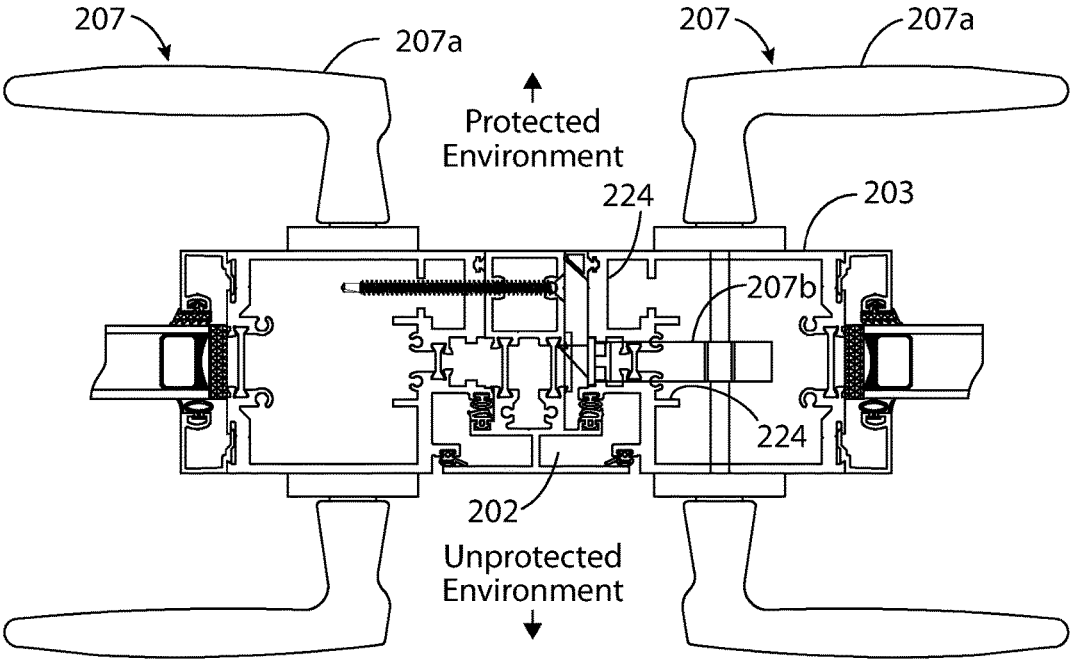
FIG. 24 illustrates the section of FIG. 16 taken along sections lines 17-17, with the door hardware mounted American-style instead of Euro-style as in FIG. 17.
Figure 25:
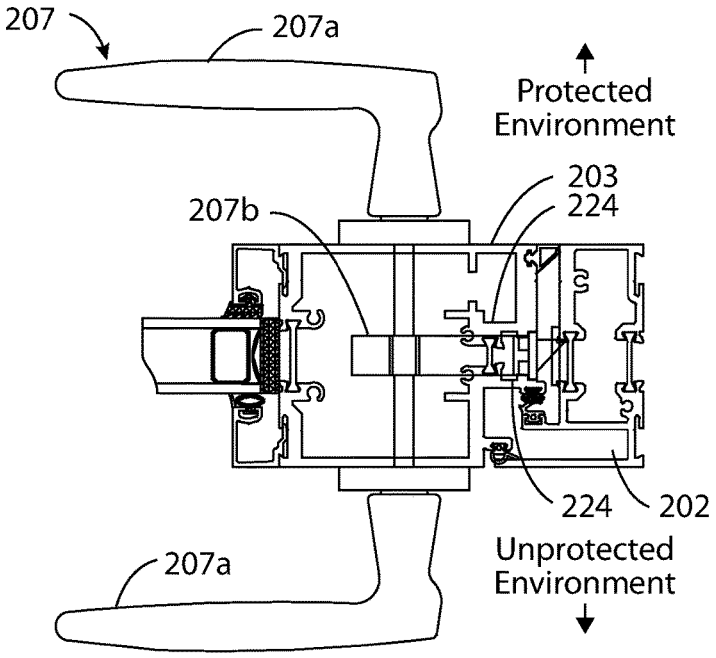
FIG. 25 illustrates the section of FIG. 5 taken along section lines 8-8 with the door hardware mounted American-style instead of Euro-style as in FIG. 8

As briefly discussed, the structure of the high-performance fenestration system lends itself to the use of more than one style of door hardware. The structure allows door hardware 207, as illustrated in FIGS. 8, 10B, and 17, showing both the door handle 207*a* lockset 207*b* mounted in the European-style or "Euro-style" on one side of the door. Because FIG. 8, 10B, or 17 illustrate an inswing door, the lockset 207*b* is installed on the interior side of the door. In contrast, for the door hardware 207, door handle 207*a*, and lockset 207*b* of FIGS. 24, 25, 38, 43, 46-49, 54, 55, 58, 59, and 65 show the lockset 207*b* mounted along the centerline of the doorframe as is consistent with American-style door hardware. As far as the inventor is aware, the inventor's high-performance fenestrations described within this disclosure are the only storm door systems that allow door hardware 207 to be mounted in either American-style or Euro-style within the same fenestration. Referring to FIGS. 24 and 25, the lockset 207*b* is mounted in one of two internal mounting grooves known as Euro-grooves 224. The Euro-grooves 224 are both isolated from the pressure chamber 202. The lockset 207*b* can mount into the either the Euro-groove 224 along the centerline of the sash 203 for American-style mounting or can mount the Euro-groove along the inside edge of the sash 203 for Euro-style mounting. Unlike prior art systems of FIGS. 1-4, door mounting hardware does not interfere with the pressure chamber 202 as shown in FIGS. 8, 10B, 17, 24, 25, 38, 43, 49, 54, 58, and 65. Therefore, the system performance should not be affected by changing the position of the locksets 207*b* in the inventor's high-performance fenestration system.

Figure 26:
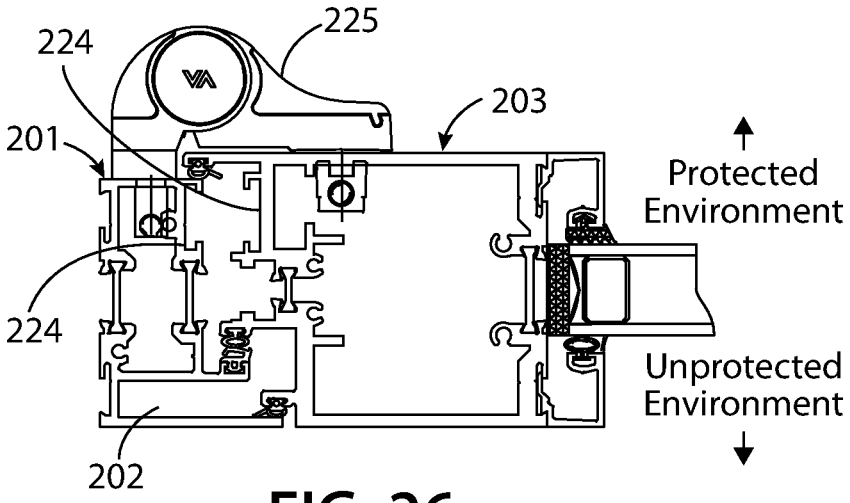
FIG. 26 illustrates the section of FIG. 5 taken along section lines 9-9 with an alternative hinge style replacing the hinge of FIG. 9.
Figure 27:
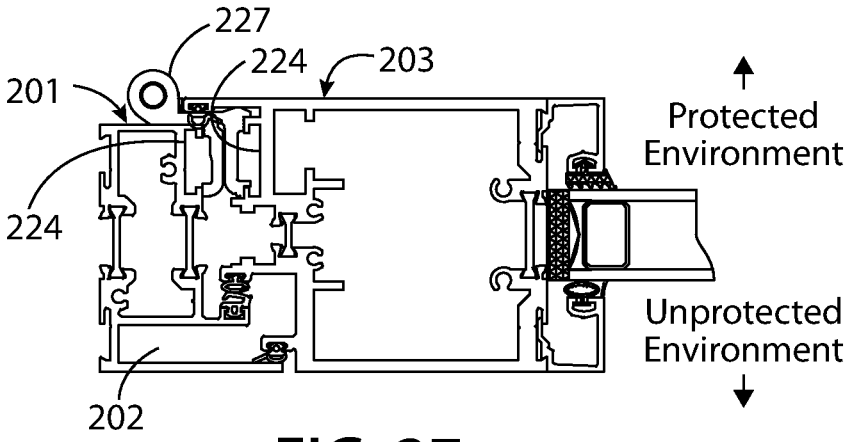
FIG. 27 illustrates the section of FIG. 5 taken along section lines 9-9 with an alternative Euro-style hinge replacing the American-style hinge of FIG. 9.
Figure 28:
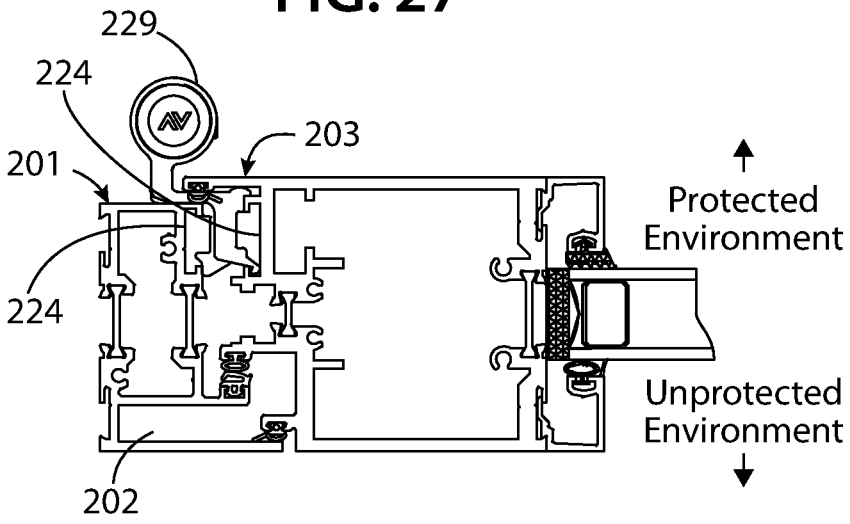
FIG. 28 illustrates the section of FIG. 5 taken along section lines 9-9 with another alternative Euro-style hinge replacing the American-style hinge of FIG. 9.

FIGS. 26-28 illustrate Euro-grooves 224 indented in opposing surfaces of the frame 201 and sash 203. As previously discussed, FIG. 26 illustrates an alternative American-style hinge 225. FIG. 27 shows a first style of Euro-style hinge 227 and FIG. 28, a second style of Euro-style hinge 229. The Euro-style hinges 227 229 of FIGS. 27 and 28 mount into the Euro-grooves 224 as illustrated. The alternative American-style hinge 225 of FIG. 26 does not utilize the Euro-grooves 224 but instead mounts into slots in both the sash 203 and frame 201.

Figure 29:
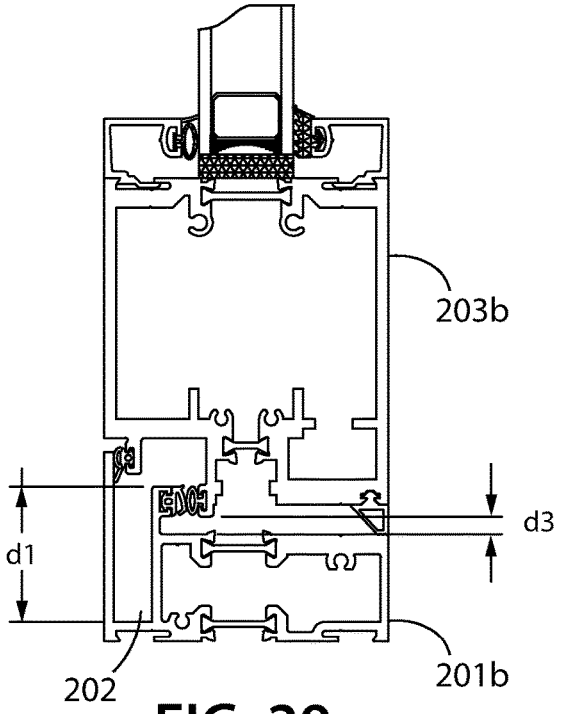
FIG. 29 illustrates the sill frame member and sill sash member of FIG. 7 showing the water column height d1 and clearance height d3.
Figure 30:
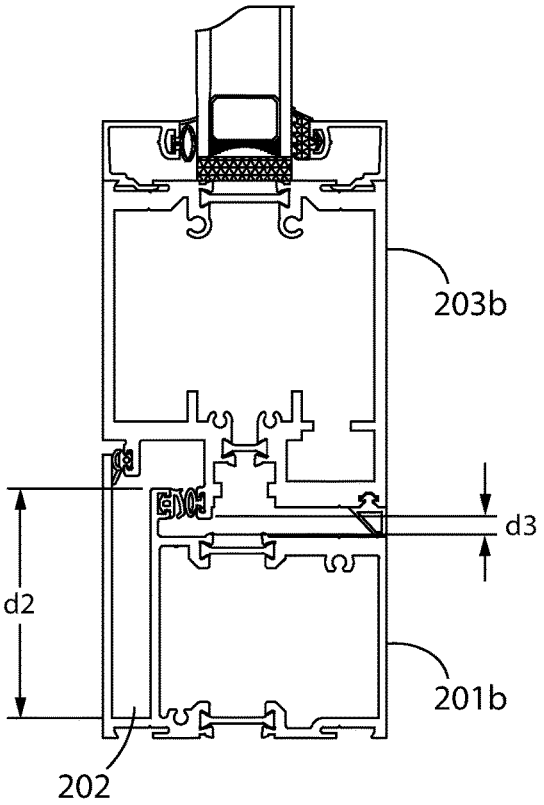
FIG. 30 illustrates that the water column height d2 can be varied from the water column height d1 of FIG. 29 without changing the basic structure of the sill sash member or sill frame member.

Another advantage of the improved high-performance fenestration of this disclosure is the ability to change the height of the water column without affecting other aspects of the structure of the fenestration. Referring to FIGS. 29 and 30, the water column height d1 of the pressure chamber 202 in FIG. 29 is extended in FIG. 30 to water column height d2. For example, a water column height of 1.4 inches (0.036 meters) could easily be extended to 2.4 inches (0.061 meters). These measurements are examples and are not limiting. Other heights may be used in FIGS. 29 and 30 as required by engineering or architectural specifications. In addition, the clearance d3 between the sill sash member 203*b* and the sill frame member 201*b* in FIGS. 26 and 27 could also be extended without significant changes to the structure of the fenestration. In contrast, many of the prior art fenestrations, such as the prior art inswing door 100 of FIGS. 1-4, require structural changes that could significantly affect performance if the water column height were extended. For example, the gooseneck gasket 113 or thermal strut projected portion 111*a* could lose their structural integrity and no longer function as intended.

Figure 45:
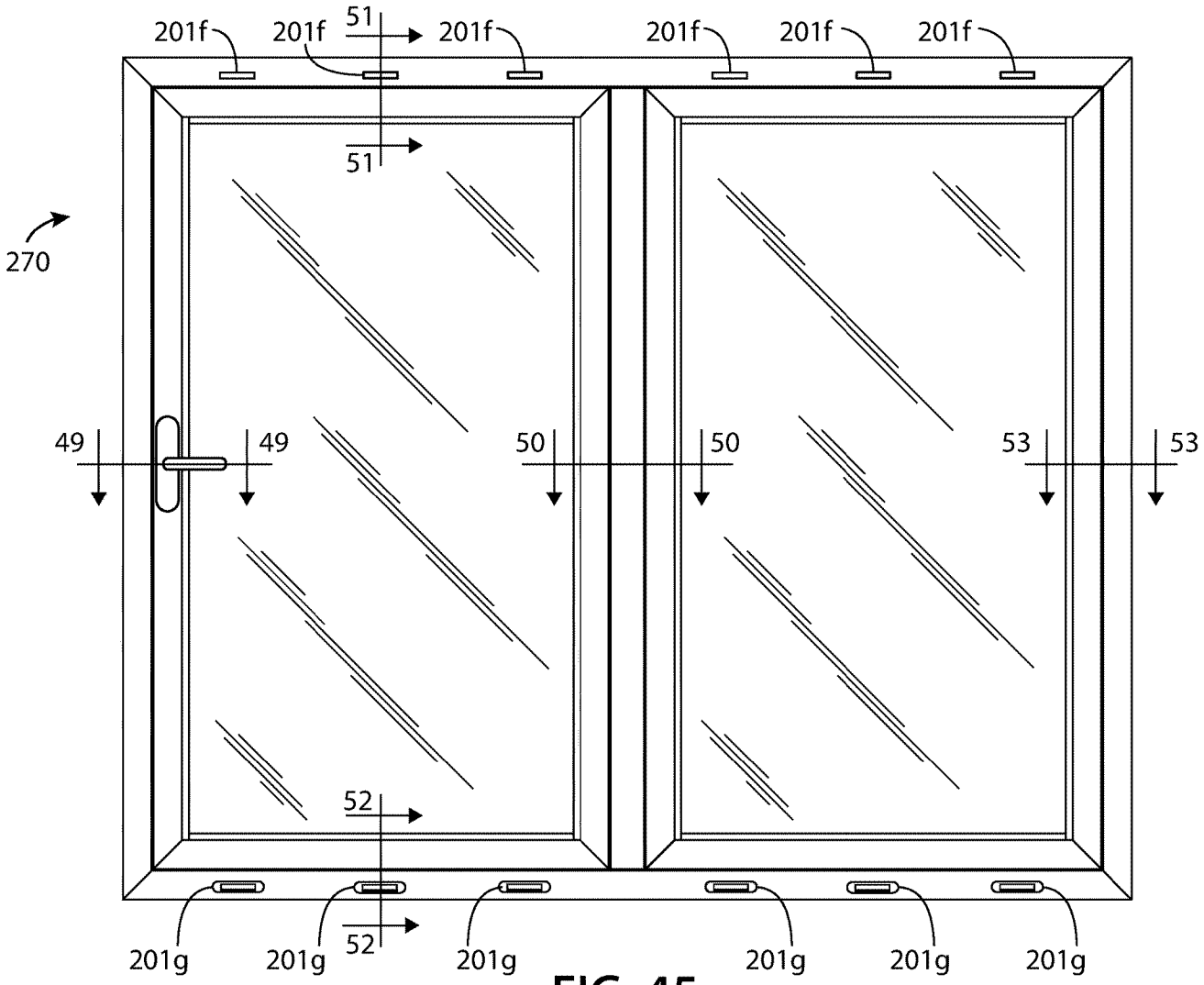
FIG. 45 illustrates a front elevation view of an improved bifold door of the present disclosure.
Figure 46:
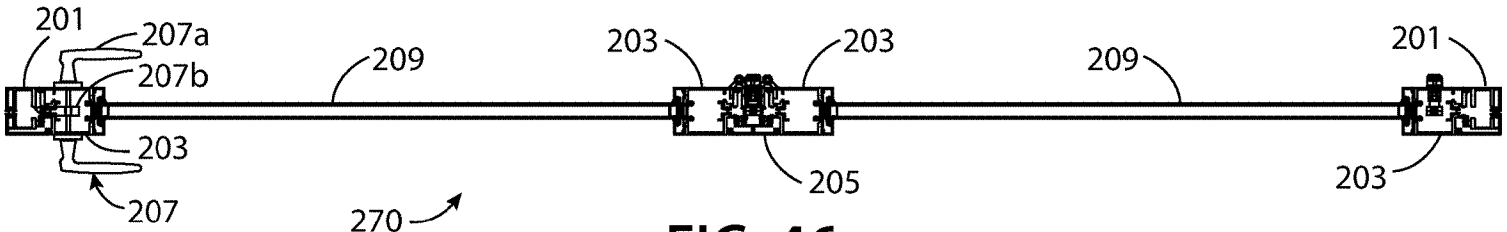
FIG. 46 illustrates a top plan view of the improved bifold door of FIG. 45 in a closed position.
Figure 47:
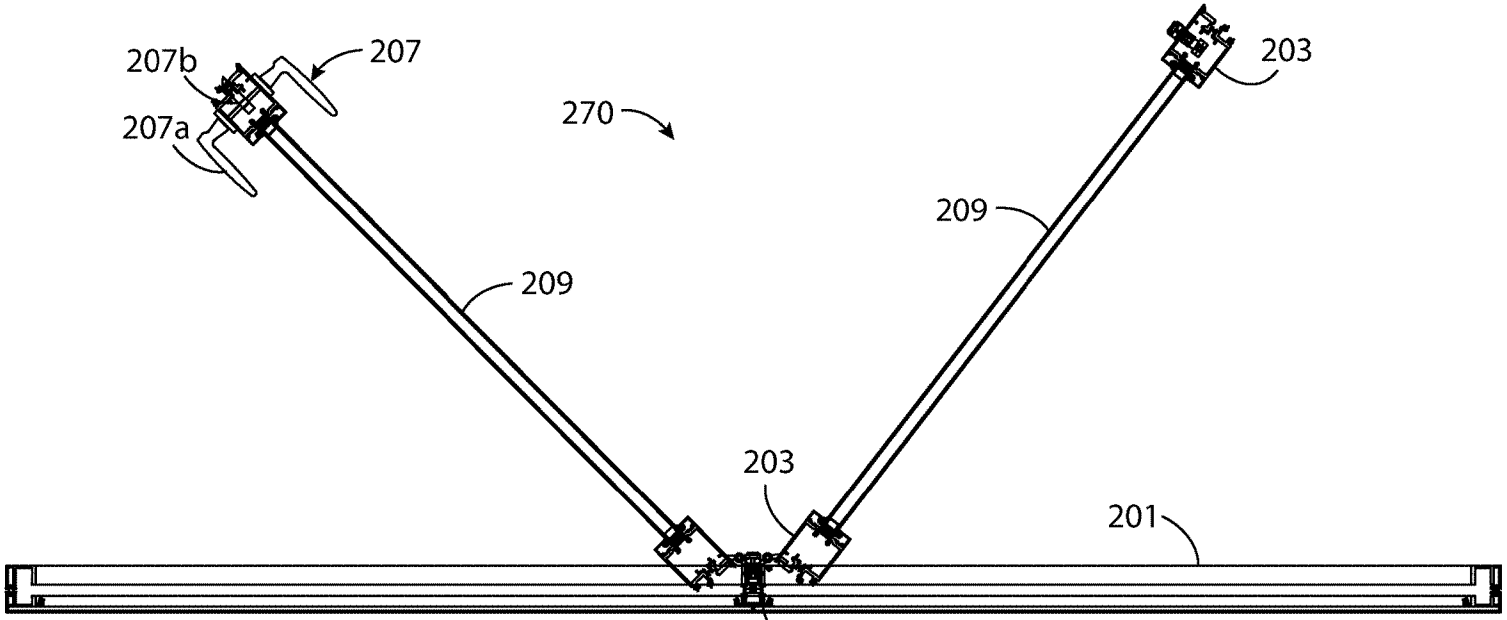
FIG. 47 illustrates a top plan view of the improved bifold door of FIG. 45 in a partially open position.
Figure 48:
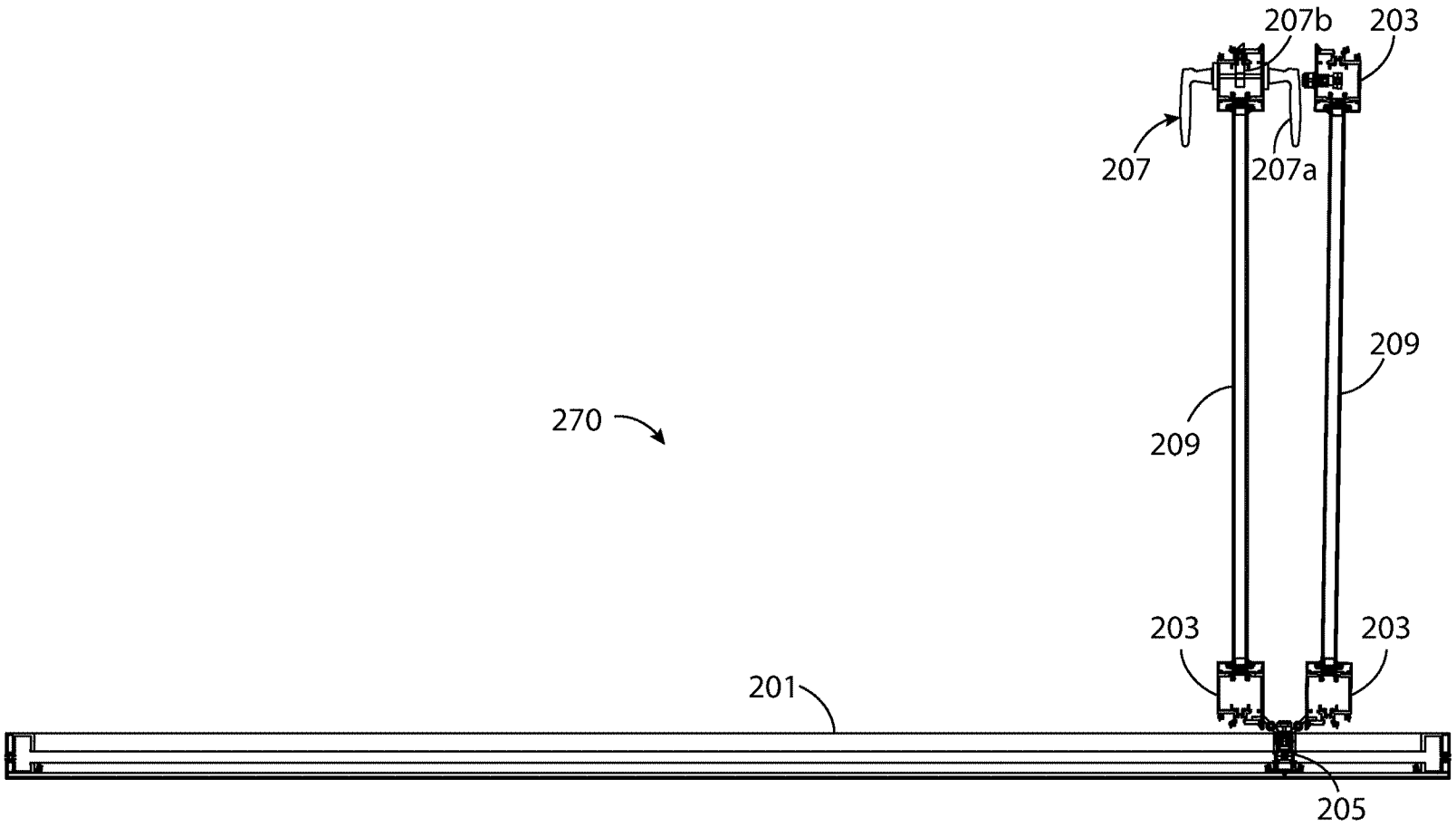
FIG. 48 illustrates a top plan view of the improved bifold door of FIG. 45 in a full open position.
Figure 49:
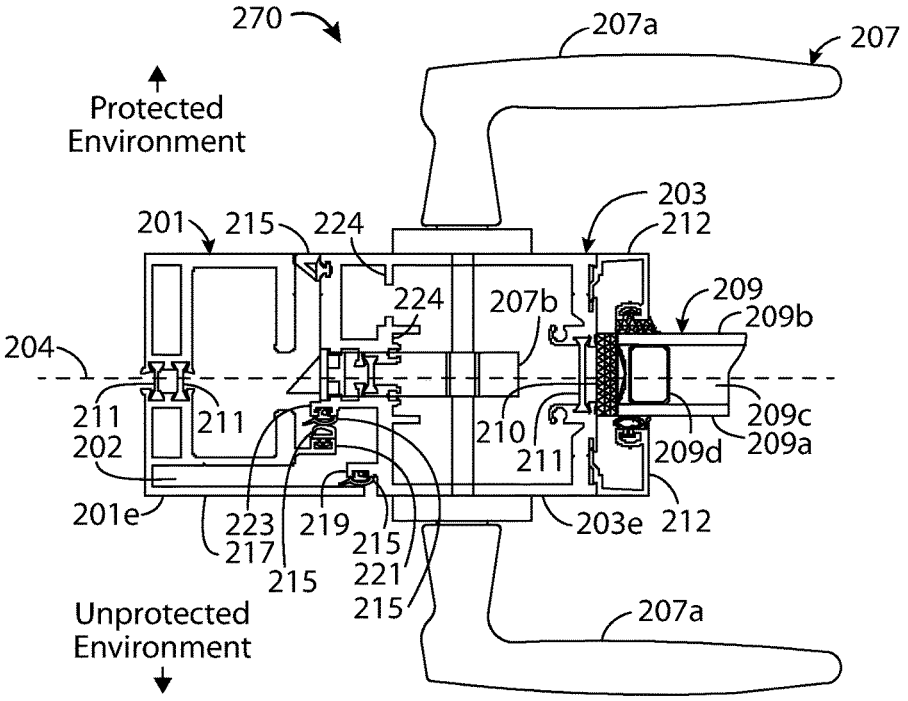
FIG. 49 illustrates a section of the improved bifold door of FIG. 45 taken along section lines 49-49 and showing the door hardware.
Figure 50:
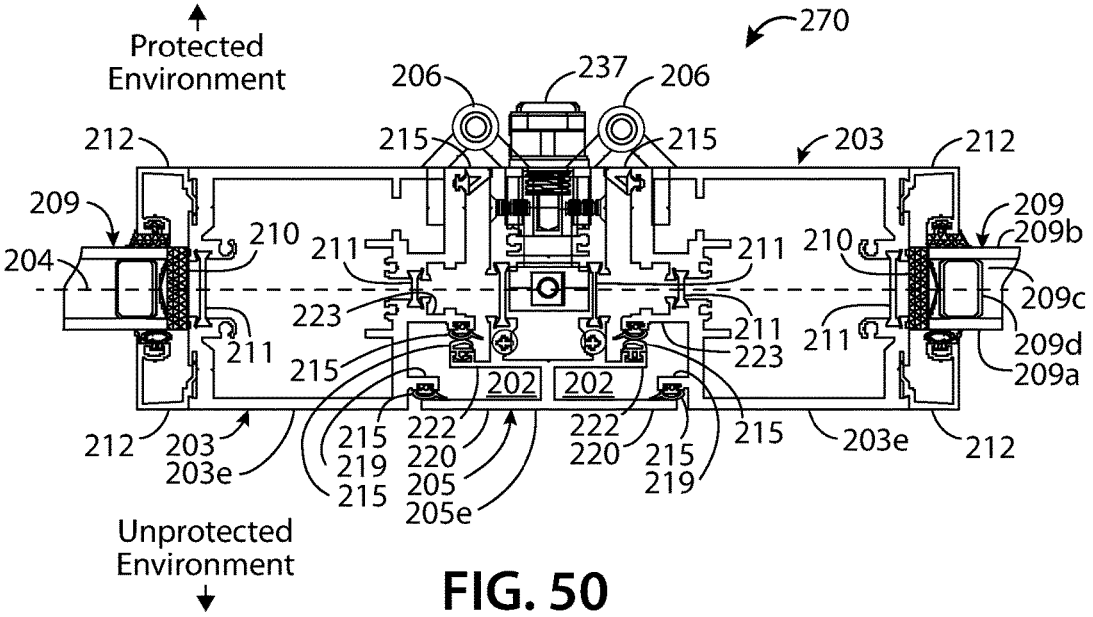
FIG. 50 illustrates a horizontal section of the improved bifold door of FIG. 45 taken along section lines 50-50 showing sections of the astragal and vertical sash members.
Figure 51:
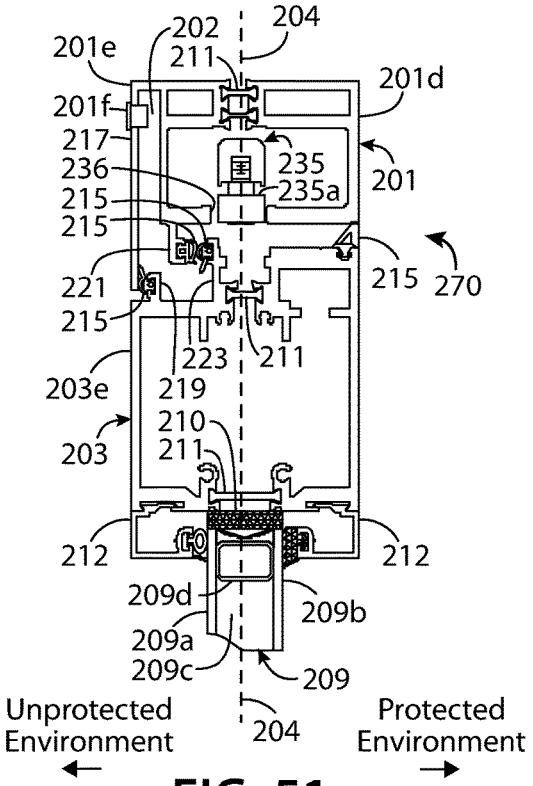
FIG. 51 illustrates a section of the improved bifold door of FIG. 45 taken along section lines 51-51 showing sections of the head frame and head sash member.
Figure 52:
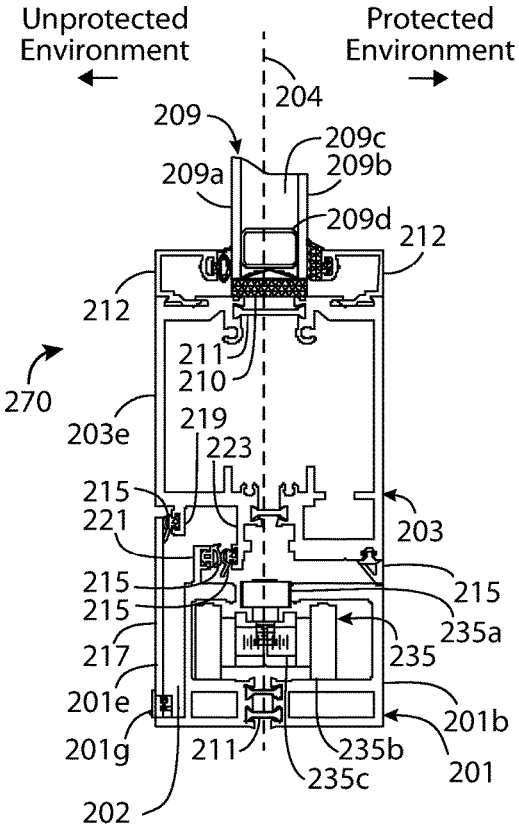
FIG. 52 illustrates a section of the improved bifold door of FIG. 45 taken along section lines 52-52 showing sections of the sill frame and sill sash members.
Figure 53:
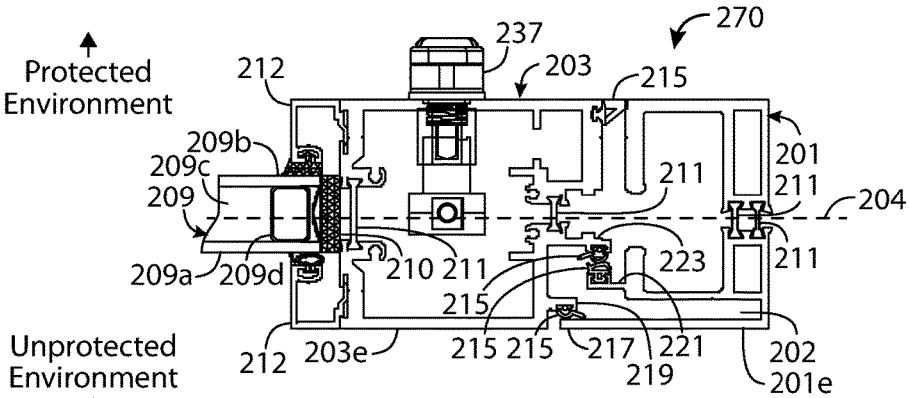
FIG. 53 illustrates a section of the improved bifold door of FIG. 45 taken along section lines 53-53 showing sections of the right vertical jamb and right vertical sash.
Figure 54:
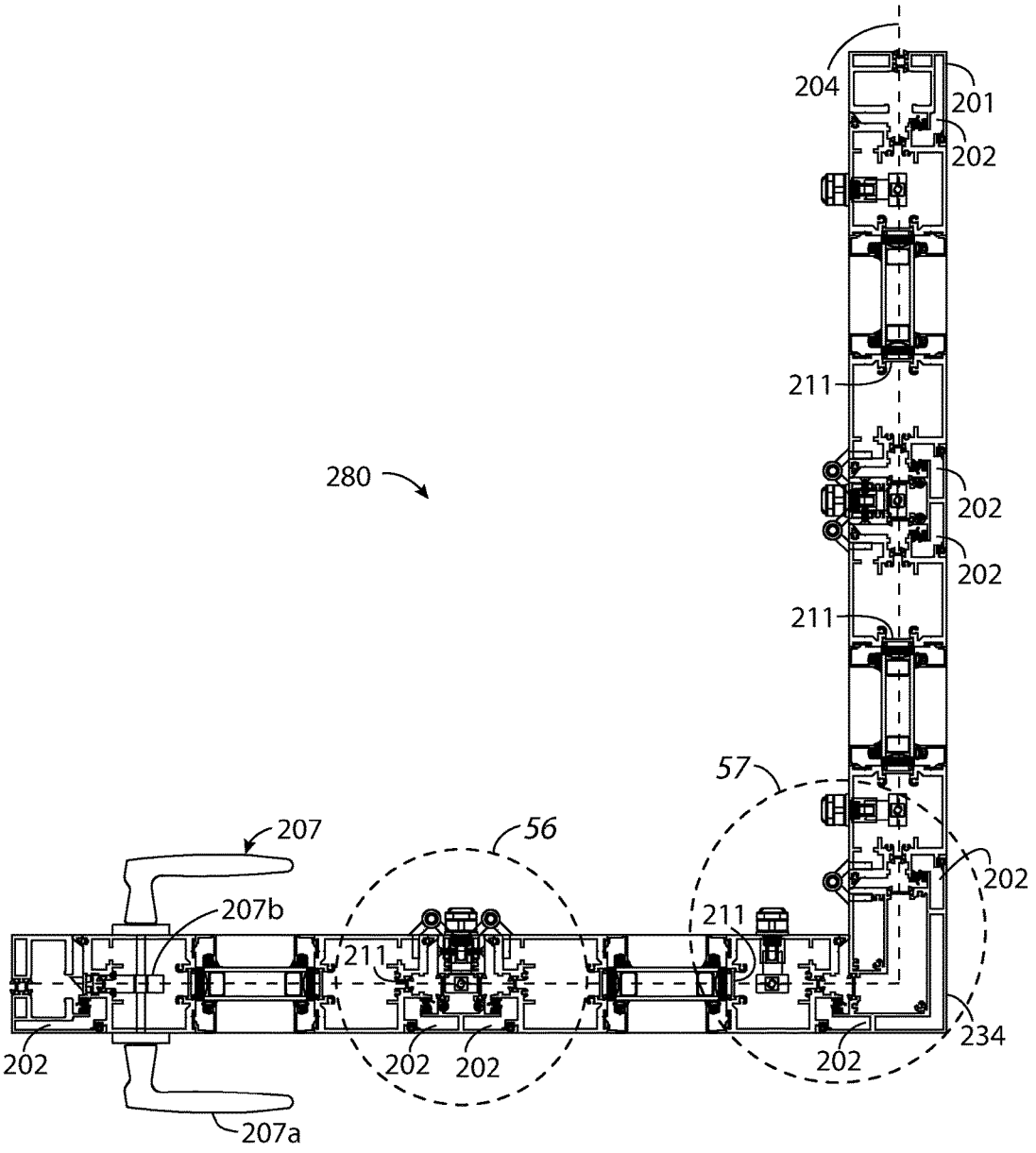
FIG. 54 illustrates a horizontal section of an improved corner bifold door in the closed position.

FIGS. 45-53 illustrate the improved high-performance fenestration in the form of an improved bifold door 270. Referring to FIGS. 46-48, the sashes 203 together with their corresponding infill panels 209, hinge away from the astragal 205. The astragal 205 is slidably captive to the frame 201. FIGS. 45-47 show the sequence of opening the doors starting with the closed position (FIG. 46) to the partially open position (FIG. 47), and sliding the astragal 205 with the doors to the fully open position (FIG. 48). The astragal 205 slides the frame 201 using a trolley assembly 235, which is illustrated in FIGS. 51 and 52. FIG. 51 shows the trolley assembly 235 sliding in the slot 236 formed between the unprotected-environment-facing frame portion 201*e* and the protected-environment-facing frame portion 201*d*. The trolley assembly 235 is shown including a roller bearing 235*a*. Other similar mechanisms to accommodate sliding within the slot 236 can be used. In addition, while this trolley assembly 235 is bottom-loading (i.e. the weight-bearing load is at the bottom of the door or window), the trolley assembly can also be top-loading (i.e. the weight-bearing load is carried at the top of the door or window). In FIG. 52, the trolley assembly 235 is illustrated including trolley wheels 235*b*, a roller bearing 235*a*, and an axle 235*c*. It is important to note that the pressure chambers 202 in FIGS. 51 and 52 are isolated from the trolley assembly 235. The presence of the trolley assembly 235 does not affect the function of the pressure chamber 202 and therefore, should not significantly affect the performance of the door.

As previously described, the pressure chambers 202 of the improved bifold door 270 of FIGS. 49-53 and the improved inswing French-style door 240 of FIGS. 17-23 share common principles of construction. In particular, in FIG. 50, as described for FIGS. 17 and 23, the first pair of projections includes a first sash projection 219 and a first astragal projection 220. The first sash projection 219 projects away from the unprotected-environment-facing sash portion 203*e* of the sash 203. The first astragal projection 220 is shown as the exterior-facing astragal portion 205*e*. A gasket 215 is attached to the first sash projection 219. The gasket 215 is positioned between the first sash projection 219 and the first astragal projection 220 and forms a seal between the two portions. The second pair of projections includes a second astragal projection 222 and a second sash projection 223. The second astragal projection 222 is shown as a portion of the interior of the astragal 205. The second sash projection 223 projects away from the interior of the unprotected-environment-facing sash portion 203*e*. Gaskets 215 are attached to the second sash projection 223 and the second astragal projection 222. These gaskets 215 form a seal between the two portions. Referring to FIGS. 50-53, while the improved bifold door 270 includes American-style hinges 206 (FIG. 50), a two-point lock assembly 237 (FIGS. 50 and 53), and moves along the frame 201 via a trolley assembly 235 (FIGS. 51 and 52), the pressure chamber 202 is independent of these elements just as it is independent of the lockset 207*b* and door hardware 207 of FIG. 17.

The improved bifold door 270 as shown in the cross sectional views of FIGS. 49-53 is structured so that the pressure chamber 202 is continuous around the perimeter of the frame 201 and sash 203 (FIGS. 49, 51-53), and astragal 205 and sash 203 (FIG. 50) in a similar manner as described for the improved inswing French-style door 240 of FIGS. 17-23.

FIGS. 45, 51, and 52 show the weep holes 201*f* (FIGS. 45 and 51) and weep flaps 201*g* (FIGS. 45 and 52) that function in the same manner as previous described.

Figure 55:
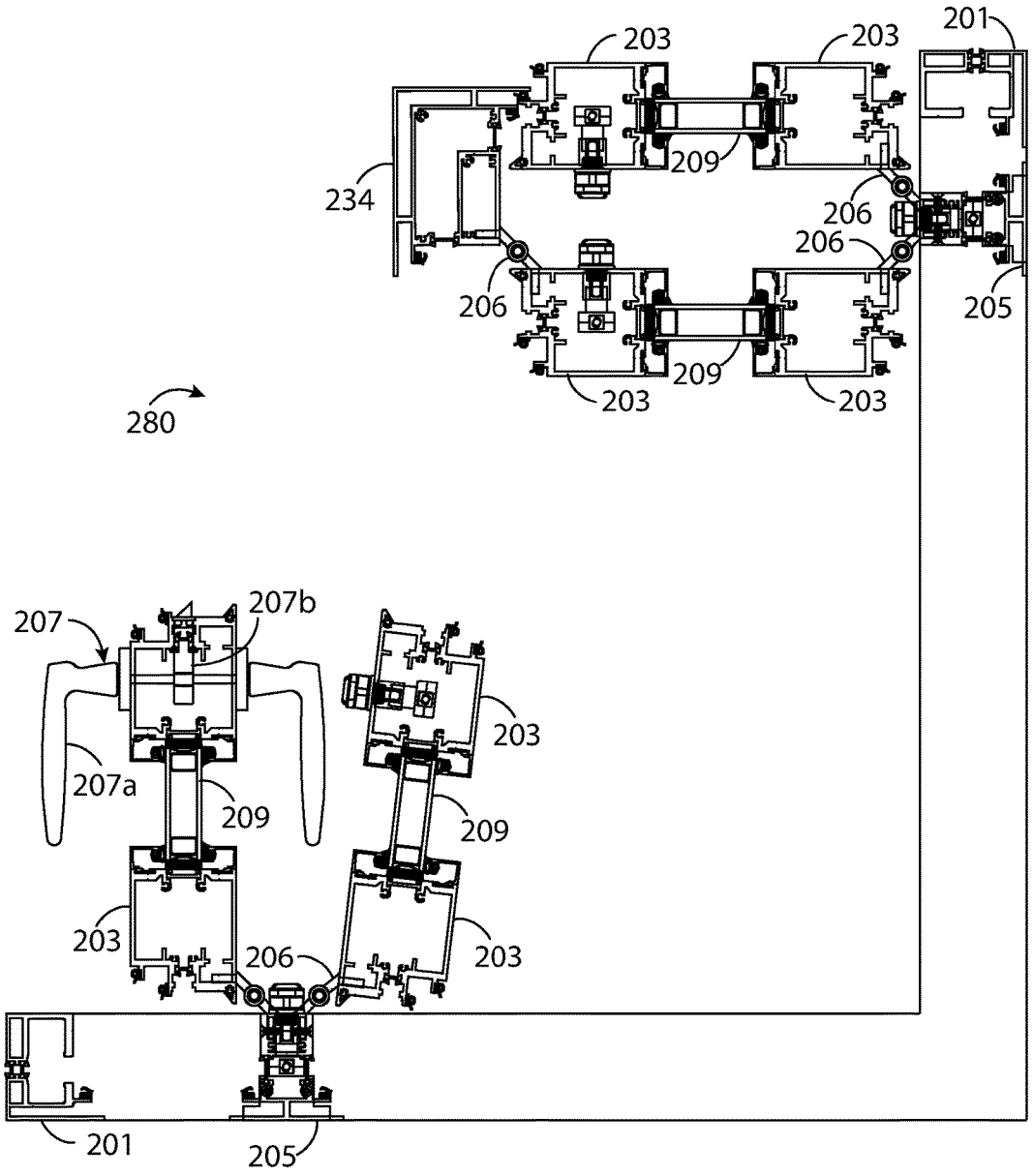
FIG. 55 illustrates a horizontal section of an improved corner bifold door in the open position.
Figure 56:
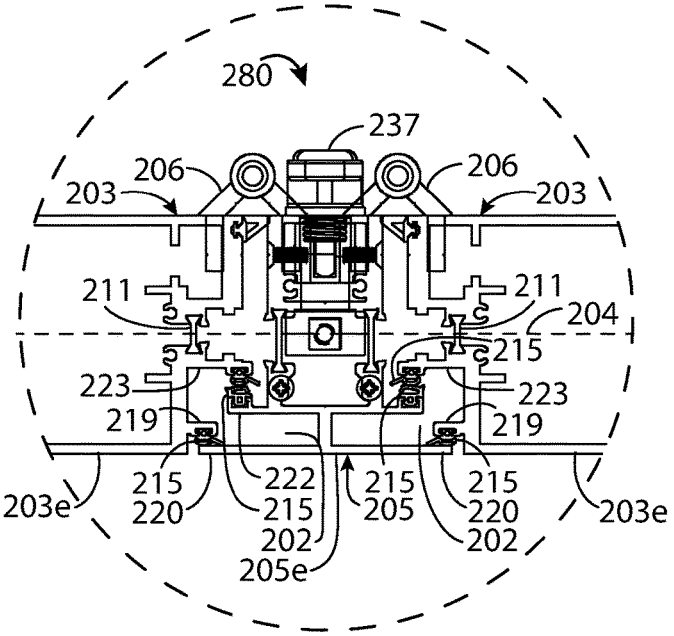
FIG. 56 illustrates a detailed view of the folding portion of the improved corner bifold door of FIG. 54.
Figure 57:
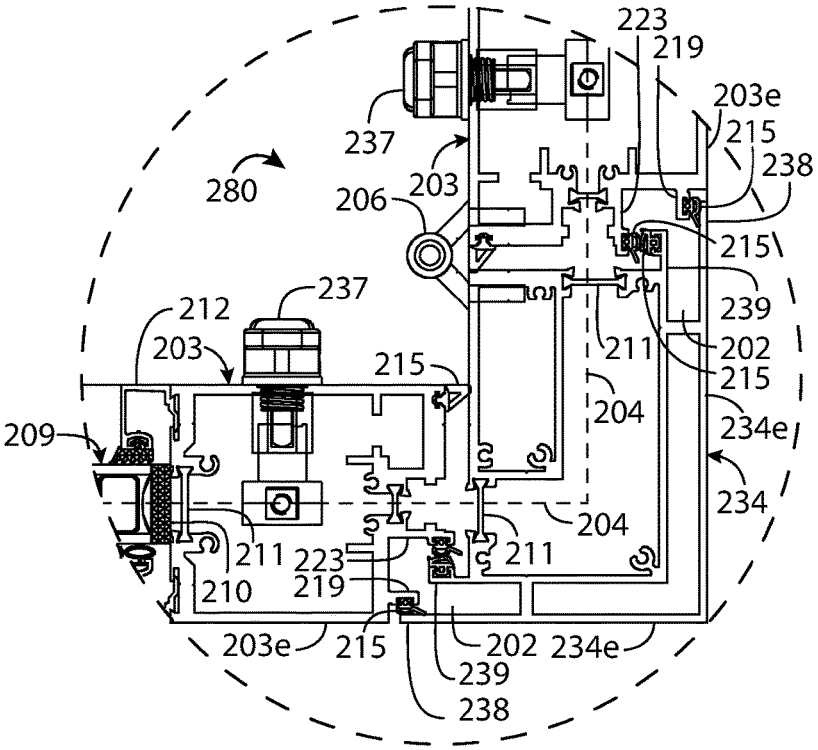
FIG. 57 illustrates a detailed view of a corner portion of the improved corner bifold door of FIG. 54.
Figure 58:
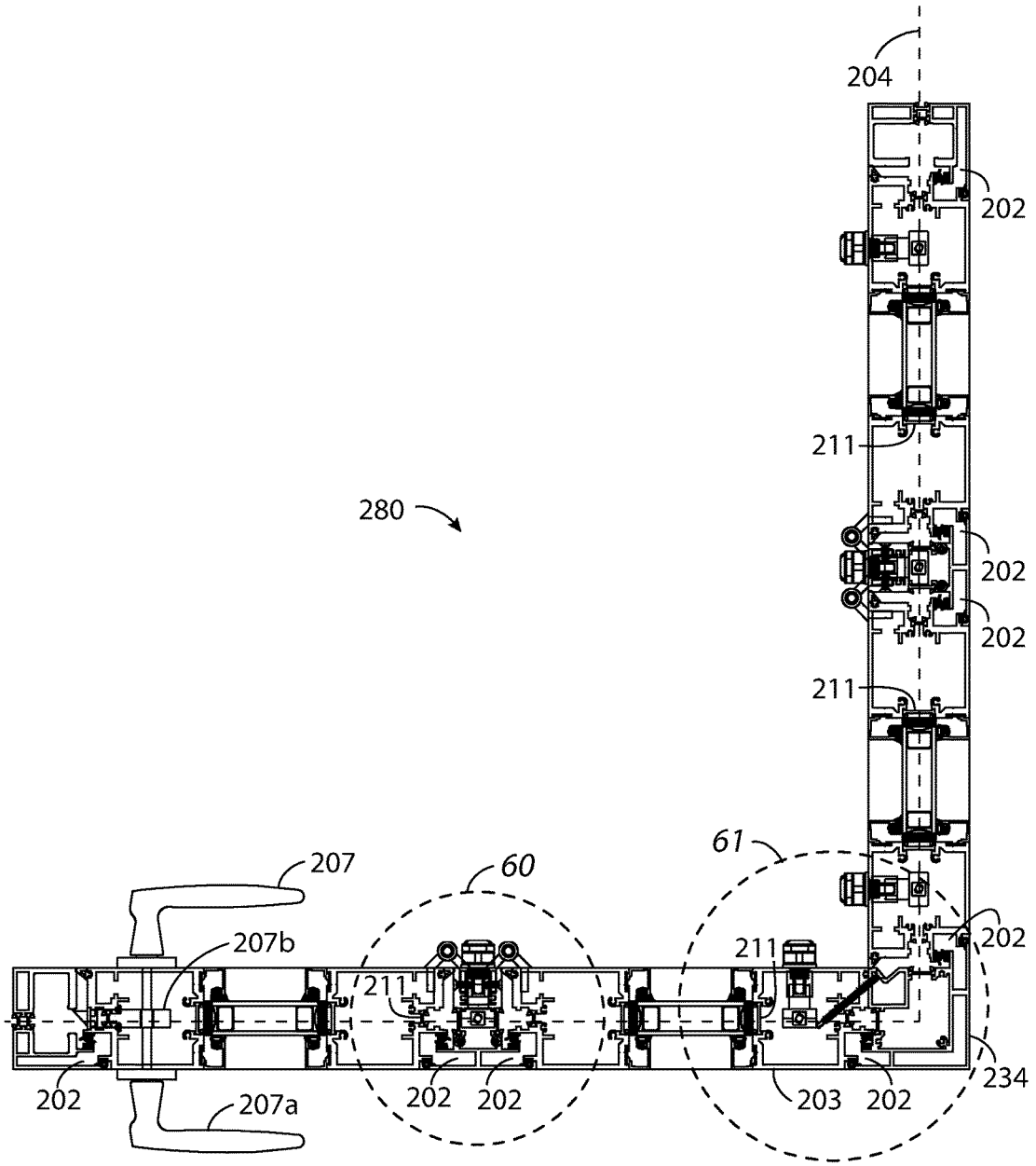
FIG. 58 illustrates a horizontal section of an alternative improved corner bifold door in the closed position.
Figure 59:
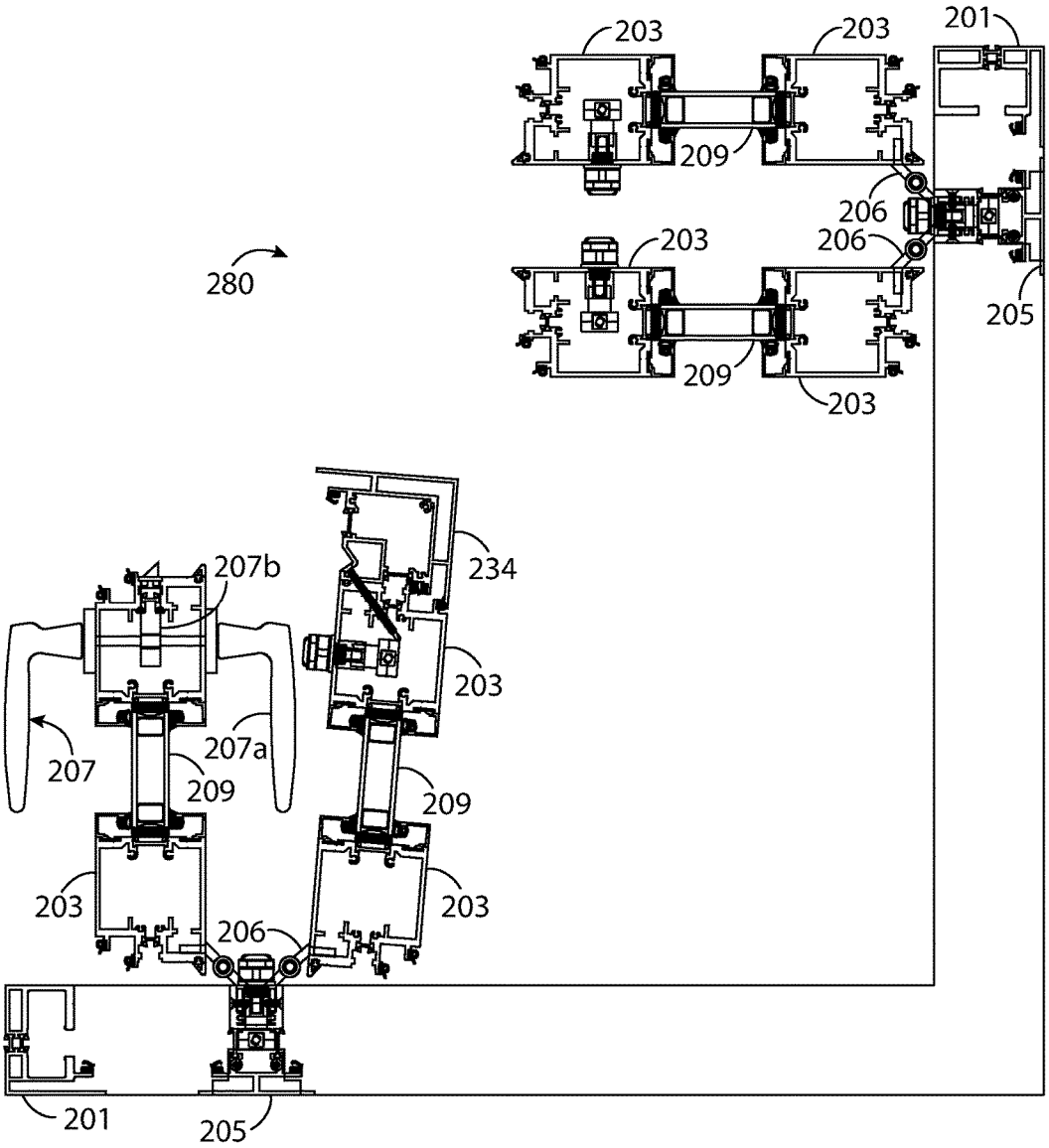
FIG. 59 illustrates a horizontal section of the alternative improved corner bifold door in the open position.
Figure 60:
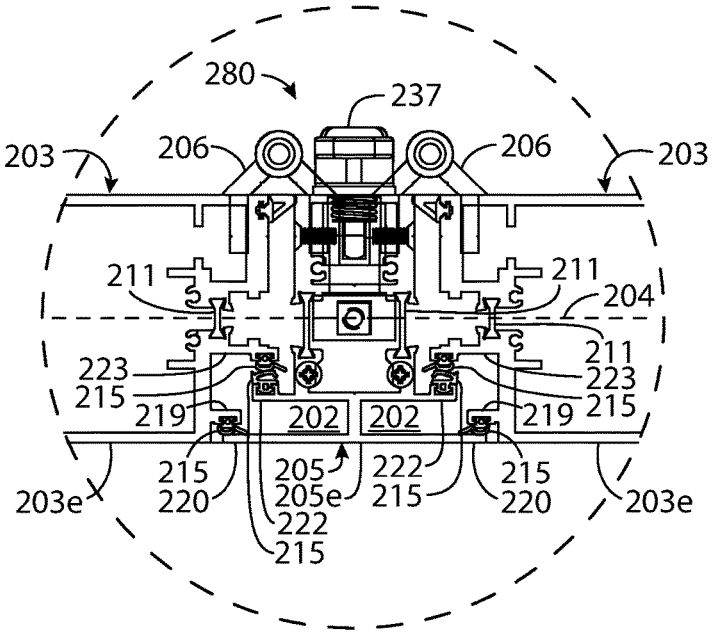
FIG. 60 illustrates a detailed view of a folding portion of the improved corner bifold door of FIG. 58.
Figure 61:
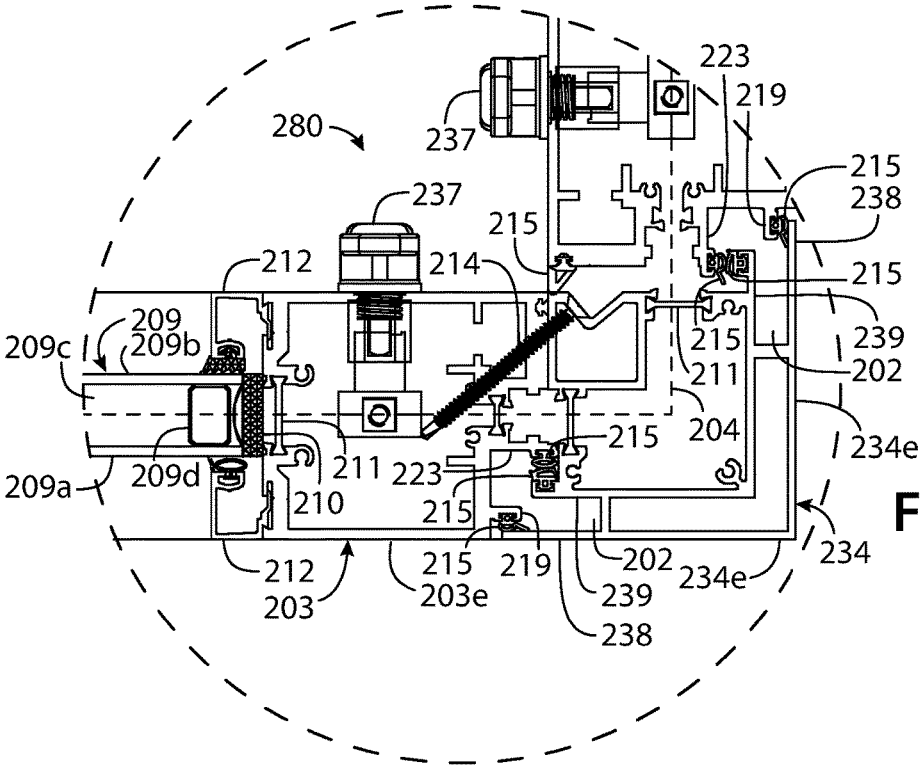
FIG. 61 illustrates a detailed view of a corner portion of the improved corner bifold door of FIG. 58.

FIGS. 54-61 shows two variations of an improved bifold corner door 280. The difference between the two variations is whether the corner member 234 is hingedly attached to the sash 203 (FIGS. 54, 55, and 57) or rigidly attached to the sash 203 (FIGS. 58, 59 and 61). As illustrated in FIGS. 55 and 59, the sashes 203 surrounding the infill panels 209 swing open in a V-shape by the American-style hinges 206 attached to the astragals 205. The astragals 205 slide along the frame 201. The main difference between the improved bifold corner door 280 and the improved bifold door 270 of FIGS. 45-53 is the L-shape of frame 201 of FIGS. 54 and 55 as compared with a linear shape of the frame 201 of FIGS. 46-48.

As illustrated in FIGS. 56, 57, 60, and 61, the pressure chamber 202 is formed by overlapping projections from longitudinally adjacent fenestration members as previously described for improved high-performance fenestrations of FIGS. 5-53 and 67-71. Referring to FIGS. 56 and 60, the first pair of projections includes a first astragal projection 220 and a first sash projection 219. The first astragal projection 220 is shown as a portion of the outside wall of the exterior-facing astragal portion 205*e* of the astragal 205. The first sash projection 219 projects away from the unprotected-environment-facing sash portion 203*e* of the sash 203. A gasket 215 is attached to the first sash projection 219 and is positioned between the first astragal projection 220 and the first sash projection 219 and forms a seal between the two portions. The second pair of projections includes a second astragal projection 222 and a second sash projection 223. The second astragal projection 222 is shown as a portion of the interior of the exterior-facing astragal portion 205*e*. The second sash projection 223 projects away from the interior of the unprotected-environment-facing sash portion 203*e*. Gaskets 215 are attached to the second sash projection 223 and the second astragal projection 222. These gaskets 215 form a seal between the two portions.

In FIGS. 57 and 61, the first pair of projections includes a first corner member projection 238 and a first sash projection 219. The first corner member projection 238 is shown as a portion of the outside wall of the exterior-facing corner member portion 234*e* of the corner member 234. The first sash projection 219 projects away from the unprotected-environment-facing sash portion 203*e* of the sash 203. A gasket 215 is attached to the first sash projection 219. The gasket 215 is positioned between the first corner member projection 238 and the first sash projection 219 and forms a seal between the two portions. The second pair of projections includes a second corner member projection 239 and a second sash projection 223. The second corner member projection 239 is shown as a portion of the interior of the exterior-facing corner member portion 234*e*. The second sash projection 223 projects away from the interior of the unprotected-environment-facing sash portion 203*e*. Gaskets 215 are attached to the second sash projection 223 and the second corner member projection 239. These gaskets 215 form a seal between the two portions. Gaskets 215 are shown on the non-chamber side of the fenestration in order to enhance isolation from the interior environment and to prevent infiltration of air from the exterior environment into the interior environment. In FIG. 61, the corner member 234 is shown rigidly attached to sash 203 on the lower left of the figure by a threaded fastener 214. In FIGS. 56-57, 60 and 61, the improved bifold corner door 280 includes a two-point lock assembly 237. The two-point lock assemblies 237 are isolated from the pressure chambers 202 and their presence therefore should not affect the performance of the pressure chamber 202.

FIGS. 62-66 illustrate an improved pivot door 290. The improved pivot door 290 includes pressure chamber 202 (FIGS. 63-66) that is isolated on one side of the thermal break 204. However, because of the nature of the operation of the improved pivot door 290, it does not include the overlapping projections as previously described for improved high-performance fenestrations of FIGS. 5-61 and 67-71. Referring to FIGS. 63-66, the outer seal of the pressure chamber 202 is formed by a blade gasket 241 from the unprotected-environment-facing frame portion 201*e* and the slot 245 in the unprotected-environment-facing sash portion 203*e*. The inner seal of the pressure chamber 202 is formed by brush gasket 243 positioned between the exterior-facing frame portion inner surface 201*h* and a corresponding interior portion of the unprotected-environment-facing sash portion 203*e*. The brush gasket 243 includes a brush surrounding a gasket seal. The gasket seal further enhances the sealing ability of the brush gasket. While the lack of overlapping projections creates a significant water resistance and performance disadvantage over the embodiments of FIGS. 5-61 and 67-71, this improved pivot door 290, by virtue of having the pressure chamber 202 isolated on one side of the thermal break 204 is a significant improvement over the existing art.

Figure 63:
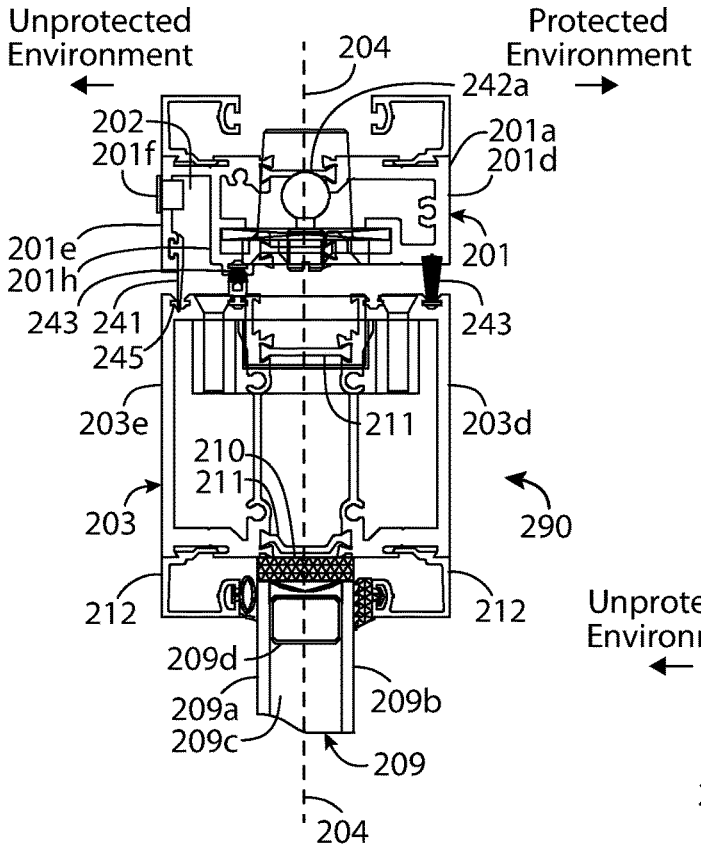
FIG. 63 illustrates a section of the improved pivot door of FIG. 62 taken along section lines 63-63.
Figure 64:
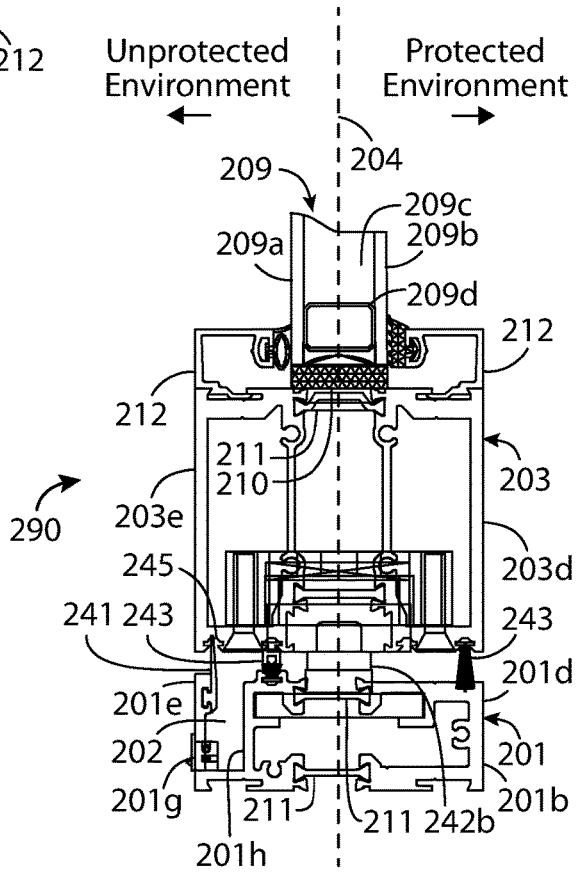
FIG. 64 illustrates a section of the improved pivot door of FIG. 62 taken along section lines 64-64.
Figure 65:
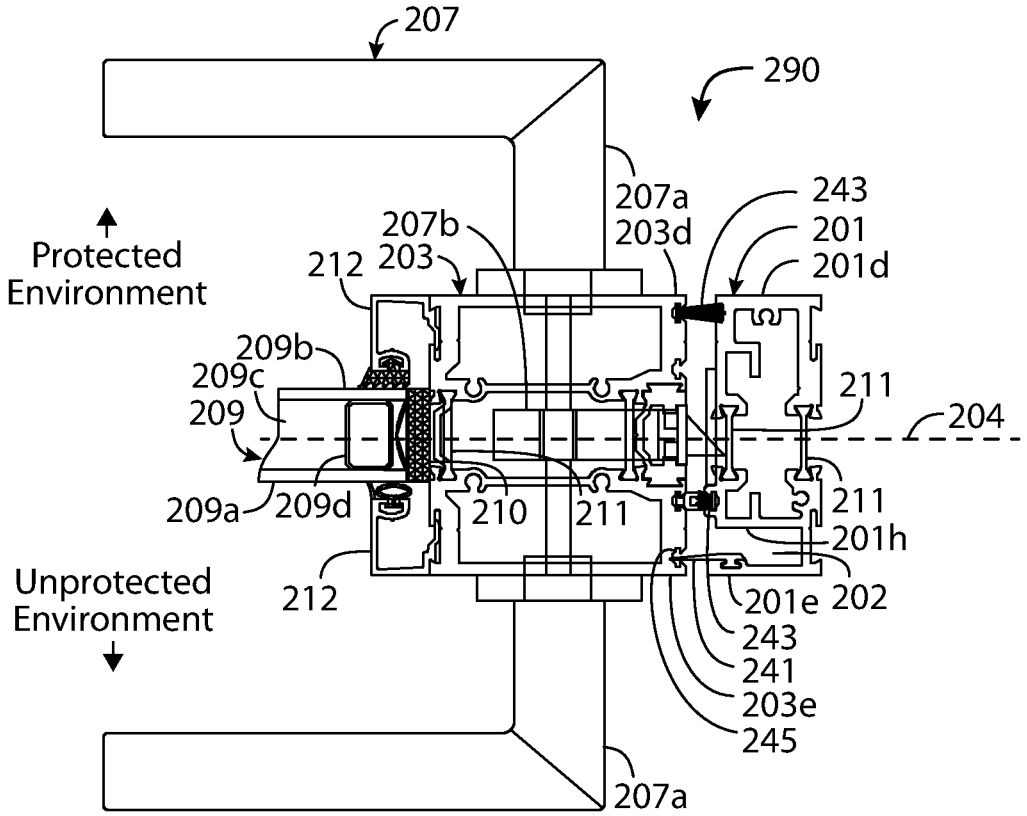
FIG. 65 illustrates a section of the improved pivot door of FIG. 62 taken along section lines 65-65.
Figure 66:
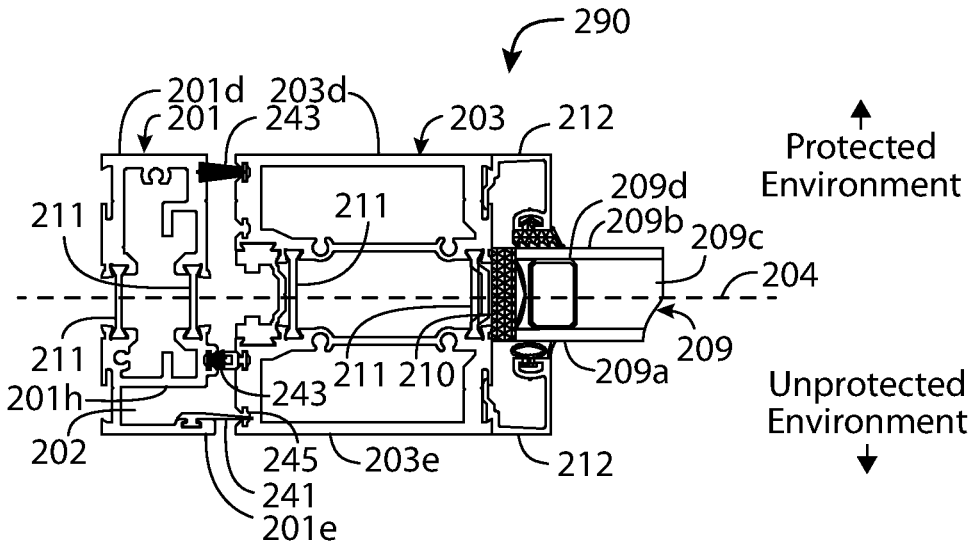
FIG. 66 illustrates a section of the improved pivot door of FIG. 62 taken along section lines 66-66.

In FIGS. 63 and 64, the door rotates about an upper pivot member 242*a* (FIG. 63) and a lower pivot member 242*b* (FIG. 64). The presence of the pivot does not affect the performance of the pressure chamber 202 because the pressure chamber 202 is isolated from the pivot.

Referring back to FIGS. 63-66, the protected-environment-facing frame portion 201*d* and protected-environment-facing sash portion 203*d* are coupled by a brush gasket 243. This brush gasket 243 helps to further isolate air between the fenestration and the interior environment.

Figure 62:
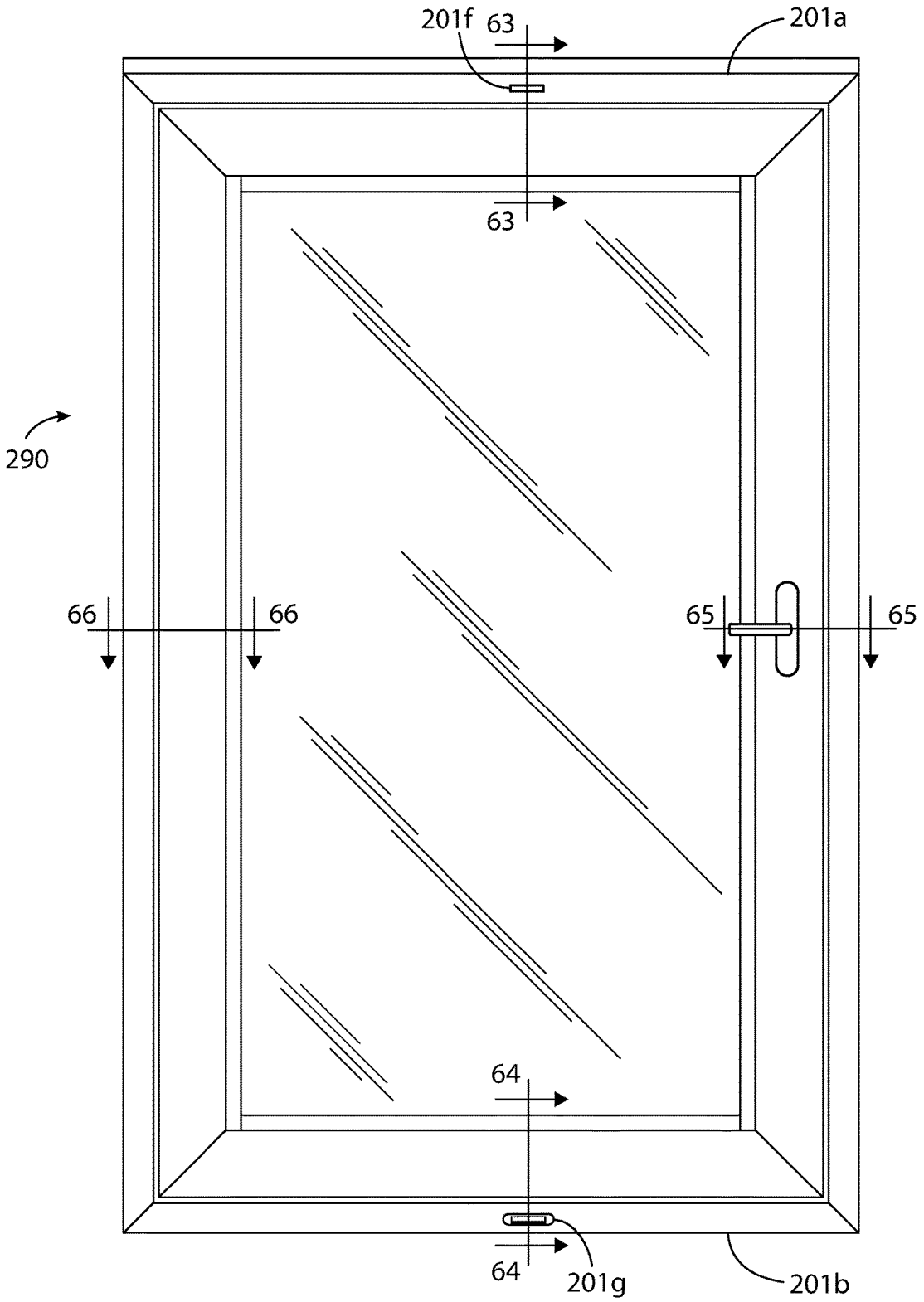
FIG. 62 illustrates a front elevation view of an improved pivot door of the present disclosure.

In FIGS. 63-66, like the high-performance fenestrations of FIGS. 5-61 and 67-71, the pressure chambers 202 of each of the fenestration frame members of the improved pivot door 290 is shaped and arranged as to create a pressure chamber 202 that is continuous between the inside perimeter of the frame 201 and the outside perimeter of the sash 203. This pressure chamber 202 that extends continuously around these perimeters can be constructed as previously described. Referring to FIGS. 62-64, the improved pivot door 290 can include weep holes 201*f* (FIGS. 62 and 63) and weep flaps 201*g* (FIGS. 62 and 64). The weep holes 201*f* and the weep flaps 201*g* are added to the frame 201 to allow air pressure from wind and the outside environment to build up within the pressure chamber 202 (FIGS. 63 and 64), as previously described. The weep holes 201*f* are positioned in head frame member 201*a* (FIGS. 62 and 63) and the weep flaps 201*g* are shown positioned in the sill frame member 201*b* (FIGS. 62 and 64).

Figure 67:
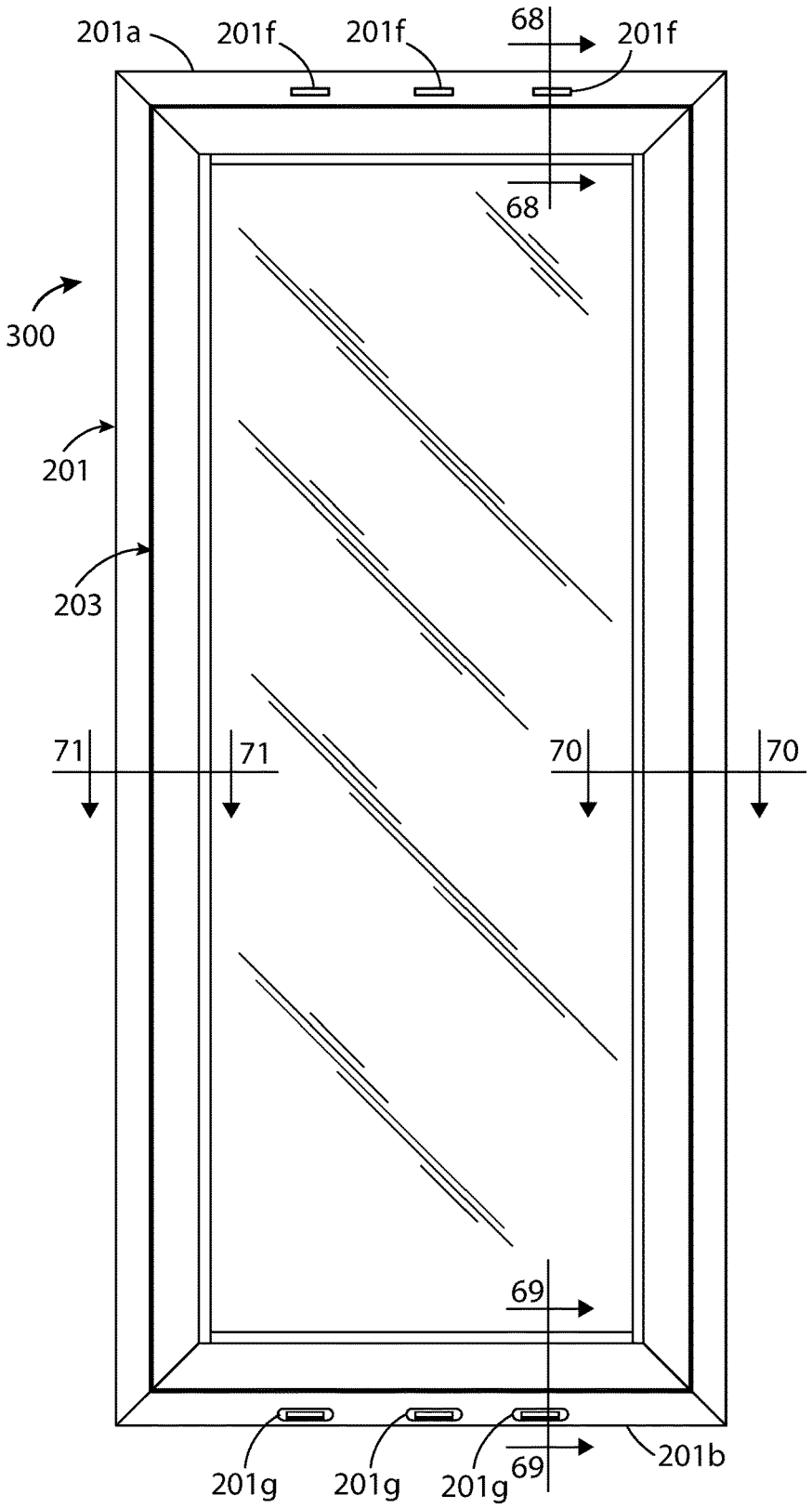
FIG. 67 illustrates the improved fixed-lite fenestration of the present disclosure in front elevation view.
Figure 68:
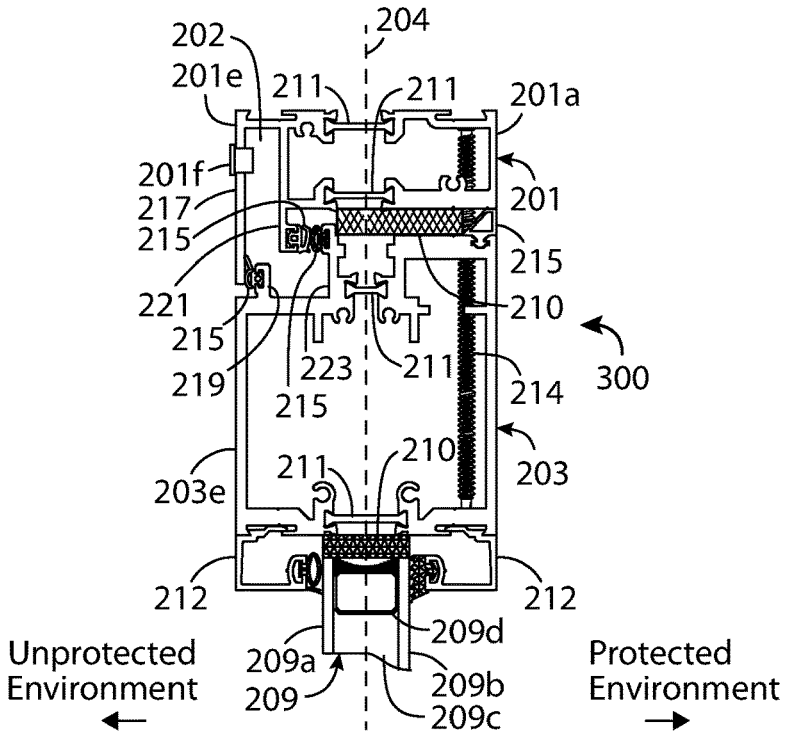
FIG. 68 illustrates a section of a head frame and a head sash of an improved fixed-lite fenestration taken along section lines 68-68 in FIG. 67.
Figure 69:
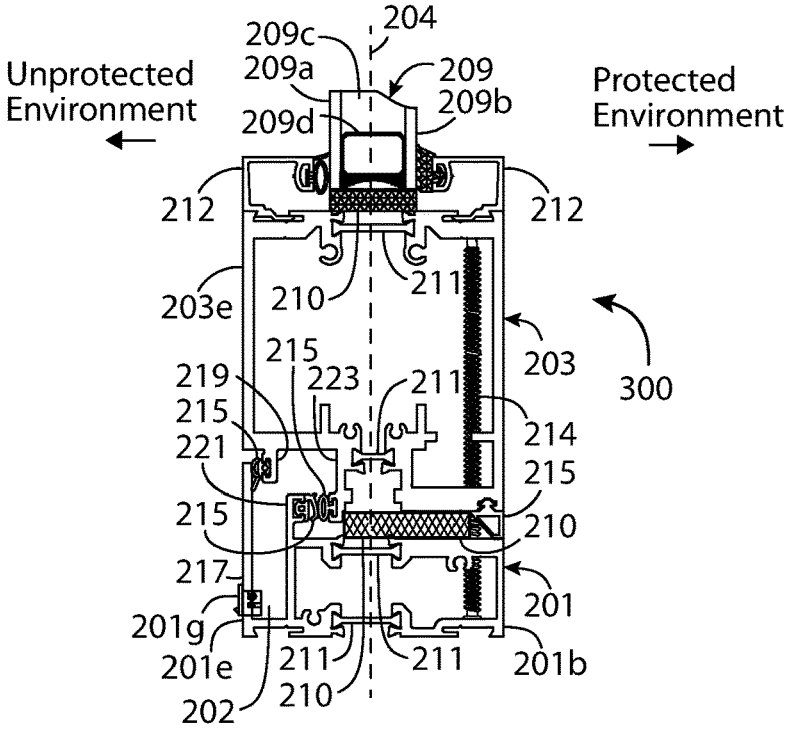
FIG. 69 illustrates a section of a sill frame and a sill sash of an improved fixed-lite fenestration taken along section lines 69-69 in FIG. 67.
Figure 70:
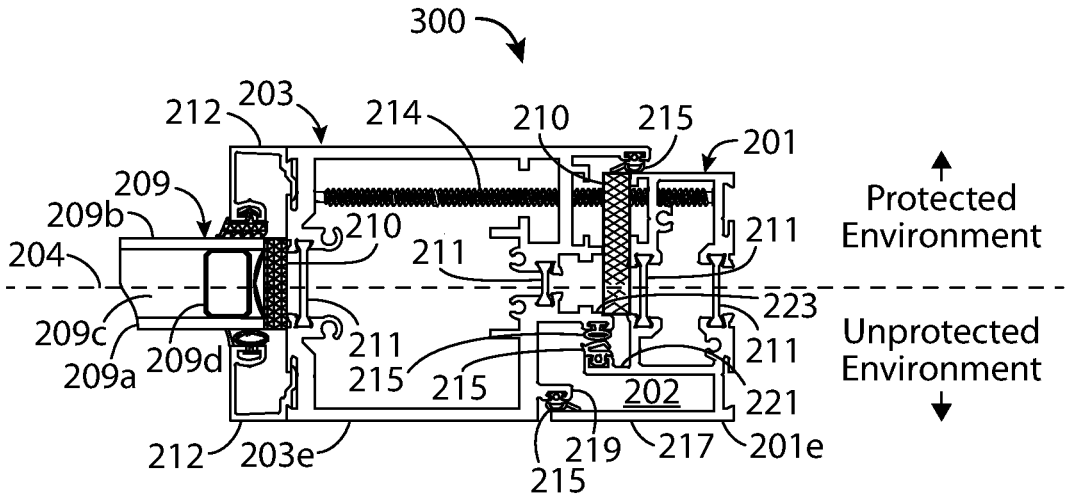
FIG. 70 illustrates a section of an improved fixed-lite fenestration taken along section lines 70-70 in FIG. 67.

Referring to FIGS. 5-9 and FIGS. 67-71, the improved inswing door 200 (FIGS. 5-9) can easily be configured as an improved fixed-lite fenestration 300 (FIGS. 67-71) by removing the American-style hinge 206 (FIG. 9), the door hardware 207 (FIG. 8) and securing the sash 203 and frame 201 (FIGS. 67-71) by a threaded fastener 214 (FIGS. 68-71). Referring to FIGS. 68-71, setting blocks 210 can be placed between the sash 203 and frame 201 to keep the sash 203 and frame 201 from twisting as the secured to each other by the threaded fastener 214. Referring to FIGS. 67-69, weep holes 201*f*, positioned in the head frame member 201*a* and weep flaps 201*g* positioned in the sill frame member 201*b* allow air from the unprotected environment (for example, the building exterior) to enter the pressure chamber 202 to help equalize the pressure, as previously described. The pressure chamber 202 of FIGS. 68-71 is positioned and aligned, as illustrated so that a continuous pressure chamber is formed between the inside perimeter of the frame 201 and outside perimeter of the sash 203 of FIG. 67 in a manner previously described. While this is one example, other variations that utilize the pressure chamber 202 on one side of the thermal break 204 can be within the scope of an improved fixed-lite fenestration 300.

An improved high-performance fenestration system has been described. It is not the intent of this disclosure to limit the claimed invention to the examples, variations, and exemplary embodiments described in the specification. Those skilled in the art will recognize that variations will occur when embodying the claimed invention in specific implementations and environments. For example, it is possible to implement certain features described in separate embodiments in combination within a single embodiment. Similarly, it is possible to implement certain features described in single embodiments either separately or in combination in multiple embodiments. It is the intent of the inventor that these variations fall within the scope of the claimed invention. While the examples, exemplary embodiments, and variations are helpful to those skilled in the art in understanding the claimed invention, it should be understood that, the scope of the claimed invention is defined solely by the following claims and their equivalents.

What is claimed is:

1. A fenestration system, comprising:

a first fenestration frame member and a second fenestration frame member longitudinally adjacent to the first fenestration frame member each including a respective interior-facing portion facing a protected environment, a respective exterior-facing portion facing an unprotected environment; a thermally insulating material fixedly joining the respective interior-facing portion and the respective exterior-facing portion to form a unified structure and the thermally insulating material defining a thermal break between therebetween;

the first fenestration frame member includes a first pair of directly projected integral portions and the second fenestration frame member includes a second pair of directly projected integral portions; and a pressure chamber positioned entirely on one side of the thermal break and formed by overlapping the first pair of directly projected integral portions and the second pair of directly projected integral portions.

2. The fenestration system of claim 1, further including:

a lockset positioned within the first fenestration frame member; and the lockset is positionable in a first location in a Euro-style position and in a second location in an American-style position; and the first location is on an opposing side of the thermal break as the pressure chamber.

3. The fenestration system of claim 1, further including:

a hinge positioned between the first fenestration frame member and the second fenestration frame member on an opposing side of the thermal break as the pressure chamber.

4. A fenestration system, comprising:

an insulated infill panel;

a sash surrounding the insulated infill panel and including a sash member;

a fenestration frame member longitudinally adjacent with the sash member, the sash operable with respect to the fenestration frame member;

the sash member and the fenestration frame member each including a respective interior-facing portion facing a protected environment, a respective exterior-facing portion facing an unprotected environment, and a thermally insulating material fixedly joining the respective interior-facing portion and the respective exterior-facing portion to form a unified structure and the thermally insulating material defining a thermal break therebetween;

the sash member includes a first pair of directly projected integral portions and the fenestration frame member includes a second pair of directly projected integral portions;

a pressure chamber positioned entirely on one side of the thermal break and formed by overlapping the first pair of directly projected integral portions and the second pair of directly projected integral portions.

5. The fenestration system of claim 4, wherein:

the sash member is a first sash member, a second sash member, a third sash member, and a fourth sash member, the sash member forming a perimeter about the sash;

the fenestration frame member is a first fenestration frame member longitudinally adjacent to the first sash member, a second fenestration frame member longitudinally adjacent to the second sash member, a third fenestration frame member longitudinally adjacent to the third sash member, and a fourth fenestration frame member longitudinally adjacent to the fourth sash member; and the pressure chamber forming a continuous pressure chamber around the perimeter of the sash and interior perimeter of the fenestration frame member.

6. The fenestration system of claim 4, wherein:

overlapping portions of the first pair of directly projected integral portions and the second pair of directly projected integral portions are parallel therewith and are parallel to a plane of the sash.

7. The fenestration system of claim 4, wherein:

the sash member is a first sash member, a second sash member, a third sash member, and a fourth sash member, the sash member forming a perimeter about the sash;

the fenestration frame member is a first fenestration frame member longitudinally adjacent to the first sash member, a second fenestration frame member longitudinally adjacent to the second sash member, a third fenestration frame member longitudinally adjacent to the third sash member, and a fourth fenestration frame member longitudinally adjacent to the fourth sash member; and the pressure chamber forming a continuous pressure chamber around the perimeter of the sash and interior perimeter of the fenestration frame member.

8. The fenestration system of claim 4, further including:

a lockset positioned within the sash member; and the lockset is positionable in a first location in a Euro-style position and in a second location in an American-style position; and the first location on is an opposing side of the thermal break as the pressure chamber.

9. A fenestration system, comprising:

an insulated infill panel;

a sash surrounding the insulated infill panel and including a sash member;

a fenestration frame member longitudinally adjacent with the sash member, the sash operable with respect to the fenestration frame member;

the sash member and the fenestration frame member each including a respective interior-facing portion facing a protected environment, a respective exterior-facing portion facing an unprotected environment, and a thermally insulating material fixedly joining the respective interior-facing portion and the respective exterior-facing portion to form a unified structure and the thermally insulating material defining a thermal break therebetween;

the sash member includes a first sash projection and a second sash projection, each projecting directly and integrally from the sash, the first sash projection being shorter lengthwise than the second sash projection;

the fenestration frame member includes a first frame projection and a second frame projection, each projecting directly and integrally from the fenestration frame member;

a pressure chamber positioned entirely on one side of the thermal break and formed by overlapping the first frame projection with the first sash projection and the second frame projection with the second sash projection forming the inner most boundary of the pressure chamber.

10. The fenestration system of claim 9 wherein the pressure chamber includes a water column.

11. The fenestration system of claim 1 wherein the pressure chamber includes a water column.

12. The fenestration system of claim 4 wherein the pressure chamber includes a water column.

* * * * *